US010267491B1

(12) United States Patent
Gordin et al.

(10) Patent No.: US 10,267,491 B1
(45) Date of Patent: Apr. 23, 2019

(54) SHARP CUTOFF LED LIGHTING FIXTURE AND METHOD OF USE

(71) Applicant: Musco Corporation, Oskaloosa, IA (US)

(72) Inventors: Myron Gordin, Oskaloosa, IA (US); Luke C. McKee, Oskaloosa, IA (US); Steven T. Heaton, Oskaloosa, IA (US); Joel D. DeBoef, New Sharon, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 15/782,039

(22) Filed: Oct. 12, 2017

Related U.S. Application Data

(60) Provisional application No. 62/409,355, filed on Oct. 17, 2016, provisional application No. 62/483,284, filed on Apr. 7, 2017.

(51) Int. Cl.

| | |
|---|---|
| ***F21V 13/04*** | (2006.01) |
| ***F21S 8/08*** | (2006.01) |
| ***F21V 7/04*** | (2006.01) |
| ***F21V 25/00*** | (2006.01) |
| ***F21V 5/04*** | (2006.01) |
| *F21W 131/105* | (2006.01) |

(52) U.S. Cl.
CPC ..... *F21V 13/04* (2013.01); *F21S 8/086* (2013.01); *F21V 5/04* (2013.01); *F21V 7/04* (2013.01); *F21V 25/00* (2013.01); *F21W 2131/105* (2013.01)

(58) Field of Classification Search
CPC ..... F21W 2131/105; F21V 13/04; F21V 5/04; F21V 7/04
See application file for complete search history.

(56) References Cited

U.S. PATENT DOCUMENTS 2,226,879 A 3/1940 Stam
4,272,799 A 5/1981 Downing
(Continued)

FOREIGN PATENT DOCUMENTS

JP 06084403 3/1994

OTHER PUBLICATIONS

Illuminating Engineering Society of North America, IES standard TM-15-11, Mar. 30, 2015, pp. 4-5, Illuminating Engineering Society of North America, New York.
(Continued)

*Primary Examiner* — Anne M Hines
(74) *Attorney, Agent, or Firm* — Jessica R. Boer

(57) ABSTRACT

Disclosed and described herein is a sharp cutoff LED lighting luminaire and methods of use thereof. Further disclosed is a modification thereof which allows baseballs or detritus trapped by the luminaire to fall to the ground. In the state of the art often designers will use the same type of LED lighting fixtures at the top of the pole as for low-mounted uplighting; specifically, taking an additional fixture similarly configured, inverting the orientation (i.e., so to project upward instead of downward), and mounting it relatively low on the pole. The envisioned sharp cutoff LED lighting fixture is better suited for low-mounted uplighting insomuch that it reduces back light, haze, internal glow, and perceived glare as compared to current LED lighting fixtures typically used for the same purpose.

14 Claims, 50 Drawing Sheets

(56) References Cited

U.S. PATENT DOCUMENTS

| | | | | |
|---|---|---|---|---|
| 5,105,347 | A | 4/1992 | Ruud et al. | |
| 5,584,574 | A | 12/1996 | Haddad | |
| 6,398,384 | B2 | 6/2002 | Siminovitch et al. | |
| 6,705,744 | B2 | 3/2004 | Hubbell et al. | |
| 7,425,084 | B2 | 9/2008 | Ruud et al. | |
| 7,804,189 | B2 | 9/2010 | Koehler et al. | |
| 7,918,588 | B2 | 4/2011 | Gordin et al. | |
| 7,976,198 | B1 | 7/2011 | Gordin | |
| 7,988,326 | B2 | 8/2011 | Gordin | |
| 8,162,511 | B1 | 4/2012 | Gordin et al. | |
| 8,523,397 | B1 | 9/2013 | Gordin | |
| 9,402,292 | B1 | 7/2016 | Gordin et al. | |
| 9,631,795 | B2 | 4/2017 | Gordin et al. | |
| 2006/0181882 | A1 | 8/2006 | Gordin et al. | |
| 2011/0149582 | A1 | 6/2011 | McKee | |
| 2012/0307486 | A1 * | 12/2012 | Gordin ..... | F21S 4/00 362/223 |
| 2014/0340889 | A1 | 11/2014 | Gordin | |

OTHER PUBLICATIONS

Illuminating Engineering Society of North America, IES standard RP-6-15 pp. 31-33, May 16, 2011, Illuminating Engineering Society of North America, New York.

Clear, R.D., Discomfort glare: What do we actually know?, Lighting Research Technologies, 2012; 0:1-18.

Musco Sports Lighting LLC, Light Structure Green Auxiliary Brackets, 2011, Musco Sports Lighting, LLC, Oskaloosa, Iowa.

English translation of cited JP06084403.

* cited by examiner

Section A

Section B

| | | *Embodiment 2 - Aimed to 12° from from horizon* | | | | *Prior Art Fixture - Aimed to 12° from horizon* | | | |
|---|---|---|---|---|---|---|---|---|---|
| *Aim Condition* | | *Distance from ground (ft) at aim distance* | | | | *Distance from ground (ft) at aim distance* | | | |
| Mounting Height (ft) | **Aim Distance (ft) (X)** | Cut-off (Z) | Lower Beam (A) | Max cd (B) | Upper Beam (C) | Cut-off (Z) | Lower Beam (A) | Max cd (B) | Upper Beam (C) |
| 25 | **100** | 25 | 30.24 | 39.05 | 69.52 | 24.1 | 37.28 | 52.73 | 157.70 |
| 25 | **125** | 25 | 31.55 | 42.57 | 80.65 | 23.9 | 40.35 | 59.67 | 190.88 |
| 25 | **150** | 25 | 32.86 | 46.08 | 91.78 | 23.7 | 43.42 | 66.60 | 224.06 |
| 25 | **175** | 25 | 34.17 | 49.59 | 102.92 | 23.5 | 46.49 | 73.53 | 257.23 |
| 25 | **200** | 25 | 35.48 | 53.11 | 114.05 | 23.3 | 49.56 | 80.46 | 290.41 |
| 25 | **225** | 25 | 36.79 | 56.62 | 125.18 | 23.0 | 52.63 | 87.40 | 323.59 |

Fig 16B

SHARP CUTOFF LED LIGHTING FIXTURE AND METHOD OF USE

CROSS-REFERENCE TO RELATED APPLICATIONS

This application claims priority under 35 U.S.C. § 119 to provisional U.S. application Ser. No. 62/409,355, filed Oct. 17, 2016, and provisional U.S. application Ser. No. 62/483,284 filed Apr. 7, 2017, both of which are hereby incorporated by reference in their entirety.

I. TECHNICAL FIELD OF INVENTION

The present invention generally relates to improvements in luminaire design which relate to the sharpness of beam cutoff. More specifically, the present invention relates to providing an LED luminaire for baseball uplighting (and for e.g., other wide-area uses, rail and shipping yards, parking lots, and building illumination), said luminaire having a sharp cutoff of light at the lower edge of the composite beam projected therefrom, which reduces the angle over which light projected from the luminaire transitions from "full light" to "no light." This allows a relatively high level of illumination in the vertical space above a field with a sharp cutoff immediately above, but relatively close to, players on a field. The present invention also relates to reducing the negative effects of having an uplight luminaire with a visor that can trap aerial objects by providing an apparatus that can shed trapped baseballs and detritus such as leaves and insects when used in e.g., the aforementioned baseball lighting.

II. BACKGROUND OF THE INVENTION

Lighting baseball fields requires both illuminating the playing surface of the field and providing "uplighting" (i.e., light to the aerial space above and/or proximate the field). Field illumination is typically provided in accordance with at least a minimum accepted standard, such as is found in RP-6-15 of the Illuminating Engineering Society (IES). U.S. Pat. No. 7,976,198 incorporated by reference herein in its entirety discusses the necessity of consideration of aerial lighting levels and provides some examples of measurements of aerial lighting intensity.

It is also known in the lighting industry that lighting that is otherwise satisfactory and meets illumination standards for field lighting can still pose problems when considering uplighting. As discussed in U.S. Pat. No. 7,976,198, light sources can cause glare and reduce playability for some of the players due to the mounting locations and aiming angles of the light sources. For example, a luminaire that provides uplighting but causes reflection on surfaces near the luminaire or internal glow from the luminaire can cause unwanted glare in the eyes of the batter or other players. This glare can obscure the ball and reduce the player's ability to visually track it. U.S. Pat. Nos. 7,976,198 and 9,402,292, also incorporated by reference herein in its entirety, both provide a discussion of some of the considerations that go into determining when uplight is needed, when glare may be perceived, how to adequately design a lighting system to provide uplight while mitigating glare, and the like.

Still further, it is well known in the art of lighting design that improving lighting and reducing cost are primary drivers and can lead to many excellent designs optimized for a specific primary function, but sometimes to the detriment of a secondary function. For example, older designs with less control tended to provide adequate lighting of an aerial space (albeit typically with less control over perceived glare) because visors, etc. were not as precise—particularly for HID lighting. Contrarily, newer designs such as newer LED luminaires exhibit enhanced beam control and while well suited for target areas, no longer have sufficient uncontrolled light that could be used for aerial lighting. This is in addition to the fact that there are still significant areas (older or newer technology) which are lacking in adequate progress. For example, there has been little progress in reducing the number of pole or light mounting locations for wide area lighting applications—progress which could lead to reduced cost.

Consider more specifically beam control and uplight. It is ordinarily considered desirable in the art to control such things as symmetry of the beam, distribution of light within the beam, beam angle, field angle, and cutoff angle, as well as the sharpness of transition from "full" light to "zero" light (or no perceivable light). In the current state of LED design luminaires providing such a transition over an angle of 10 or more degrees are considered to have fairly sharp cutoff (if such is even possible). These luminaires (often referred to as field lighting or downlighting fixtures) are designed such that beam size and intensity closely match the requirements of the target area (which, as stated in the aforementioned patents, is different than needs for uplighting). To achieve these ends, a lighting designer typically relies upon a number of light directing devices such as e.g., secondary lenses, structural components such as adjustable armatures, color gels, filters, and/or lighting redirecting devices (e.g., reflective visors, baffles, light absorbing visors, strips, or rails). Traditionally, uplight could be provided from one or more of these field lighting fixtures from a high mounted position and aimed generally downward, and/or uplight could be provided from one or more of these field lighting fixtures from a low- or mid-mounted position and aimed generally upward. With respect to the former, these luminaires generally have multiple rows of LEDs stacked vertically (i.e., more or less on a plane that is perpendicular to the aiming axis of the luminaire) in several rows so to produce an array. This provides good illumination for field lighting and allows for smooth blending of the light on a playing field from multiple luminaires because of the wide spread and diffuse beam from the elevated position. If an upper visor is used, it provides cutoff that still works well with a somewhat gradual transition of light from full light to full cutoff (ordinarily having a stark cutoff at the top of the beam could even result in undesirable effects on the target area by creating a sharp transition effect on the target area or field where a more gradual transition is typically appropriate). The problem is that it produces too much light for uplighting, in addition to posing potential glare issues because the large array of LEDs are often directly viewable along common lines-of-sight. This is in addition to the fact that the top of a pole is already crowded with field lighting fixtures which are needed for lighting uniformity and blending, and so there is not always space at the top of a pole for uplight fixtures.

That being said, this style of luminaire is also unsuitable for uplighting from a low- or mid-mounted position, as the multiple rows of LEDs create problems by making it very difficult to create a sharp cutoff of light near the edge of the composite beam. FIGS. 5A-B illustrate the problem with using field lighting LED luminaires having multiple rows of LEDs. There is a different angle for cutoff for each row of LEDs due to stacking rows of LEDs in a luminaire housing; in essence, creating multiple focal points which impair the ability to provide sharp cutoff from a single visor or other light redirecting device. This is at least part of the reason why haziness appears when using current LED luminaires as low-mounted uplights—the lack of a distinct cutoff leads to a gradual change in light level that has been described by viewers as "hazy." These luminaires also tend to exhibit "back light" (light which projects backwards and strikes the pole thereby producing perceived glare).

Yet until now the industry has struggled with how to improve on uplighting techniques. In order for players to see the ball well enough for play several factors need to be considered. First, low-mounted uplights must be aimed so that they have complete cutoff below a horizontal plane through the luminaire lest they cause perceived glare for players. However, for a state-of-the-art luminaire a visor creating a sufficient cutoff for uplighting, and more specifically baseball uplighting, would require a visor on the order of at least three to four times as long as currently in use, which would be prohibitively large for lighting fixtures that need to be as compact as possible (e.g., due to pole loading or EPA needs). Second, ball visibility is closely related to its contrast with its visual background. If the ball is close to the ground, the visual background is fairly bright, and therefore the ball requires a fairly high level of illumination. If the ball is high in a dark sky, a relatively small amount of illumination will allow it to be visible against the dark background. But field lighting luminaires low- or mid-mounted and aimed for uplighting tend to provide very high levels of lighting at the highest part of the aerial zone of play, with diminishing light levels in the lower aerial zone of play—which is the opposite of what is needed. Further, luminaires using LEDs for sports lighting are being packed with more LEDs to provide more lumens per luminaire in order to reduce the number of luminaires on a pole or structure and potentially reduce construction costs by e.g., lowering weight and wind loading of the support structure, and practices such as these which are good for the primary needs of sports lighting can have undesired outcomes for other lighting needs at the same venue (here, uplighting). So, progress in lighting design and specifically field lighting highlights the need for more attention to be paid to the aerial space above and/or proximate the field.

It is further well known that lighting systems for large or wide area applications can have a high cost, and that a major component of the cost is related to the pole or other elevating structure. Poles can be on the order of dozens of feet to over 100 feet tall making them very costly; therefore, it is generally desirable to minimize the number of poles for a given target area. But it can be problematic trying to reduce pole count since certain pole positions which might be desirable which use luminaires according to prior art tend to create glare for certain players. Also, luminaires according to prior art tend to project light into the sky much higher than is needed, which can create a sky pollution issue—regardless of pole count.

FIG. 3C, for example, illustrates a pole configuration that might be desirable. It may be appreciated by a person of skill in the art that if the configuration shown in FIG. 3C were used with light sources according to prior art, there would be significant problems with meeting the exacting requirements of sports lighting (e.g., uniformity, minimum light level, etc.) while also minimizing glare and haze, particularly since the proposed "E" pole location shown is in center field in direct view of a batter. In fact, even in standard 8- and 6-pole configurations with poles in the outfield area walls, blackened boards, or other blocking devices (reference no. 313, FIG. 6A) must be used to prevent back light from distracting a batter. When target area lighting and uplighting are provided from the same or similar design of luminaire, such as when fixture 310, FIG. 6A, which is designed to provide target area lighting from an elevated position on e.g., pole 312 at crossarm 314, is also used as luminaire 311 to provide low-mounted uplighting, this issue is worsened. Furthermore, haze caused by the low-mounted luminaire could impede a player's vision. Haze often occurs during fog, rain, or other atmospheric conditions when particulates cause a scattering or absorption of light, and can be particularly distracting when a luminaire has a beam with a gradual transition from full to zero perceived light. And since the transition from full light to no light in these luminaires occurs over a range of approximately 10 degrees, a mid-pole mounting position in combination with a necessary cutoff of light at horizontal is precluded, since the full light necessary for viewing the ball in the air would not be present at 40 feet in height. It should be noted that often LED luminaires according to prior art when used for baseball uplighting must be mounted low, at some height 320 FIG. 6A (which is on the order of 25 feet) in order to ensure that full light hits at roughly 40 feet elevation from the field. If this low mounting height is not used, adequate modeling of a ball in flight may not be possible.

Shown another way, FIG. 5A illustrates in simplified form the light projected on a wall 650 from an LED luminaire 22 according to prior art; namely, having multiple rows of LEDs. FIG. 5B illustrates a virtual side view of the same luminaire having LEDs 694-697 spaced one inch apart, with representative center beams 684-687, and representative lower cutoffs 674-677. It may be appreciated that center beams 684-687 remain parallel to any distance of projection—with the result that the centers of the beams (also referred to as the central aiming axis of the LEDs) from each LED would be indistinguishable at any distance. But it may be further appreciated that due to the differing relationship of LEDs 694-697 to the furthest edge 652 of visor 651, the lower cutoffs 674-677 diverge in a very short distance. In fact, with a visor length on the order of 16 inches, the beams diverge at approximately 5.5 degrees from each other, which at a distance of 16 inches is again only one inch apart, but at 160 feet is a distance of 10 feet. Thus if luminaire 22 as shown is aimed so that light from LED 694 is cut off 25 feet in the air (which is the effective full cutoff point of the luminaire, equivalent to full darkness 657 FIGS. 5A and 5B), full intensity of the beam will not be achieved until a height of 55 feet. This further illustrates the dilemma of trying to use existing LED luminaires for uplighting, since it is desirable to have light with its greatest intensity very near the lower cutoff, and diminish gradually higher in the air (which is the inverse of what is illustrated by zones 653-657 in FIGS. 5A and B).

So while a mid-pole mounting position would be preferable for preventing onsite glare (i.e., glare as perceived by one at the target area), the gradual cutoff of state-of-the-art fixtures necessitates the lower mounting position; this is in addition to the fact that blocking device 313 may need to be just as tall or perhaps even taller 321 than luminaire 311 if internal glow is present or light sources are directly viewable or haze is a concern. Further, a mid-pole mounting position with a luminaire oriented upwardly can trap balls and aerial detritus.

There is still a need for an LED luminaire which creates a beam design having a sharp lower cutoff and not requiring a sharp upper cutoff, but providing less vertical beam spread than common luminaires used for field lighting. In fact, sports lighting needs such sharp cutoff LED luminaires that move away from the current direction in the state of the art in order to provide several benefits. One desired benefit is to provide sharp cutoff to improve playability and to provide precise uplighting to adequately illuminate a ball or other object in flight. It is also generally desirable for uplight to be provided over a precise vertical angle to ensure an object is illuminated over its entire trajectory—without light reflecting back onto the pole (creating a potential glare issue) or light becoming trapped in the luminaire thereby creating an internal glow from the luminaire. It is also generally desirable if uplights avoid excessively long visors or large devices for redirecting light (such as would be currently needed to provide sharp cutoff from arrays of vertically stacked LEDs). Finally, it is generally desirable if uplights in low or mid mounting locations avoid trapping objects falling on them. This can be a problem because even though the lighting fixtures are mounted relatively low, mounting height is still above the reach of a typical person (e.g., to discourage theft or vandalism) which makes the balls or other objects unrecoverable without some kind of lifting mechanism.

What is needed, then, is a different approach to luminaire design which specifically addresses lower light requirements as compared to a target area, low mounting position, sharp lower beam cutoff, reduction or elimination of the issues of back light and haze, reduction or elimination of glare or directly viewable light sources, and addresses the ability to avoid trapping or catching balls, debris, and precipitation.

Thus, there is room for improvement in the art.

III. SUMMARY OF THE INVENTION

Existing LED luminaires designed for field illumination are typically not well-suited to uplighting. One reason is that uplighting requires much less overall light than light at the target area. This depends on the sport, level of play, size and color of the ball, etc. For example, for Class I baseball it is not uncommon for uplight requirements to be an order of magnitude less than light at the field. This can be e.g., 10 footcandles (fc) needed for uplight versus 150 fc needed at the infield. For lower class baseball or venues with uplight restrictions such as some areas next to observatories (which have tight restrictions on uplight so to avoid e.g., light pollution), uplight requirements can be even less; on the order of 1-5 fc. Thus using existing LED luminaires may provide more uplight than is desired.

Further, in the current state of the art, LED luminaires that are suited particularly for sports lighting or other large or wide area applications typically have a very wide vertical beam spread that is wider than desirable if used for uplighting (particularly baseball uplighting). Further, the beam shape produced from said LED luminaires is typically symmetrical both horizontally and vertically with more or less even intensity distribution therebetween, and is unsuited for lighting where high intensity light is needed close to the ground but which tapers off, and which must be cut off very rapidly to simultaneously provide adequate illumination of a ball close to ground while not contributing to perceived glare for players tracking the ball in flight. So it is apparent that subtle changes in design which create a sharp cutoff, with uniform light levels that transition smoothly from lower cutoff to upper aerial levels, can have a significant impact on desirability and effectiveness of lighting design. Thus there remains a need for sharp cutoff luminaires which would be better suited to uplighting than the aforementioned state-of-the-art LED luminaires.

In consideration of the state of the art, and the need for subtle improvements in the design of uplighting, it should be noted that the lighting industry is quite mature with regard to design techniques, and small improvements in design can be very significant for improving lighting even by small increments. Software tools for designing light placement systems help to ensure adequate light levels, good uniformity, etc. over an entire field. Even still, a lighting designer having ordinary skill in the art and having many tools available still lacks some things; for example, oftentimes available luminaires are designed towards providing lighting solutions for field areas, sometimes to the detriment of providing adequate lighting for a ball in play in the air.

It is therefore a principal object, feature, advantage, or aspect of the present invention to improve over the state of the art and/or address problems, issues, or deficiencies in the art.

Envisioned is a sharp cutoff LED luminaire adapted to provide a transition from full light (i.e., 50% luminance or more) to no light (i.e., zero perceived light) over an angle of on the order of five or fewer degrees, allowing precise placement of controlled light in the aerial space above and/or proximate the field where it is difficult to provide light without contributing to perceived glare for players. This is in contrast to state-of-the-art LED luminaires which provide a similar transition over an angle of 10 or more degrees and present glare concerns, depending on luminaire design.

Further objects, features, advantages, or aspects of the present invention may include one or more of the following:

- an LED uplight luminaire which substantially limits or eliminates line-of-site view and reflections from light sources, back light, perceived glare, internal glow, and haze (as compared to state-of-the-art luminaires when used as uplights);
- an LED uplight luminaire which is suitable for low-mounted positions;
- an LED uplight luminaire having a "ball drop with light trap" which allows balls, precipitation and other detritus that lands on the luminaire to fall to the ground while avoiding contributing to the aforementioned undesirable lighting effects.

A method according to one aspect of the present invention comprises reducing pole count and therefore potentially reducing lighting system cost by installing poles on which are mounted said sharp cutoff LED luminaires in locations that were previously considered undesirable because of the potential for perceived glare.

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

FIG. 1A Illustrates a baseball field according to prior art. FIG. 1B illustrates a ball in flight on the baseball field of FIG. 1A; here with no uplight. FIG. 1C illustrates a ball in flight on the baseball field of FIG. 1A; here with a prior art uplight fixture mounted low. FIG. 1D illustrates a ball in flight on the baseball field of FIG. 1A; here with a low-mounted uplight according to aspects of the present invention. Note that for brevity luminaires are only generically illustrated and that actual luminaires may not be similar in appearance, relative mounting height, aiming angle, or otherwise.

FIG. 2 illustrates the effect of a prior art luminaire trapping an object when used as an uplight in a low or mid mounting position.

FIGS. 3A-E illustrate plan views of various pole layouts relative a baseball field. FIG. 3A illustrates a typical 8-pole layout used for professional play or on a large field (e.g., on the order of 350 feet from home plate to the edge of outfield). FIG. 3B illustrates a typical 6-pole layout for lower class play or on a smaller field (e.g., on the order of 200 feet from home plate to the edge of outfield). FIG. 3C illustrates a 5-pole layout according to aspects of the present invention suitable to replace, e.g., a 6-pole layout. FIG. 3D illustrates a 7-pole layout according to aspects of the present invention suitable to replace, e.g., an 8-pole layout. FIG. 3E illustrates a 3-pole layout according to aspects of the present invention suitable for, e.g., cost-sensitive or low class level (e.g., recreational) play.

FIGS. 4A-I illustrate various views of a sharp cutoff LED luminaire according to aspects of the present invention. FIGS. 4A and B illustrate perspective views; FIG. 4C illustrates a front view of FIG. 4A; FIG. 4D illustrates a back view of FIG. 4A; FIG. 4E illustrates a top view of FIG. 4A; FIG. 4F illustrates a top view of FIG. 4B; FIG. 4G and FIG. 4H illustrates left and right side views, respectively, of FIG. 4A; and FIG. 4I illustrates Section A taken along line A-A of FIG. 4E.

FIGS. 5A-D diagrammatically illustrate beam cutoff for uplight lighting fixtures. FIGS. 5A and B illustrate a prior art LED fixture having multiple rows of LEDs. FIGS. 5C and D illustrate an LED fixture according to aspects of the present invention having a single row of LEDs. Note that for brevity luminaires are only generically illustrated and that actual luminaires may not be similar in appearance, relative mounting height, aiming angle, or otherwise.

FIGS. 6A-B illustrate diagrammatically the projection of light upwardly from a low-mounted pole position. FIG. 6A illustrates a prior art LED uplight at a "C" or "D" pole field position. FIG. 6B illustrates an LED uplight according to aspects of the present invention (mounted at a higher position on the pole than the prior art uplight fixture of FIG. 6A) at an "E" pole field position. Note that for brevity luminaires are only generically illustrated and that actual luminaires may not be similar in appearance, relative mounting height, aiming angle, or otherwise.

Figure 9A:
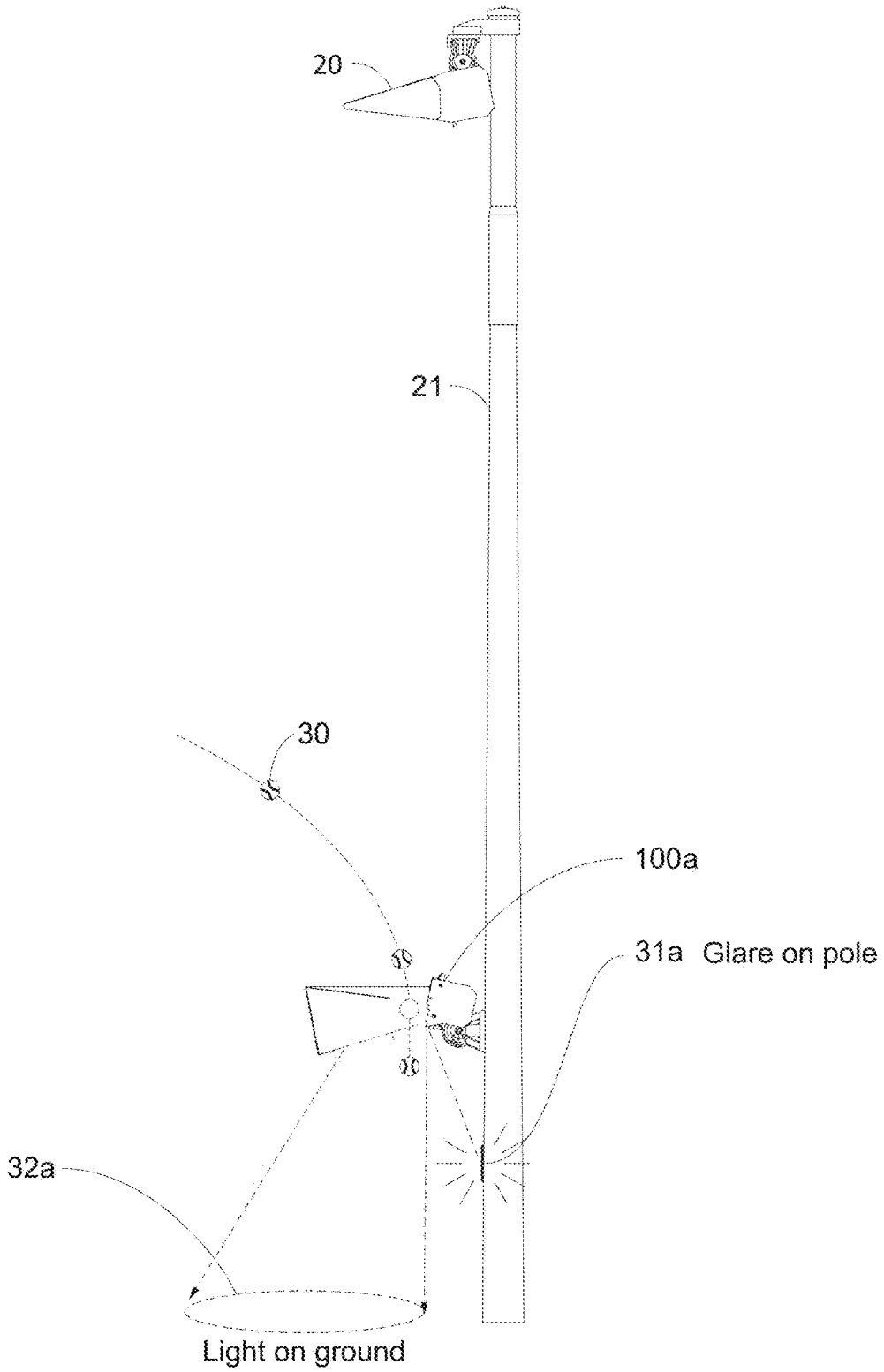
Figure 9B:
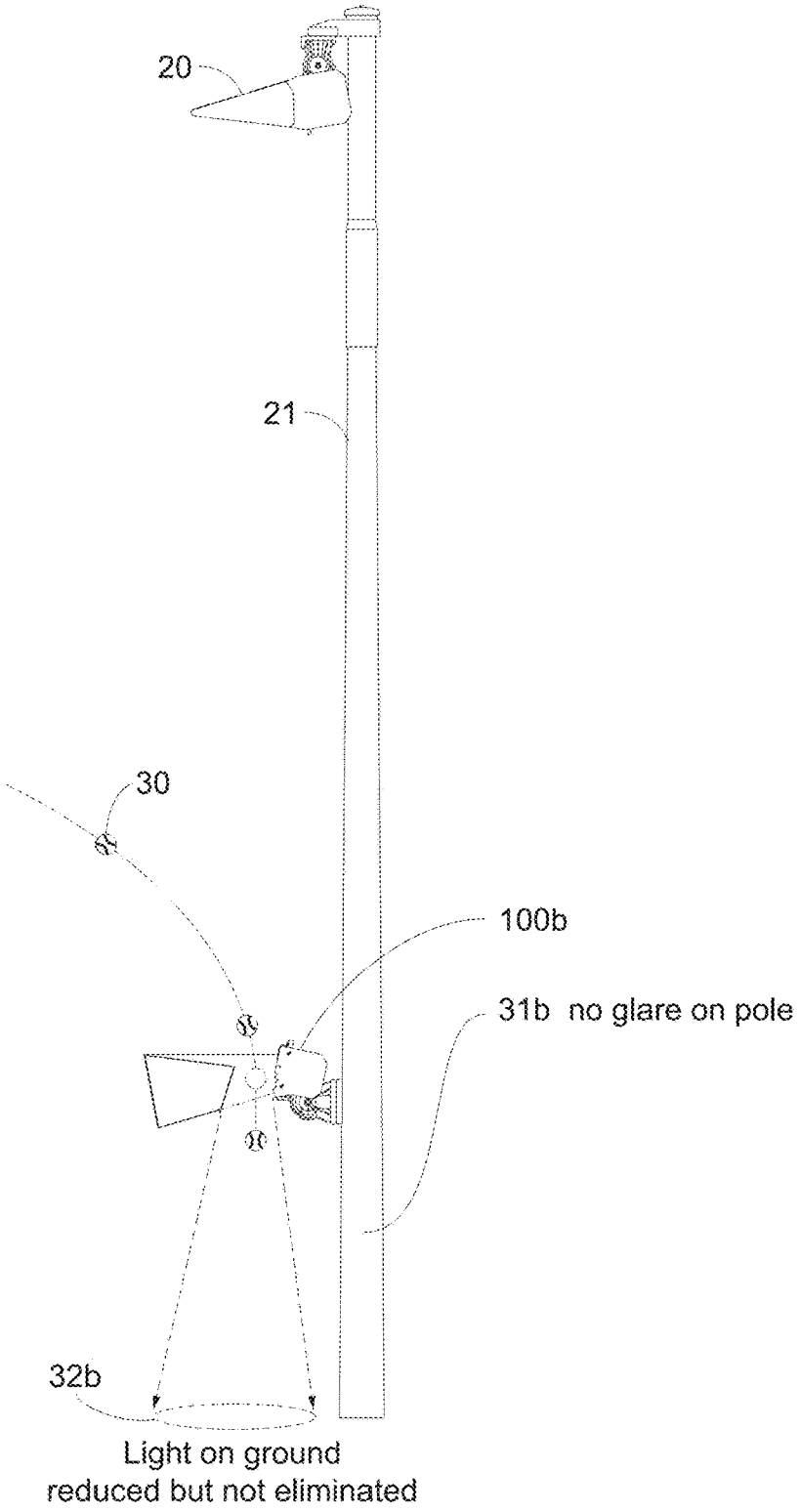
Figure 9C:
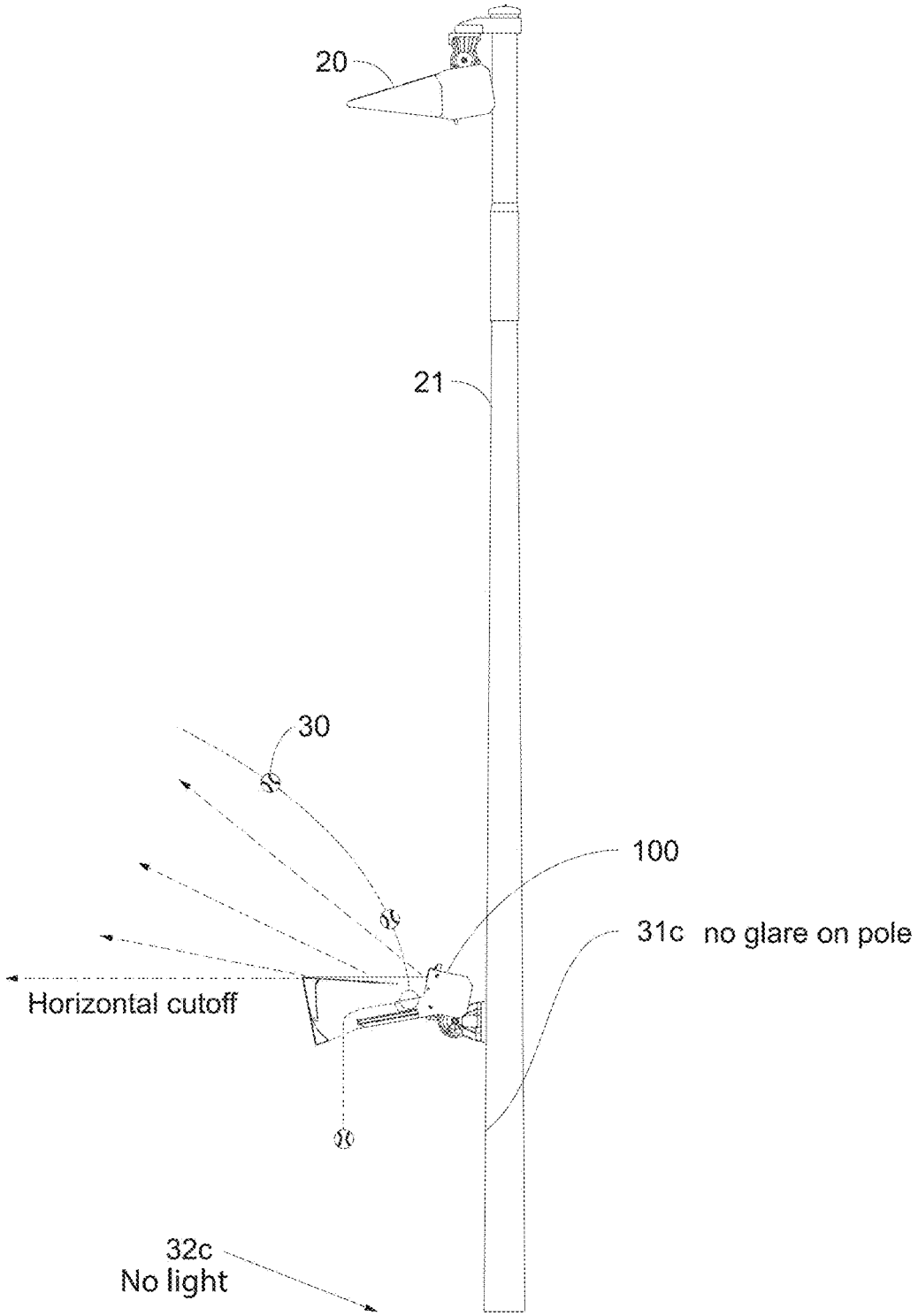

FIGS. 9A-C illustrate various options and alternatives according to aspects of the present invention.

Figure 10A:
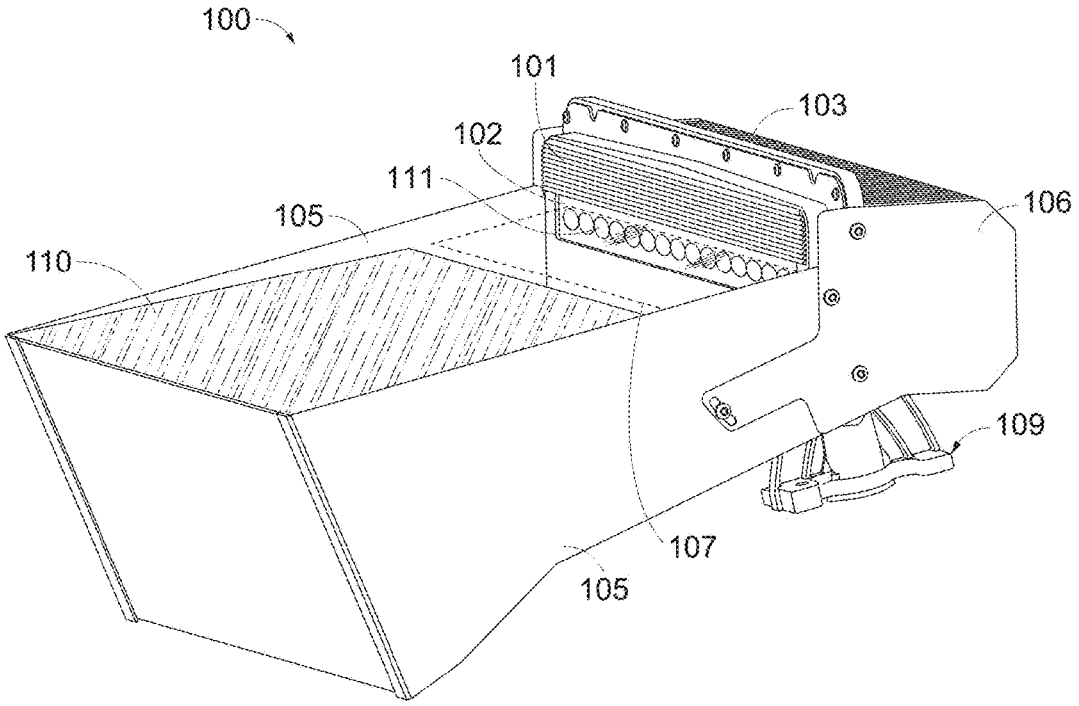
Figure 10B:
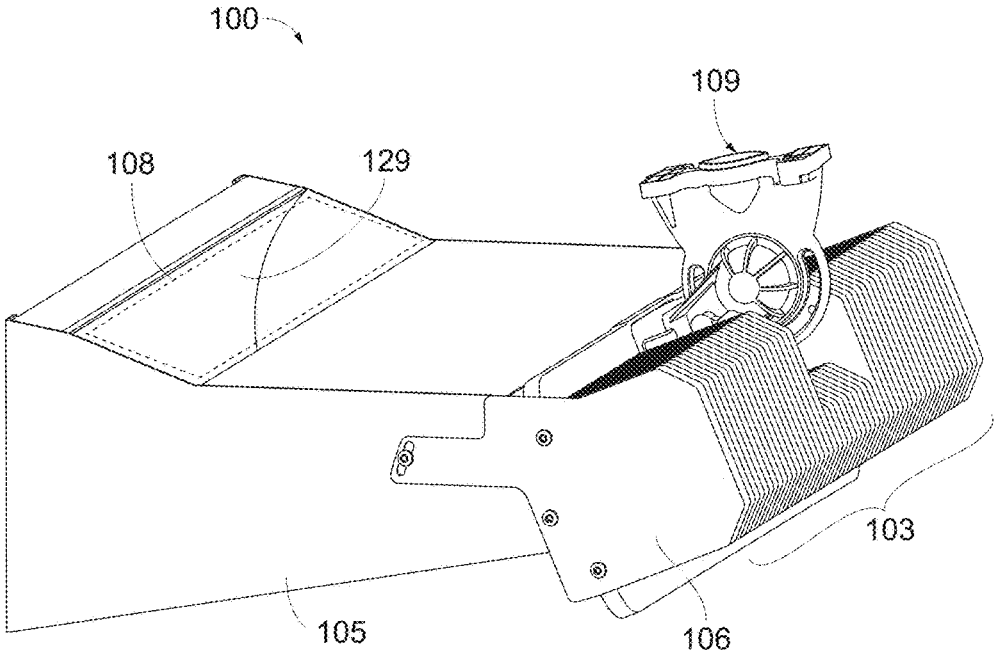
Figure 10C:
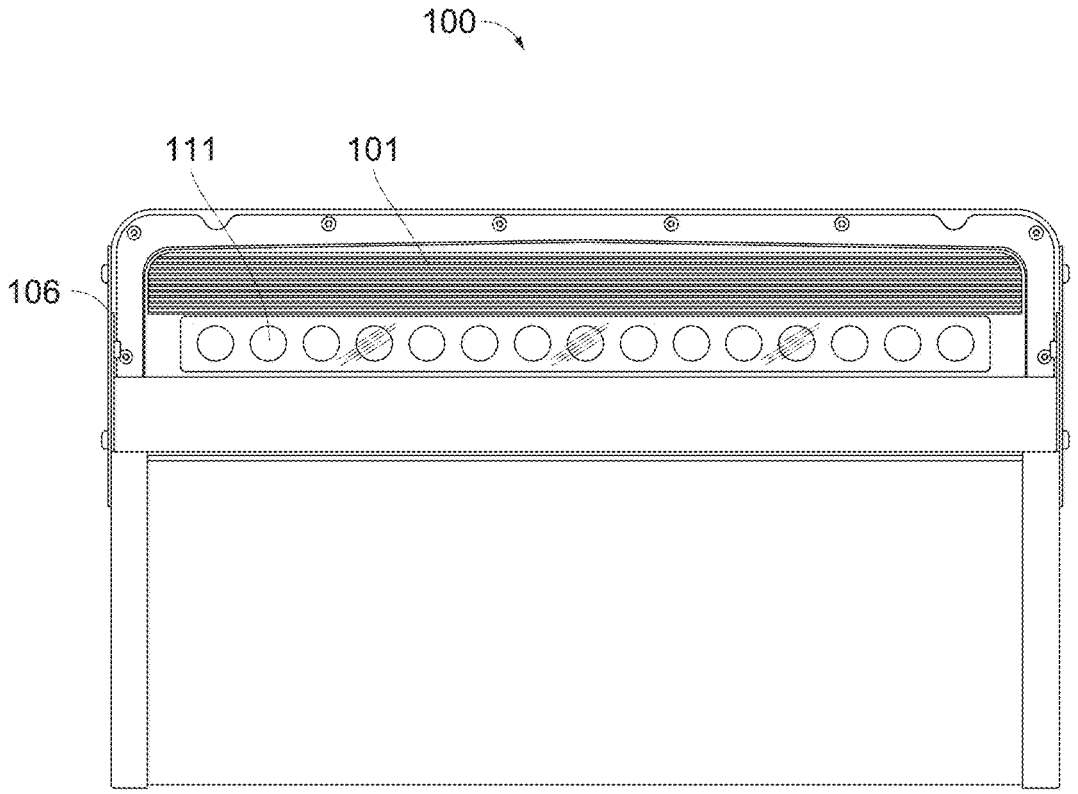
Figure 10D:
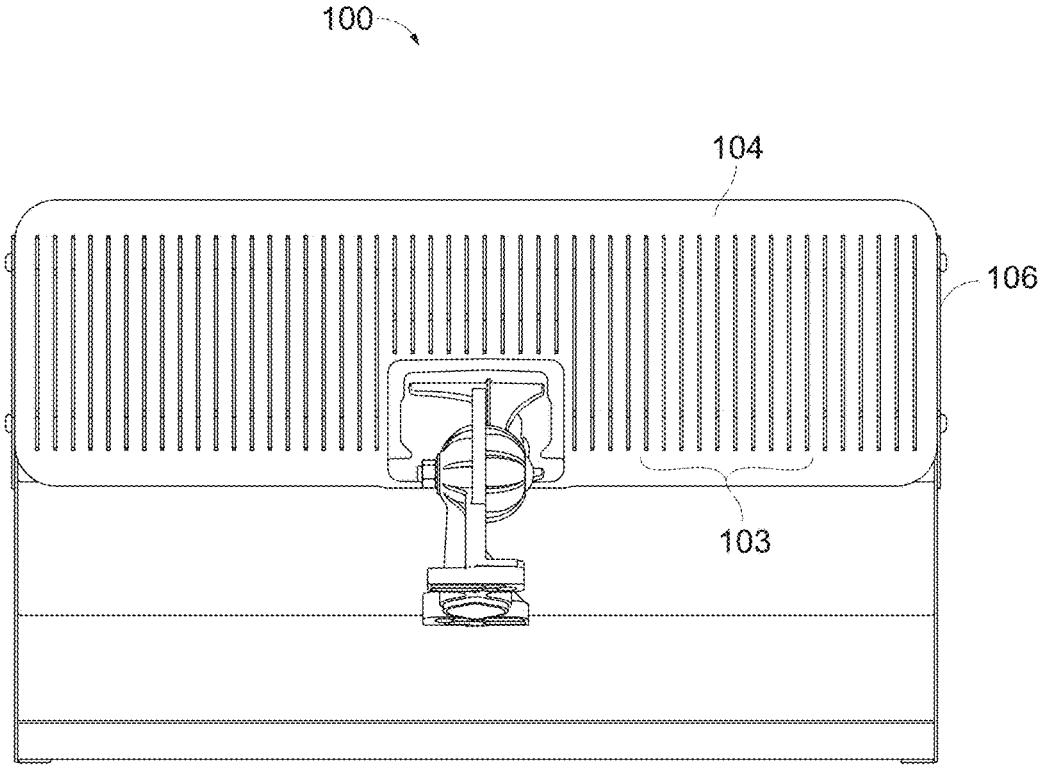
Figure 10E:
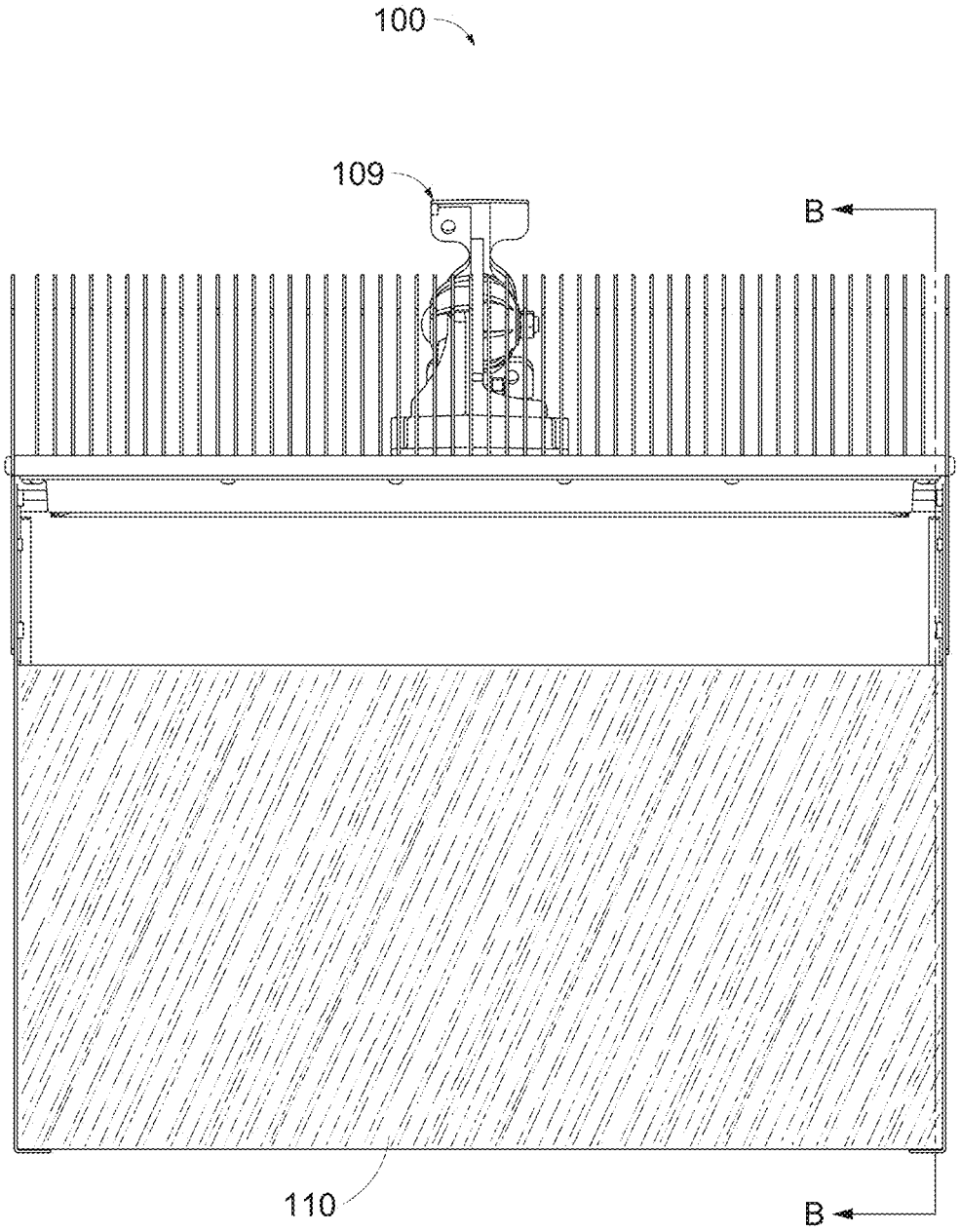
Figure 10F:
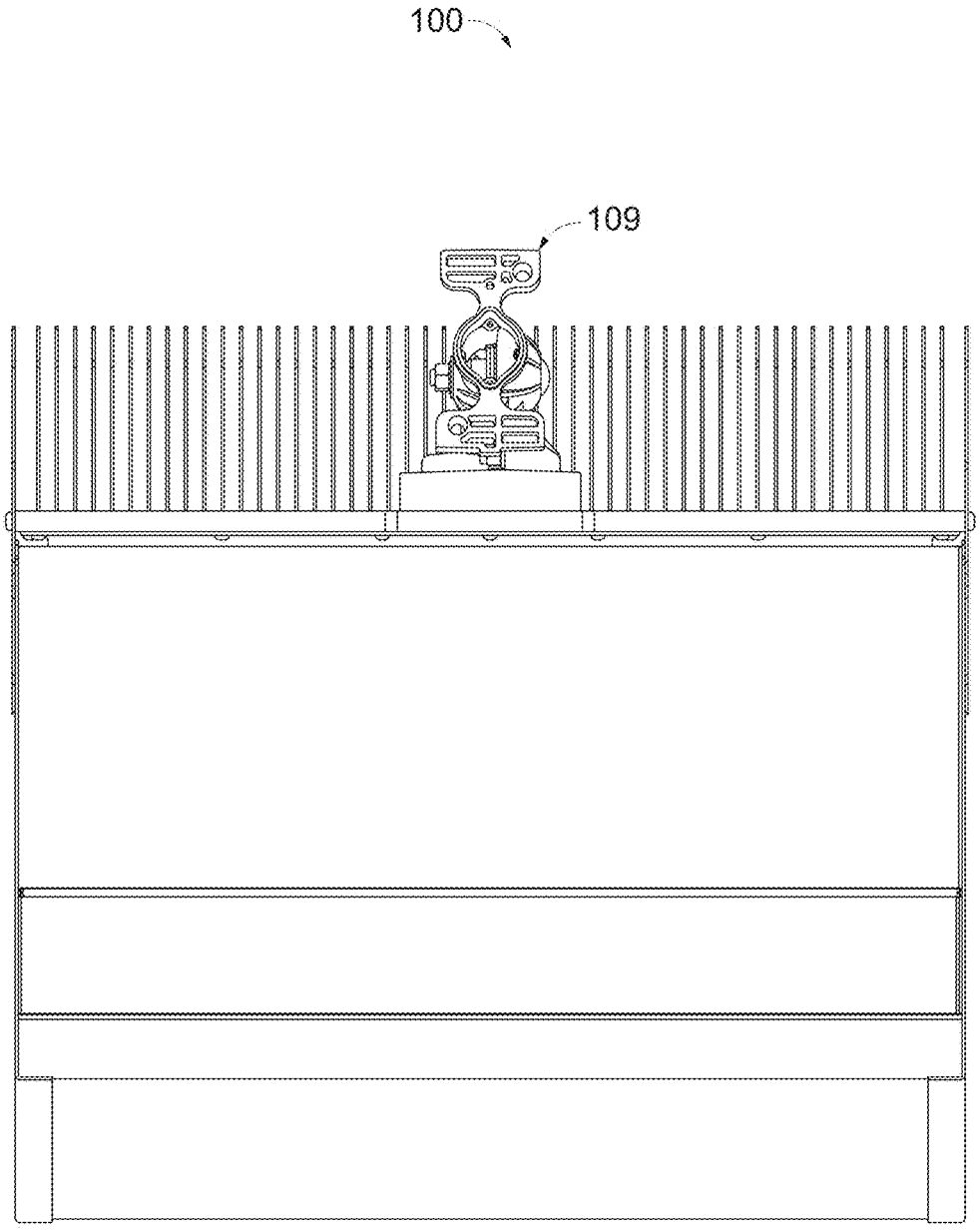
Figure 10G:
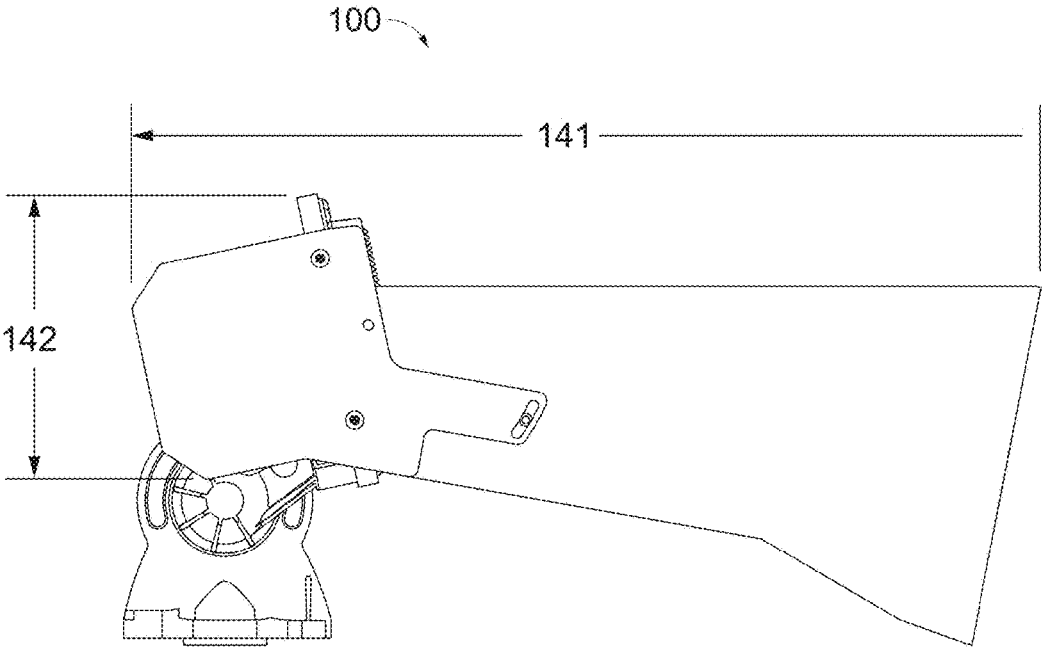
Figure 10H:
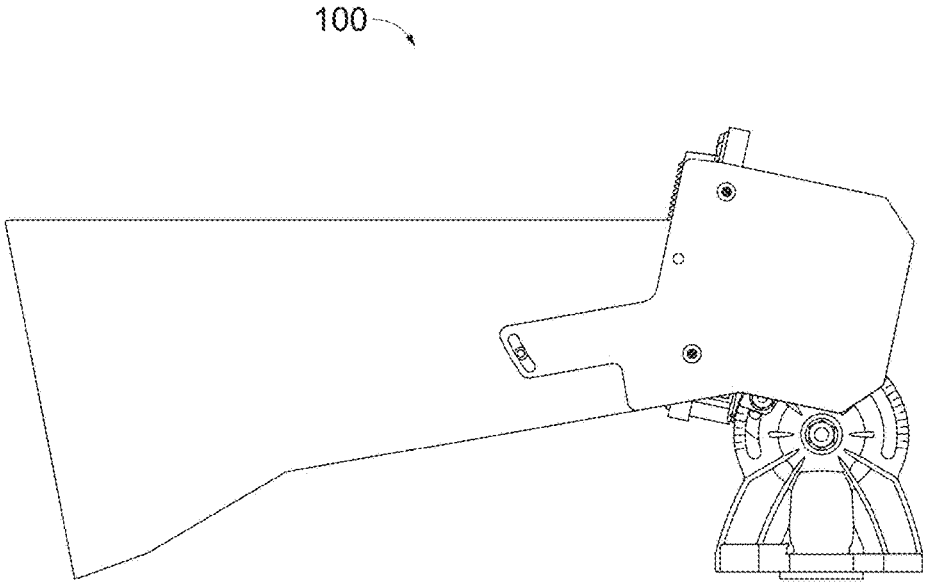
Figure 10I:
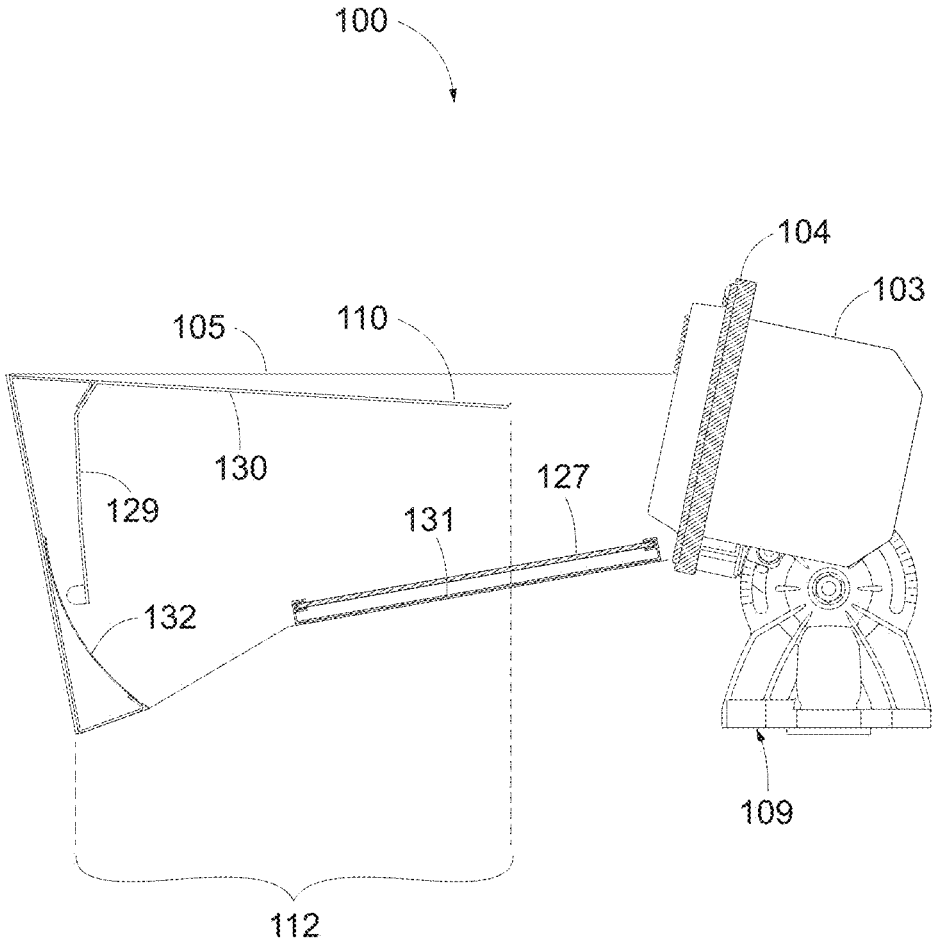

FIGS. 10A-I illustrate various views of an alternative sharp cutoff LED luminaire according to aspects of the present invention. FIGS. 10A and B illustrate perspective views; FIG. 10C illustrates a front view of FIG. 10A; FIG. 10D illustrates a back view of FIG. 10A; FIG. 10E illustrates a top view of FIG. 10A; FIG. 10F illustrates a top view of FIG. 10B; FIG. 10G and FIG. 10H illustrates left and right side views, respectively, of FIG. 10A; and FIG. 10I illustrates Section B taken along line B-B of FIG. 10E.

Figure 11:
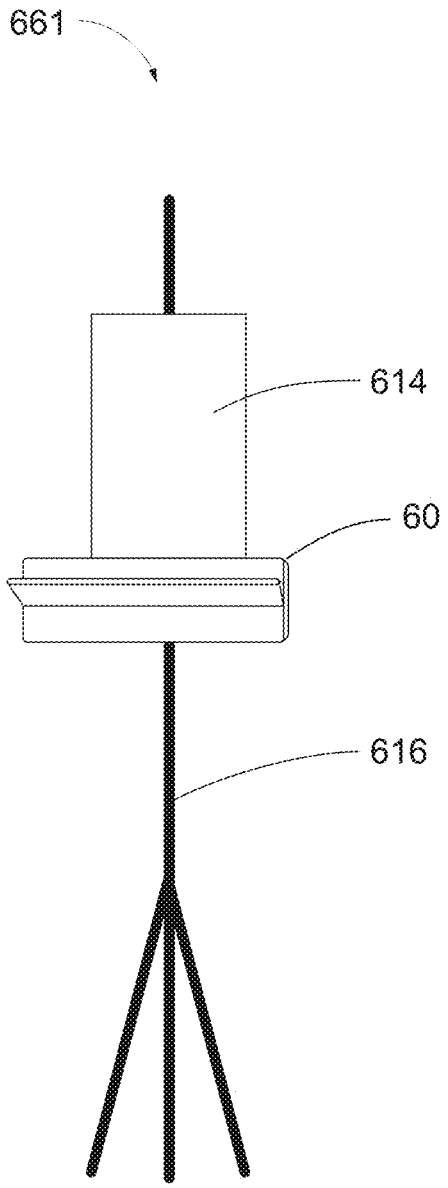

FIG. 11 illustrates a typical test setup used to determine the beam cutoff of FIGS. 5A-D.

Figure 12A:
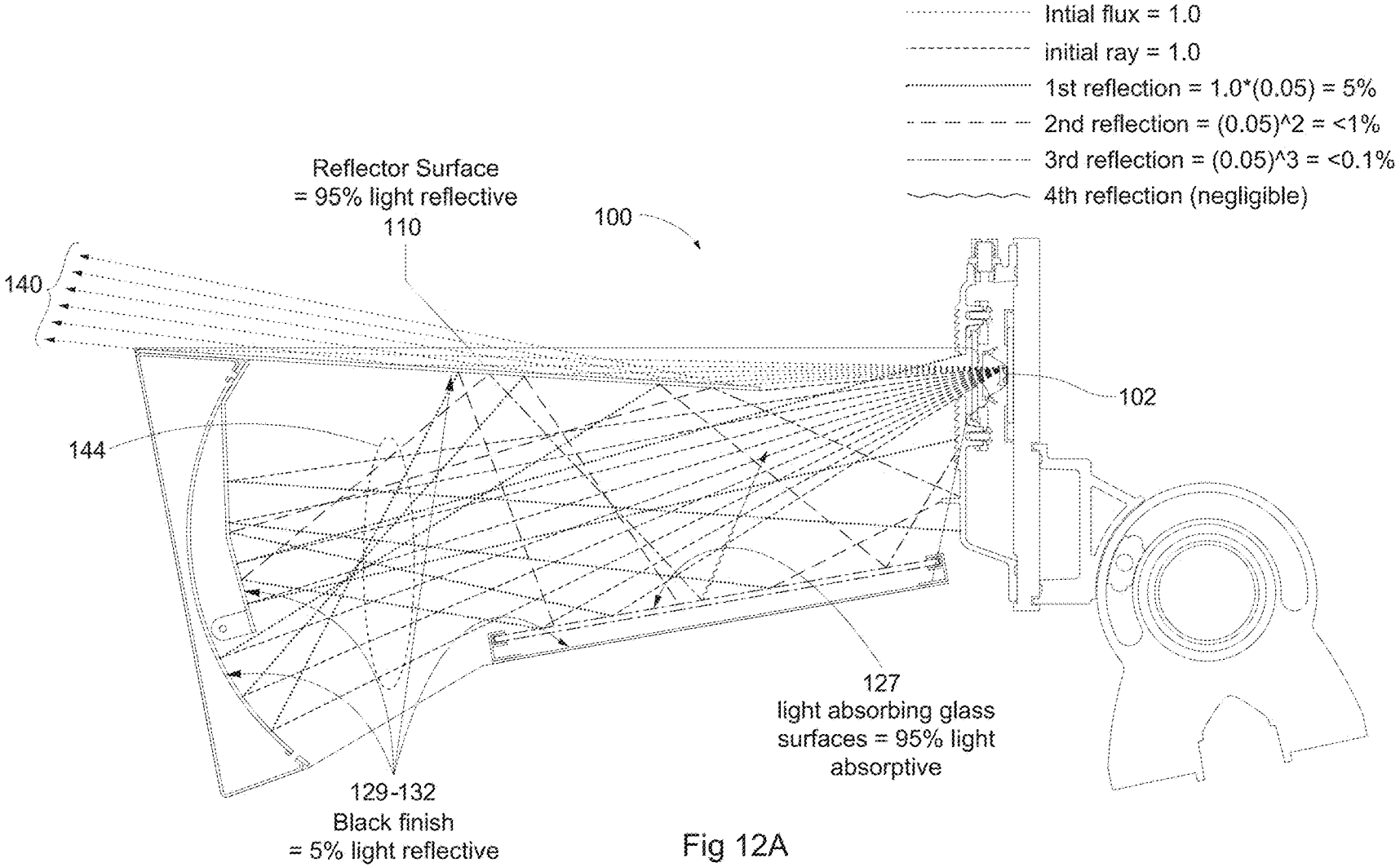

FIGS. 12A and B illustrate light ray tracing of the alternative sharp cutoff LED luminaire according to aspects of the present invention.

Figure 13A:
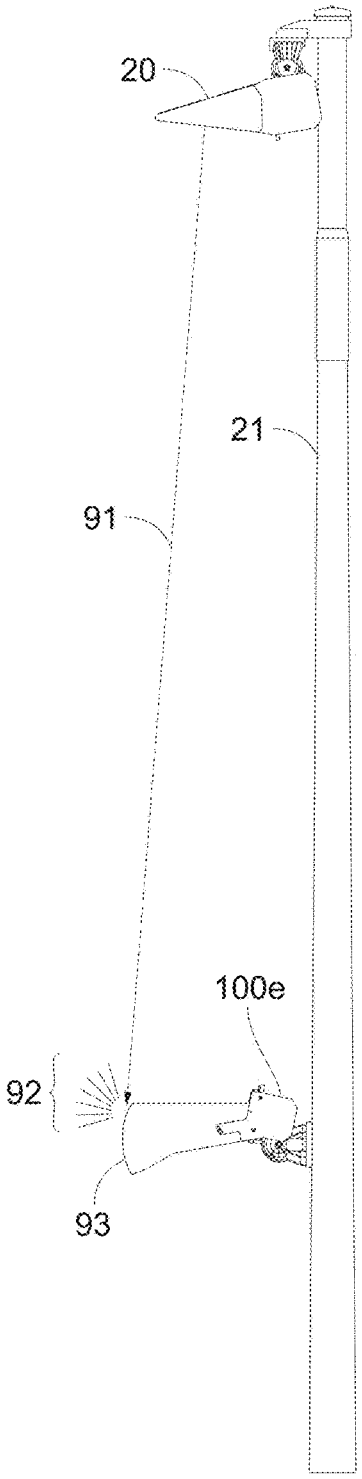

FIGS. 13A and B illustrate possible effects of light from field lighting devices on uplighting devices.

Figure 14A:
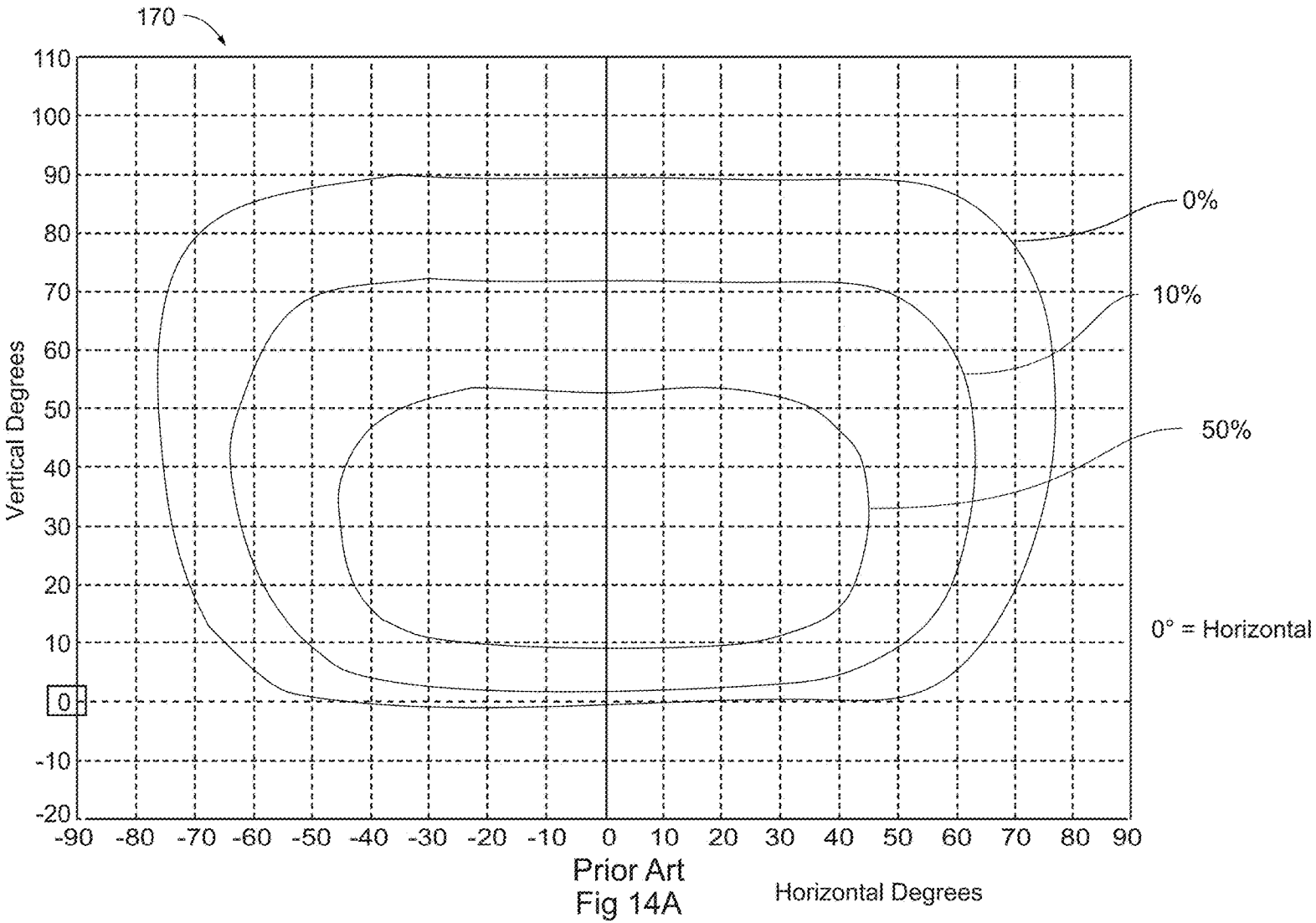
Prior Art Fig 14A
Figure 14B:
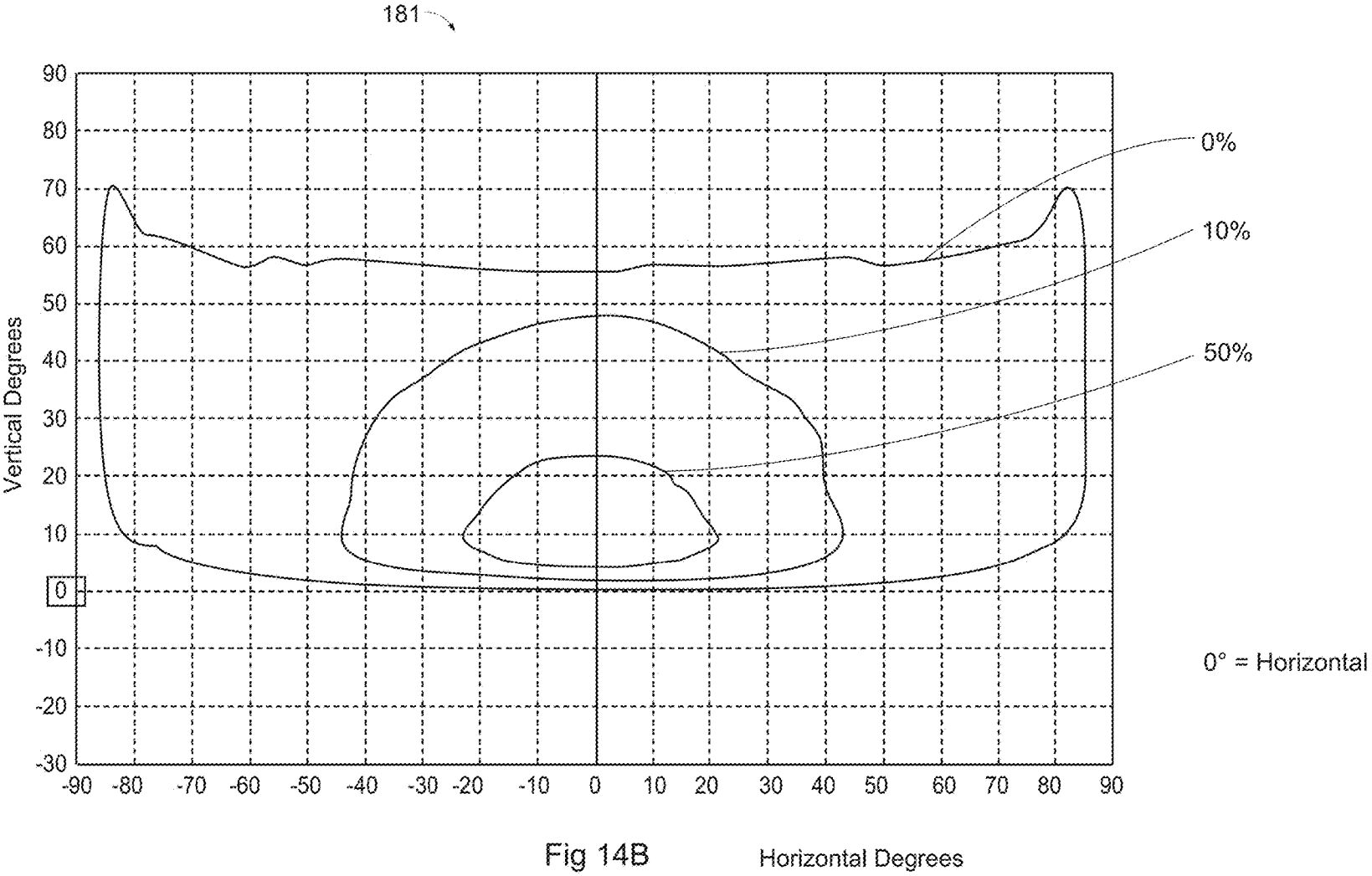

FIGS. 14A and B illustrate angle space plots. FIG. 14A illustrates a plot from a prior art LED luminaire used as an uplight. FIG. 14B illustrates a plot from the alternative embodiment of FIGS. 10A-I.

Figure 15A:
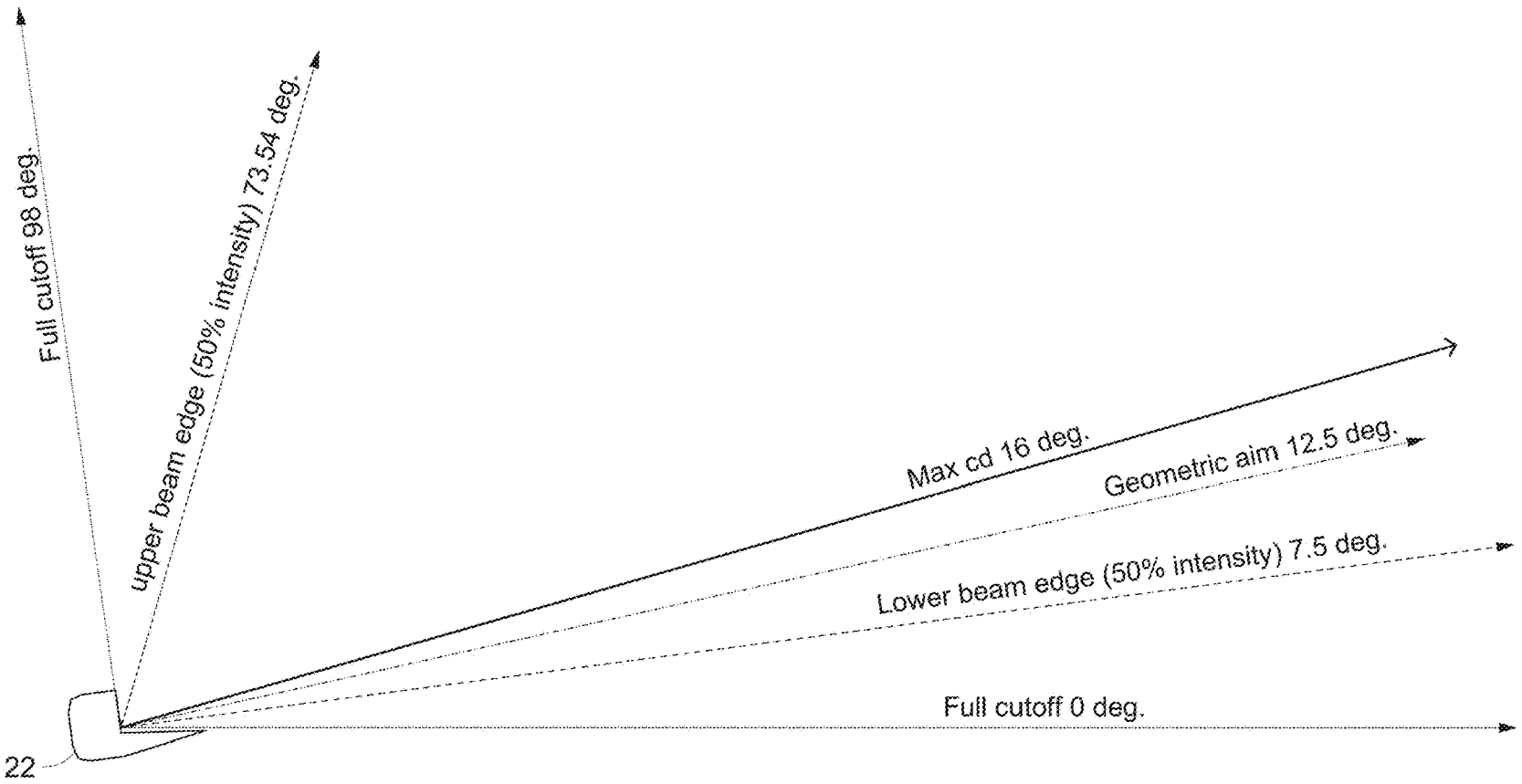
Prior Art Fig 15A
Figure 15B:
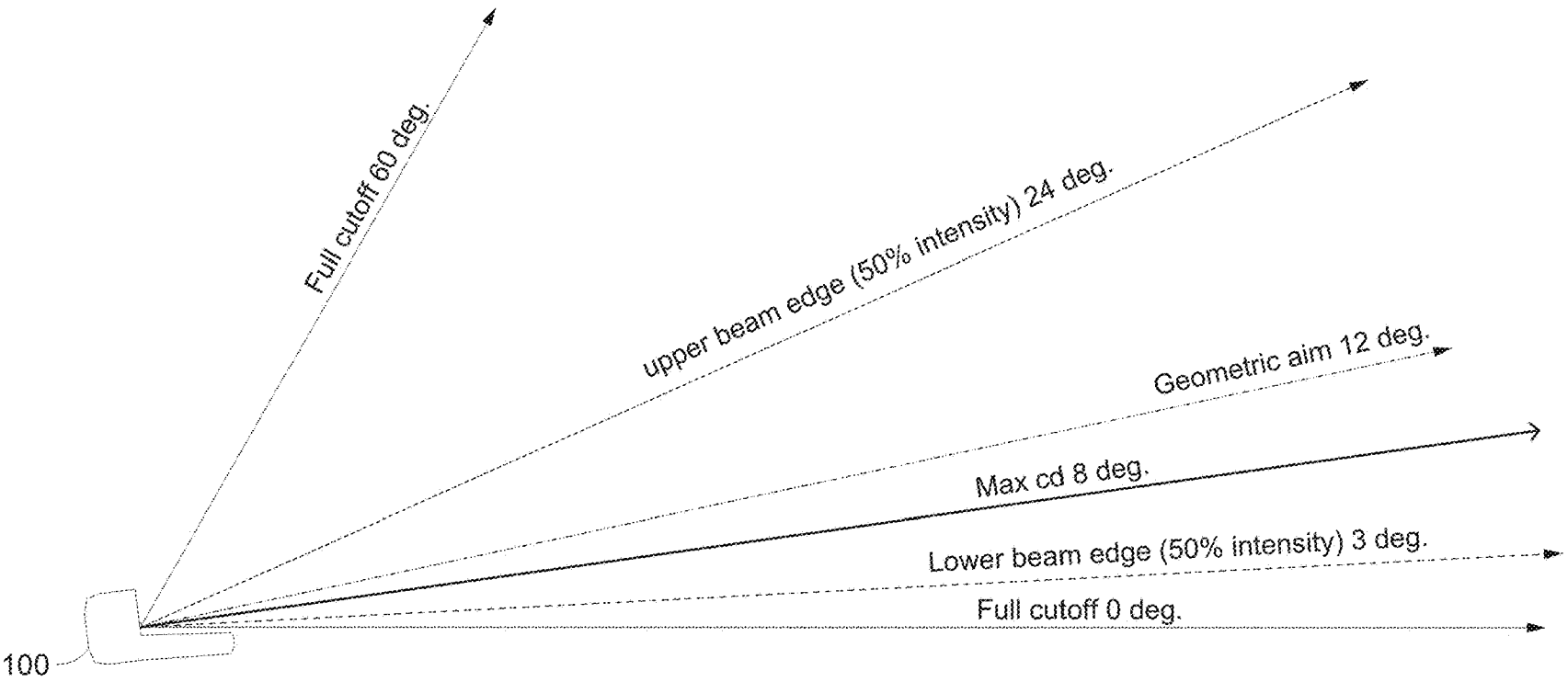

FIGS. 15A and B diagrammatically illustrate beam dimensions, distribution, and cutoff. FIG. 15A illustrates an illustration from a prior art LED luminaire used as an uplight. FIG. 15B illustrates an illustration from the alternative embodiment of FIGS. 10A-I.

Figure 16A:
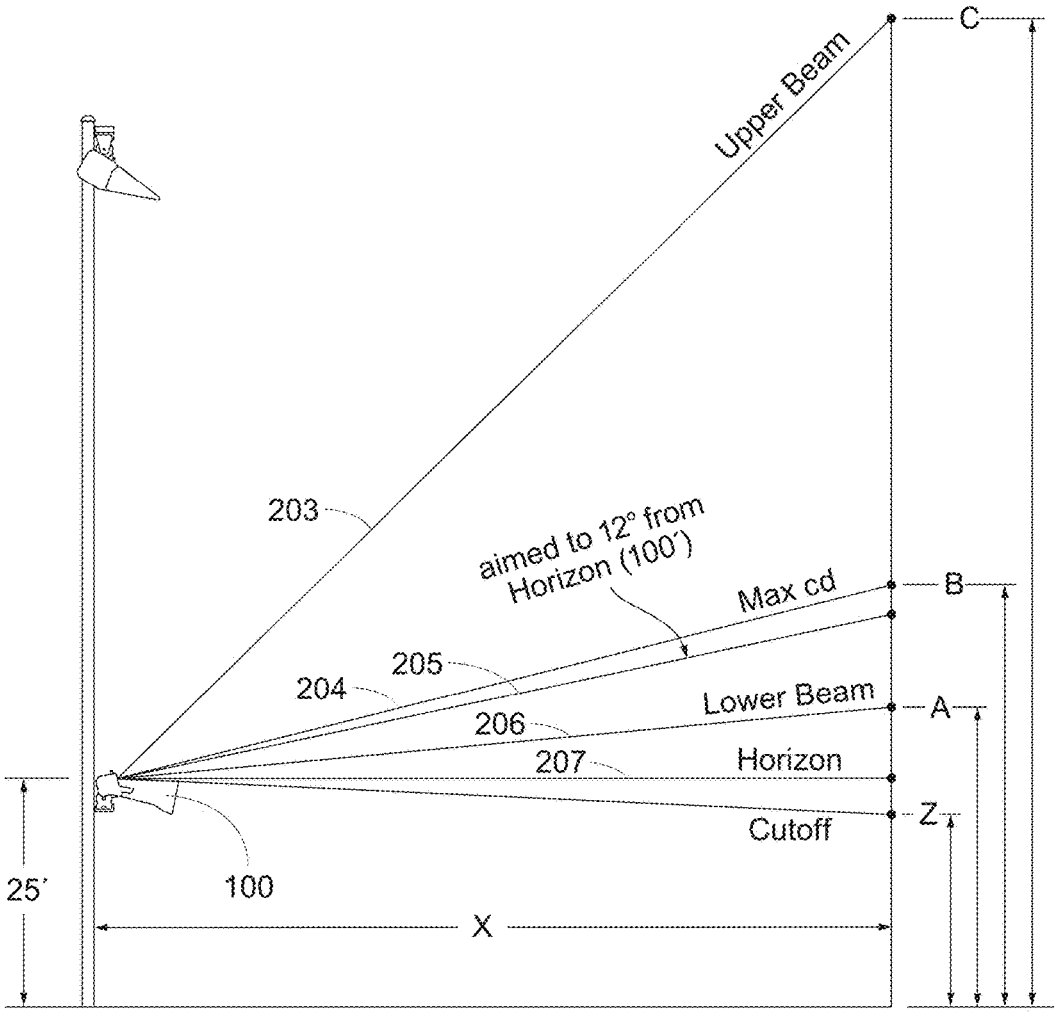

FIGS. 16A and B illustrate one specific example of mounting height and resulting lighting values for the alternative embodiment of FIGS. 10A-I, as compared to prior art.

Figure 17A:
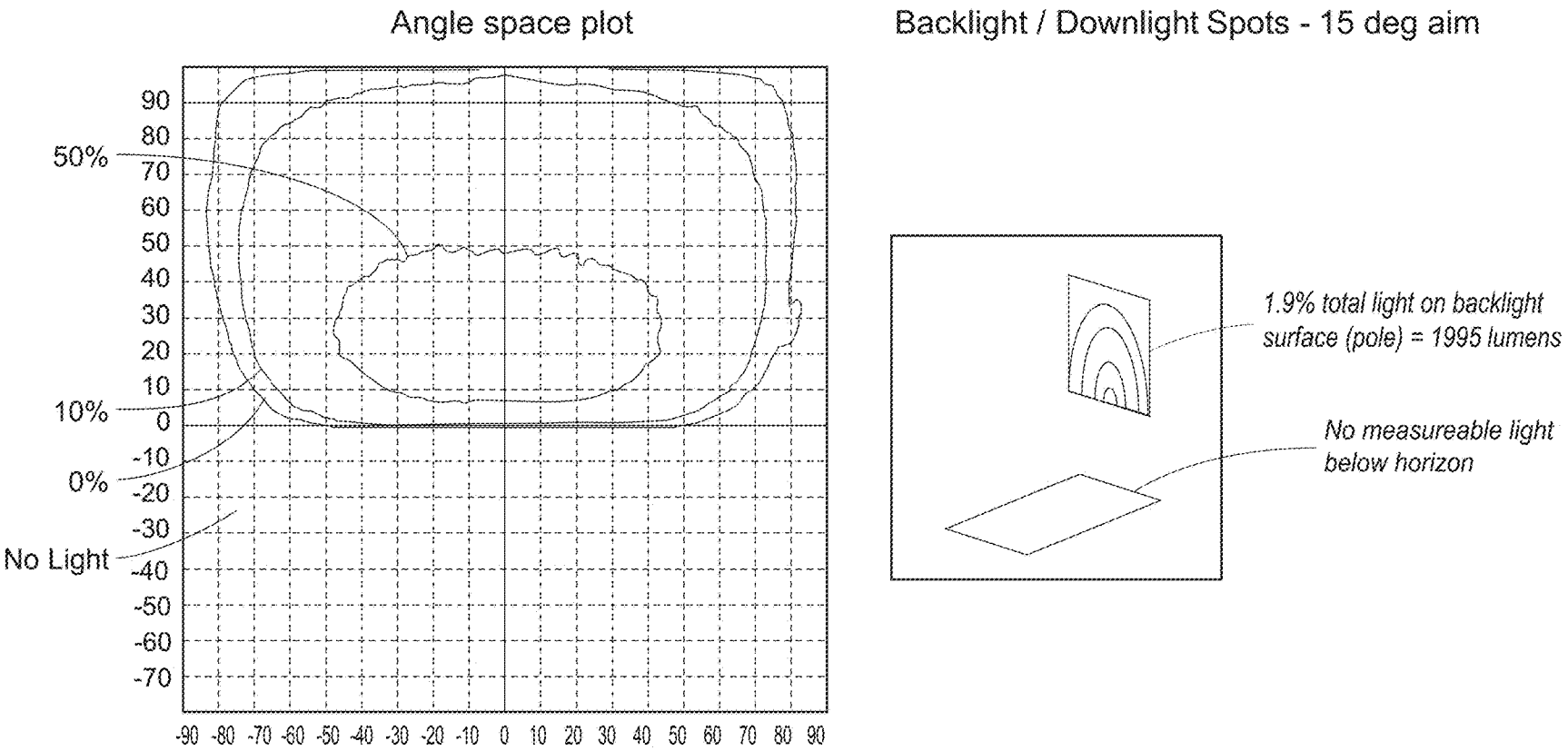
Prior Art Fig 17A
Figure 17B:
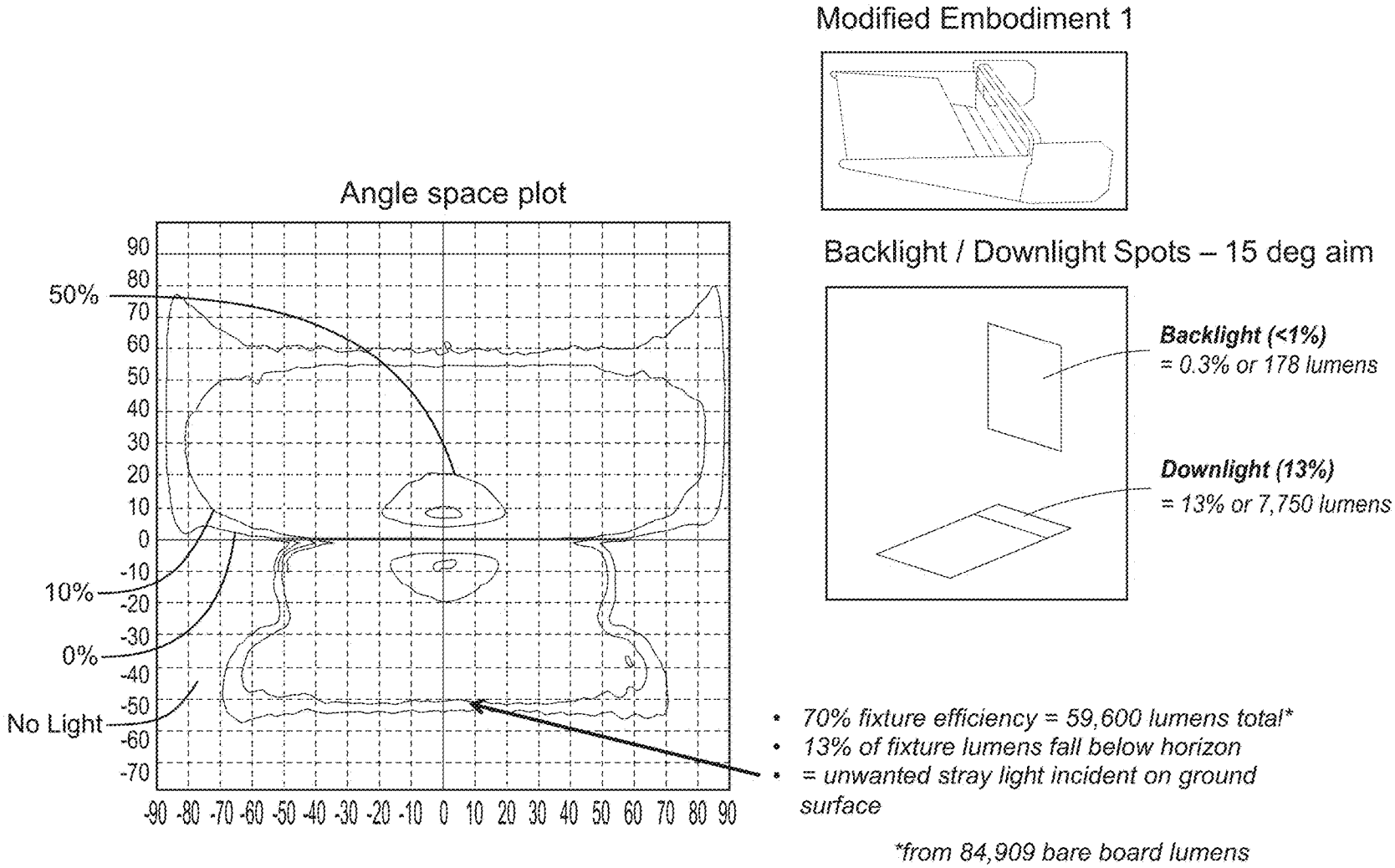
Figure 17C:
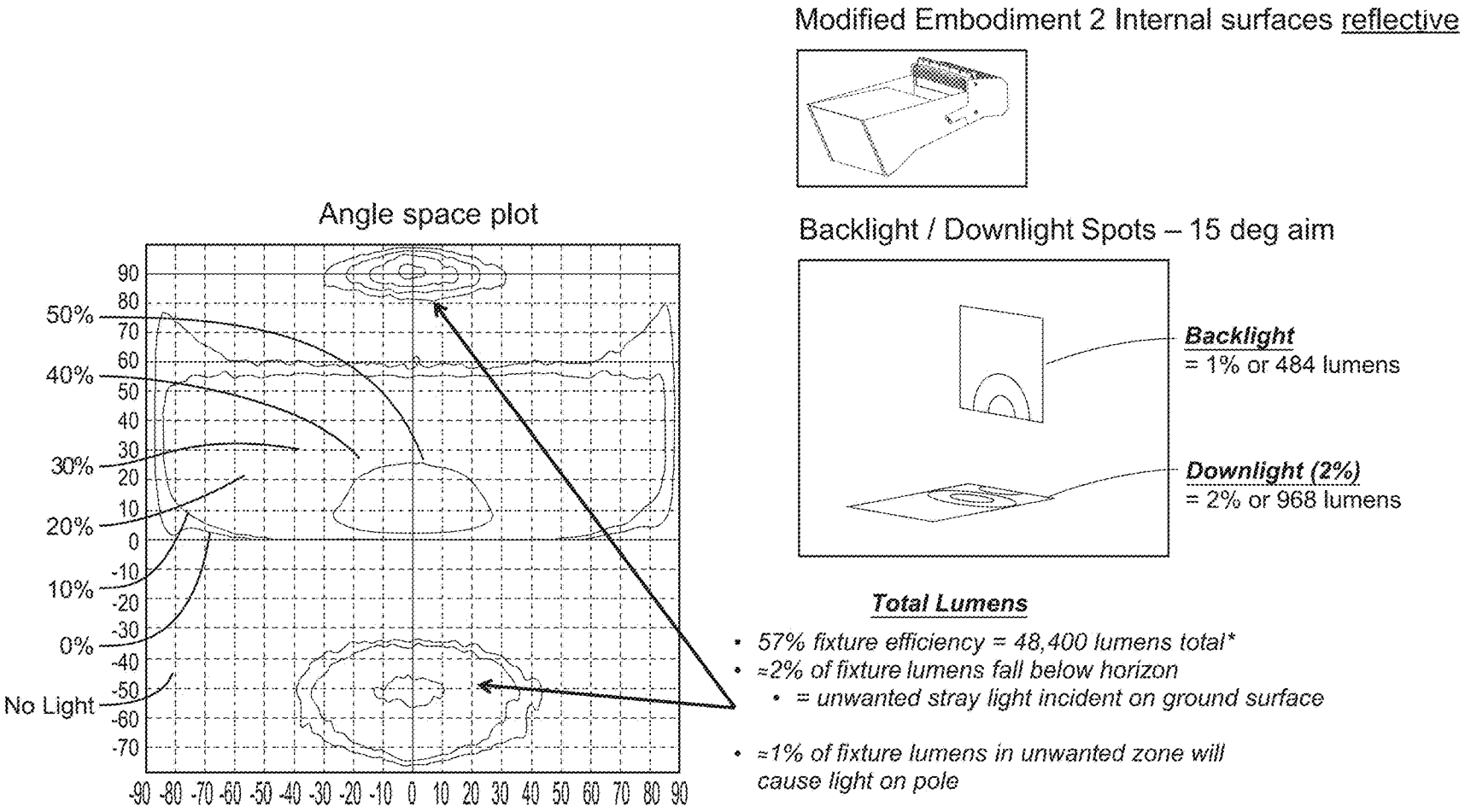
Figure 17D:
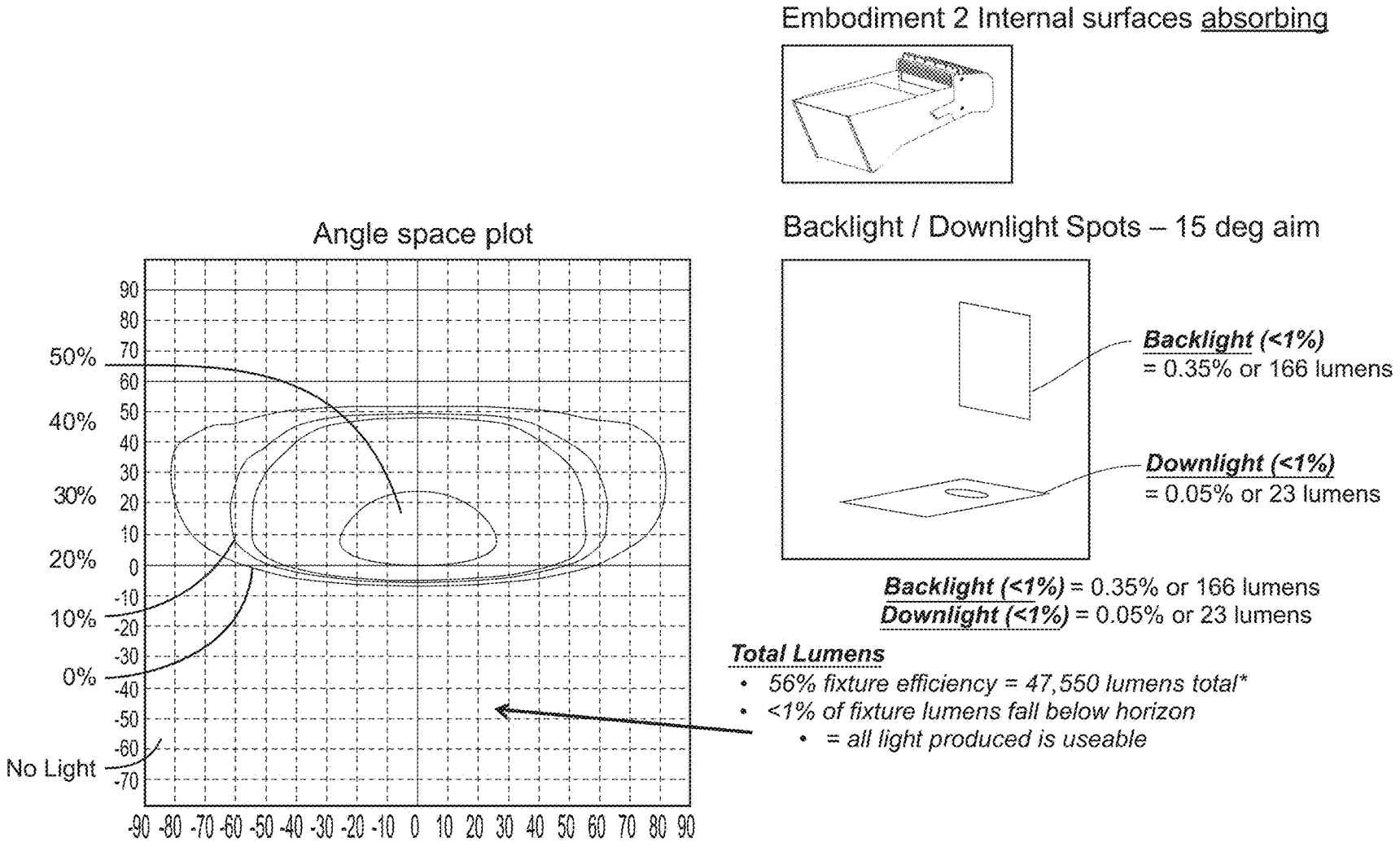

FIGS. 17A-D illustrate angle space plots and spatial representations of uplighting. FIG. 17A illustrates a prior art LED luminaire used as an uplight; FIG. 17B illustrates the embodiment of FIGS. 4A-I; FIG. 17C illustrates the alternative embodiment of FIGS. 10A-I; and FIG. 17D illustrates the alternative embodiment of FIGS. 10A-I as further modified according to aspects of the present invention.

Figure 3A:
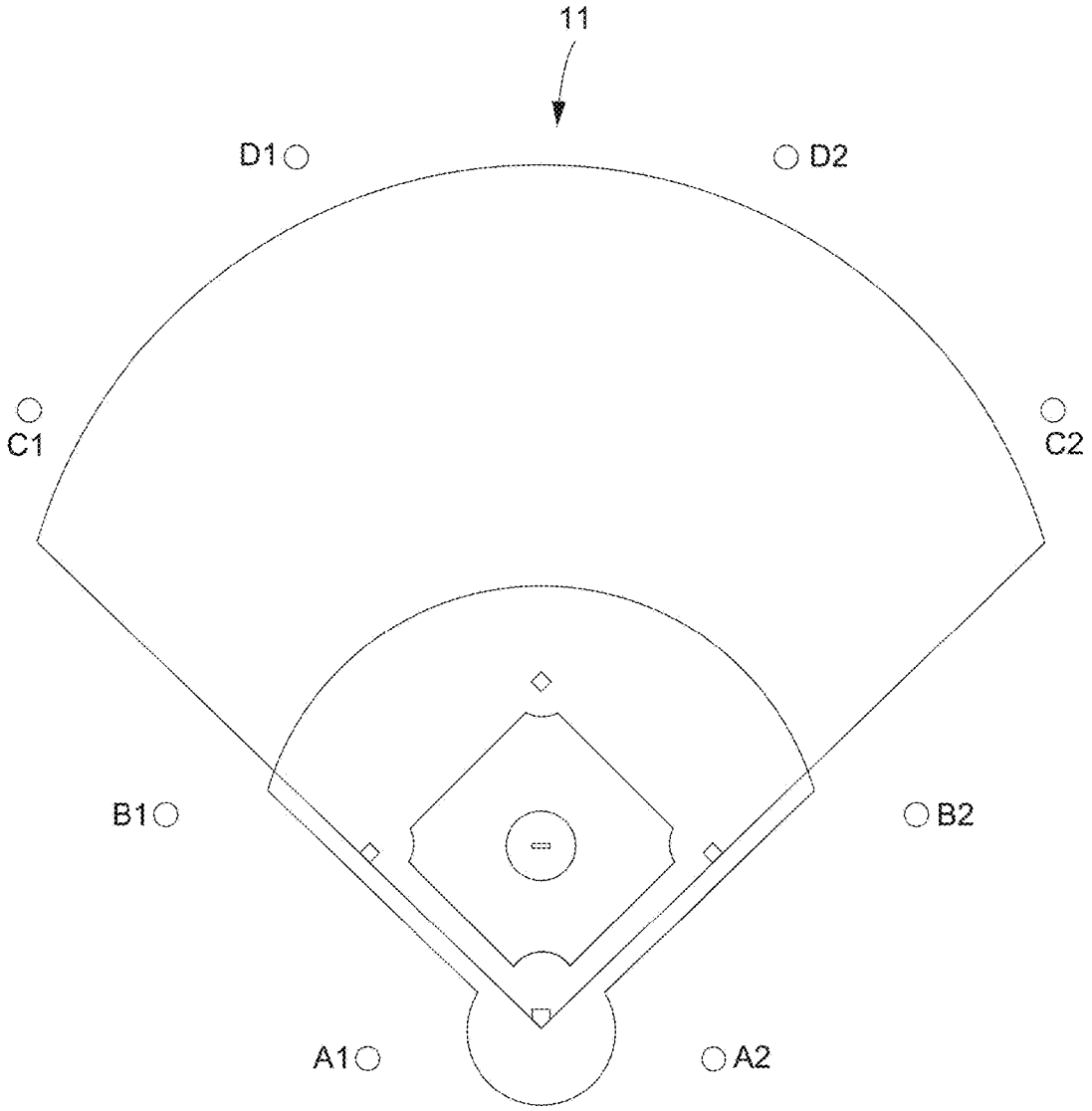
Prior Art Fig 3A
Figure 3B:
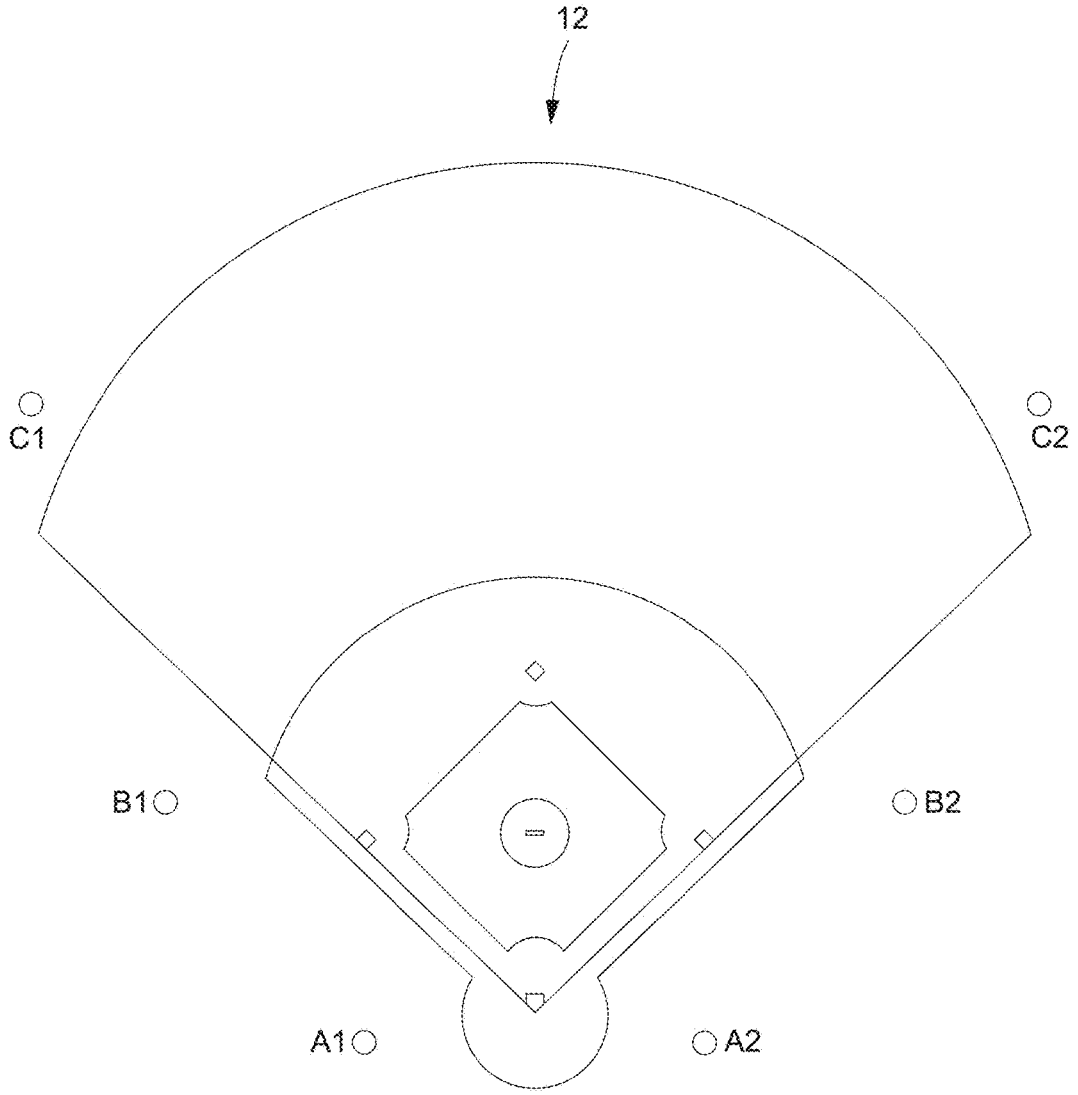
Prior Art Fig 3B
Figure 3C:
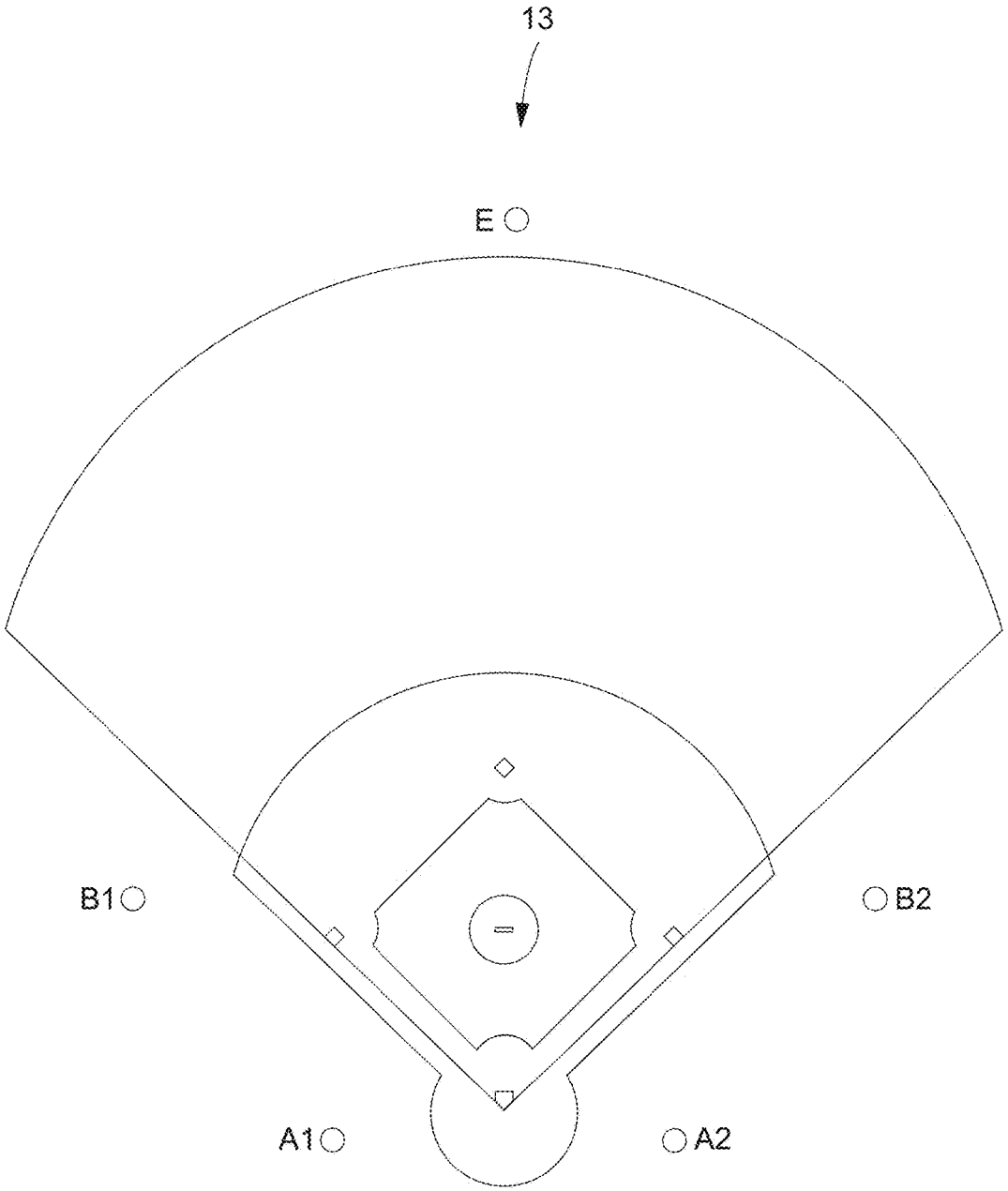
Figure 18:
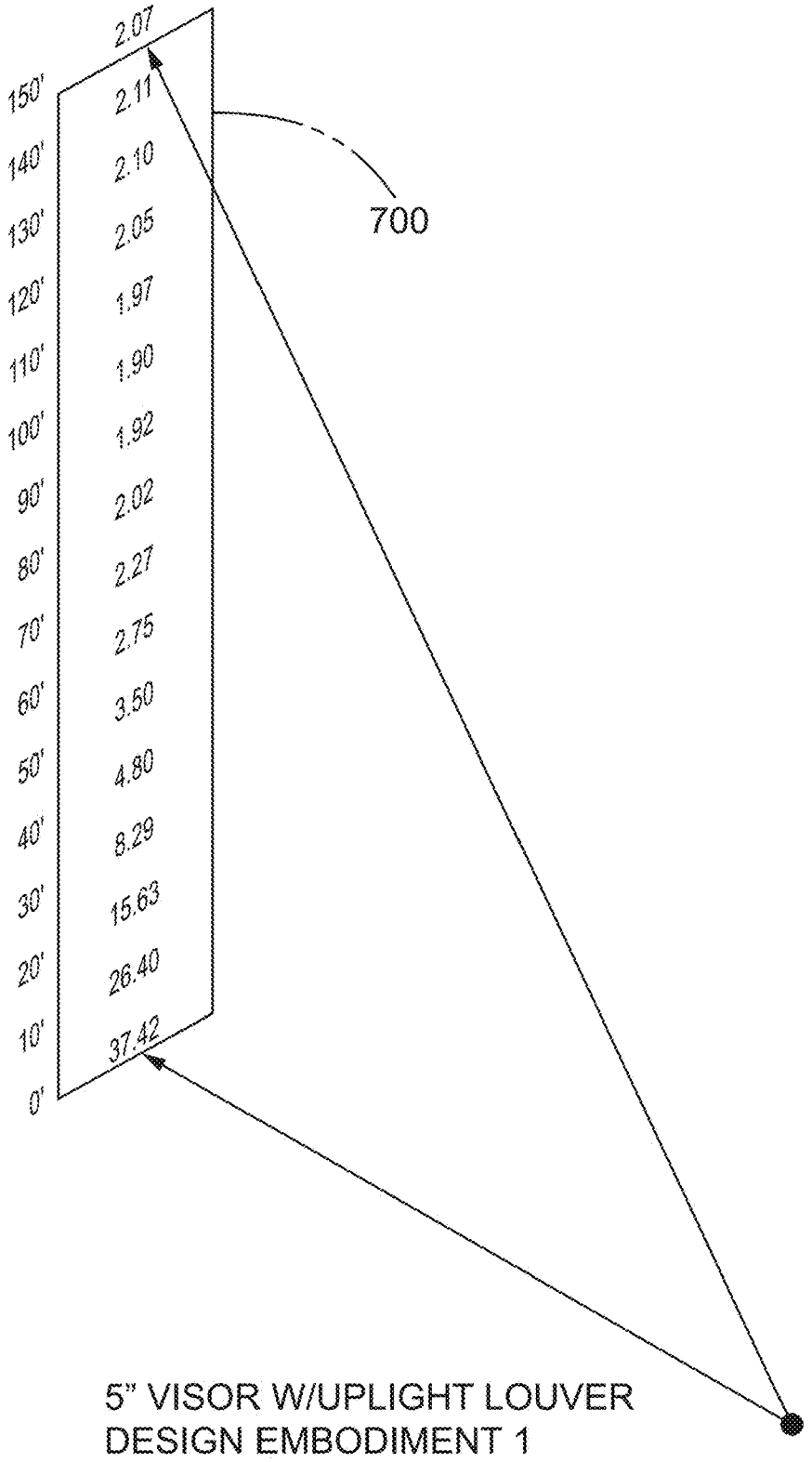

FIG. 18 illustrate FIG. 3C of U.S. Pat. No. 7,976,198.

V. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Terminology

The terms "luminaire" and "fixture" or "lighting fixture" are used interchangeably herein; all of the aforementioned terms are generally intended to mean a light source, means to power/regulate the light source, any associated light directing or light redirecting devices to shape the beam projected therefrom, and any associated structure to affix the aforementioned to a crossarm, pole, truss, etc. There is no distinction made between a luminaire, fixture, and lighting fixture; nor is there any limitation on the number of light sources contained therein or number/type of lighting directing or redirecting devices contained therein or affixed thereto.

The invention is directed to improving the sharpness of cutoff of light projected from uplight luminaires. As used herein, "cutoff" is generally defined as a measurable angle between perceived "full light" and perceived "no light," and generally corresponds to the point at which a player or a spectator would perceive no light visible from a source as transitioned from the perception of a light source being visible. However, notwithstanding this definition, "angle of cutoff" may be used herein with greater precision if indicated by context, to describe, for example, "the angle between 10% light and zero perceived light."

"Uplight" is generally defined herein as one or more luminaires which direct at least a portion of the light emitted therefrom away from the plane of a target area and towards a three-dimensional space proximate the target area. While it is possible for a luminaire to provide both uplight and light at a target area (e.g., from a poletop mounted position), poletop mounted luminaires have many issues separate from the present invention. Thus, as used herein "low-mounted uplights" generally refer to luminaires which are mounted relatively low on a pole or other structure (e.g., on the order of 35 or fewer feet above the ground), oriented to project light primarily upwardly, and are dedicated solely to uplighting; though this is by way of example and not by way of limitation.

"Back light" is generally defined herein as light which projects backwards and strikes the pole or a part of the luminaire or support structure and becomes visible to a player.

"Full light" is generally defined herein as light from a luminaire at an intensity of at least 50% of the maximum intensity.

"No light" is generally defined herein as the point at which the intensity level of light from a luminaire can no longer be perceived by persons at a target area (e.g., players on a baseball field).

"Glow" is generally defined herein as reflected light originating from the luminaire, and is typically internal to the luminaire, though this is by way of example and not by way of limitation.

"Glare" or "perceived glare" is generally defined herein as an unpleasant, undesirable, or disabling effect on a viewer when directly viewing one or more light sources; alternatively, the same effects could be experienced when viewing reflections (e.g., specular reflection of light from a source).

"Haze" is generally defined herein as perceivable visual obscuring or adverse effect to visibility as light transitions from full light to no light. Haze typically occurs during fog, rain, or other atmospheric conditions when particulates cause a scattering or absorption of light, though other situations could produce an effect which is commonly understood as hazy.

Also regarding terminology, in general reference is given to the sport of baseball and to a baseball as a sports object. The sport of softball and the softball as a sports object are very similar and will be considered to be included by baseball terms. Further, other sports such as golf, etc. having a ball in the air are envisioned as potentially benefiting from the present invention. Still further, any lighting application with a target area (e.g., a 2D plane) and an aerial space (e.g., a 3D space proximate the 2D plane) might likewise benefit from aspects of the present invention.

Comparison of Uplight Mounting Locations

The exemplary embodiments envision a sharp cutoff LED luminaire which is better suited to provide uplight from a low-mounted position than state-of-the-art LED luminaires. It should be noted that in the current state of the art, a low mounting position on the order of 10-35 feet from the ground is generally preferable to a mid-mounting position of on the order of 55 feet. A low mounting position is high enough to generally avoid theft or vandalism issues and to avoid being a hazard to player safety but is low enough to provide uplight across an entire ball trajectory while still being accessible for servicing with simple access equipment such as a ladder, without requiring heavier lift equipment such as personnel lifts. In contrast, a mid-mounting position can have a detrimental effect on field aesthetics, can often create a direct line-of-sight to the light sources from spectator seating which can cause perceived glare for spectators, and in some situations use of a mid-mounting position can be precluded by the detrimental effects of gradual beam cutoff of prior art luminaires. Likewise, in the current state of the art a low mounting position is generally preferable to a high mounting position on the order of 100+ feet because for aerial sports like baseball when light from a high mounted pole is used to provide aerial lighting, according to state-of-the-art practices aiming of said fixture is such that there is a direct view of the LED light source which can cause detrimental effects for a player tracking a ball who looks directly at the light source. These effects can include e.g., loss of sight of the ball trajectory and/or so-called "disability glare" which effectively temporarily blinds the player.

General Comparison of Technologies

Figure 1A:
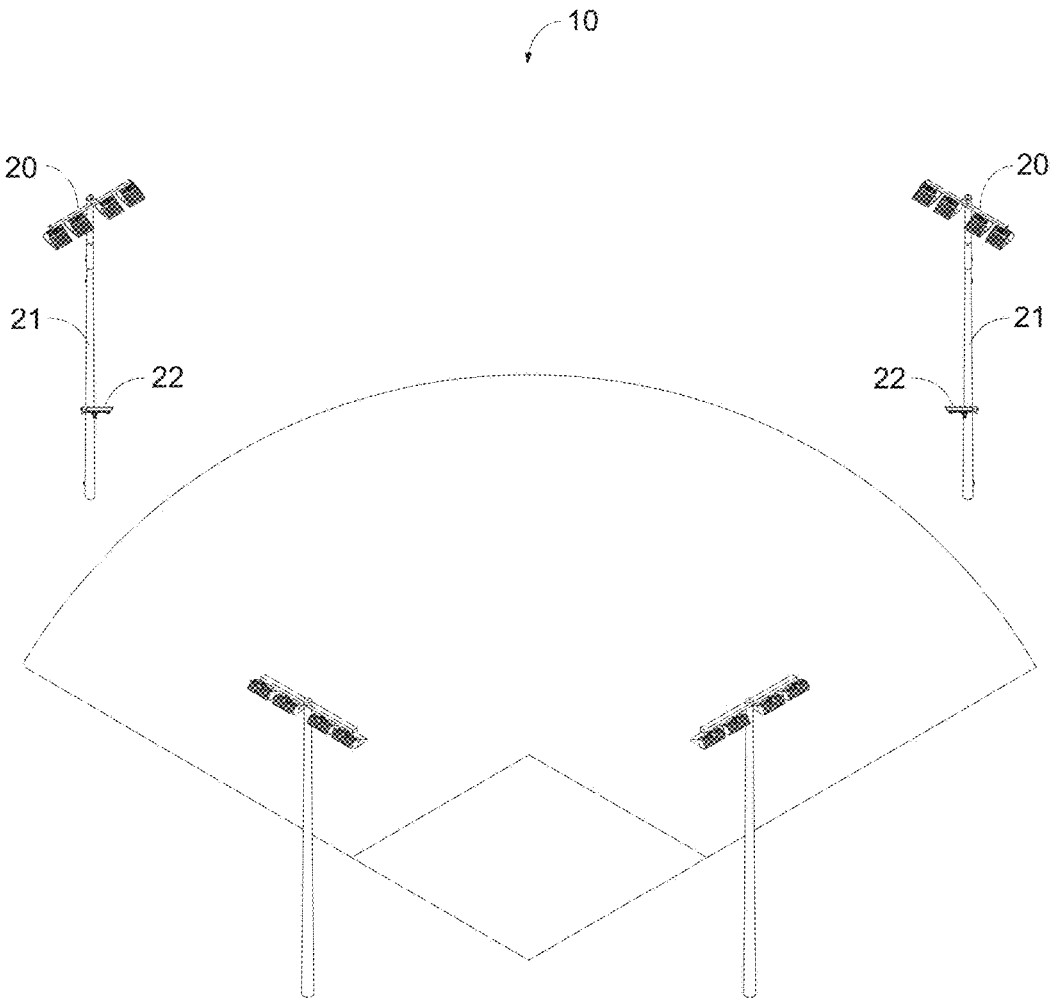
Prior Art Fig 1A
Figure 1B:
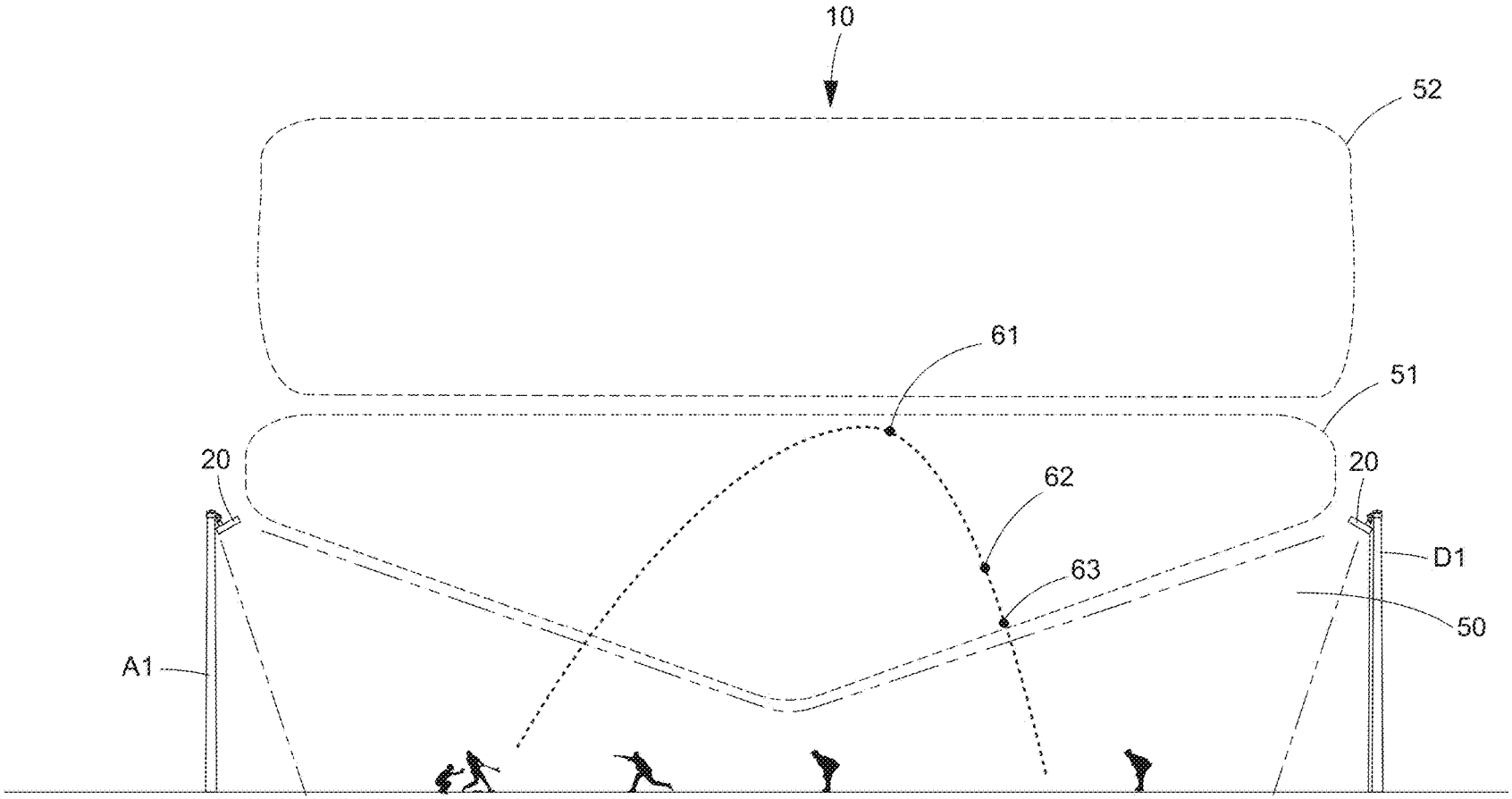
Prior Art Fig 1B
Figure 1C:
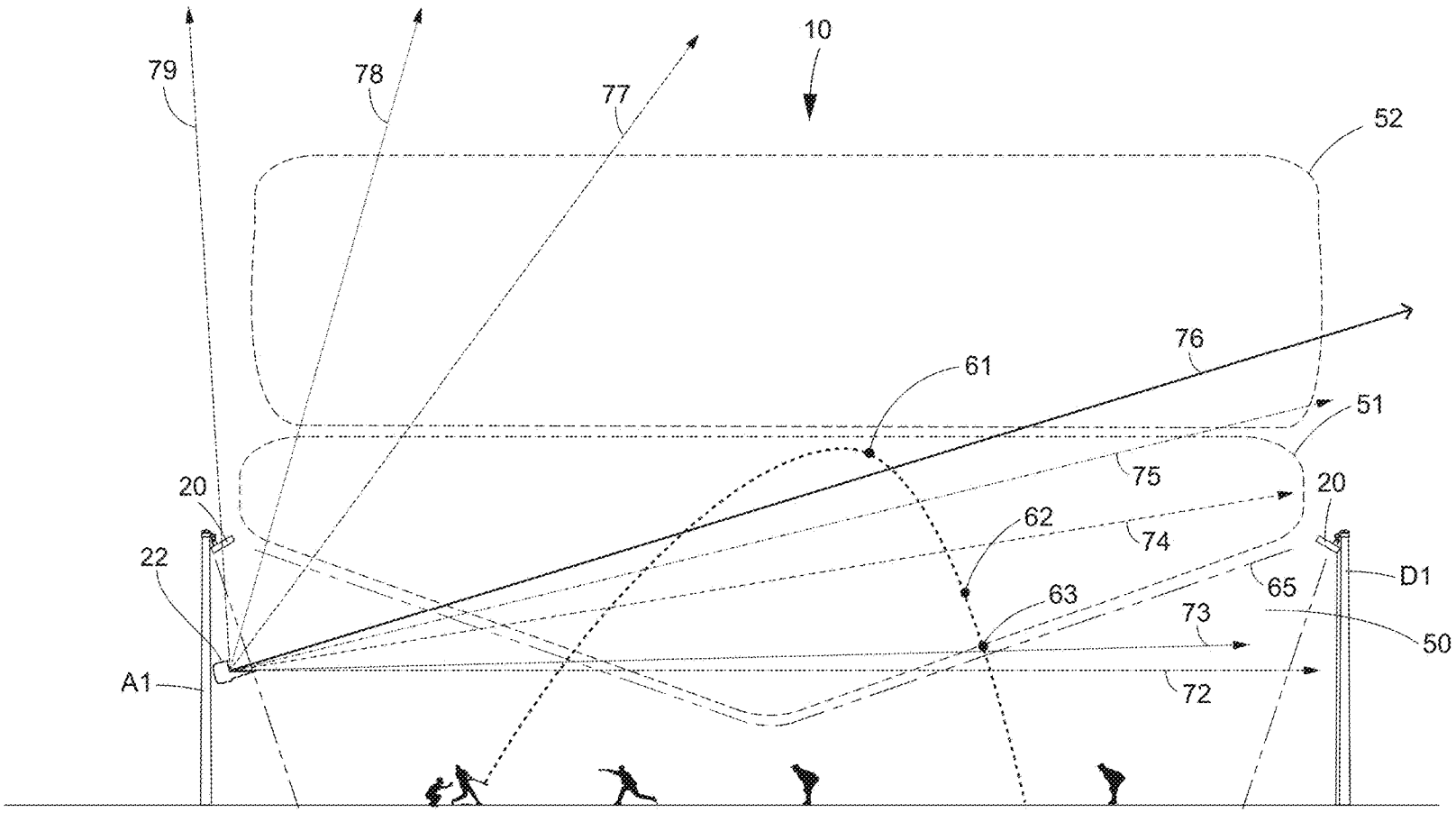
Prior Art Fig 1C

FIG. 1A illustrates a typical baseball field 10 having poles 21 with downlights 20 and uplights 22 according to prior art; it is of note that pole locations shown are simplified—many locations will have more poles such as is illustrated at field 11, FIG. 3A and field 12, FIG. 3B. FIG. 1B illustrates a side view of field 10 illustrating a typical ball trajectory across a lower aerial zone 50 (i.e., the zone proximate a target area), a mid-range aerial zone 51 (i.e., the zone where haze, light pollution, or general light scatter is typically the most severe), and an upper aerial zone 52 (i.e., the zone outside the range of play and not needing illumination); note that for clarity uplights 22 have been removed. FIG. 1C illustrates in simplified form the lighting effect at field 10 from a prior art luminaire 22 aimed at 13.5 degrees above horizontal (which is typical). Numbered rays 72-79 are listed in order from lower to upper (with angle from horizontal):

lower cutoff 72 at 0 degrees
lower field angle (10% intensity) 73 at 3 degrees
lower beam angle (50% intensity) 74 at 10 degrees
luminaire aiming axis 75 at 13.5 degrees
maximum beam intensity 76 at 17 degrees
upper beam angle (50% intensity) 77 at 54 degrees
upper field angle (10% intensity) 78 at 74 degrees
upper cutoff 79 at 94 degrees It may be appreciated from FIG. 1C that in order to provide a lower cutoff at horizontal or above, prior art luminaire 22 needs to be tilted up more than might otherwise be desirable for optimum lighting in the aerial space nearest the players (i.e., zone 50). The lower portion of the beam loses too much light due to an imprecise cutoff, so a ball in play 61 falling down from high above the field will appear to get brighter at maximum beam intensity 76, then suddenly dim as it approaches the 10% intensity location 74 (generally, ball in play 62), then again suddenly brighten as it passes into ground zone 50 which is illuminated by field lights 20 (generally, further along the trajectory than ball in play 63). Additionally, much unneeded light is wasted on upper aerial zone 52 which is higher than baseballs in play would reach, and which needs no illumination.

Figure 1D:
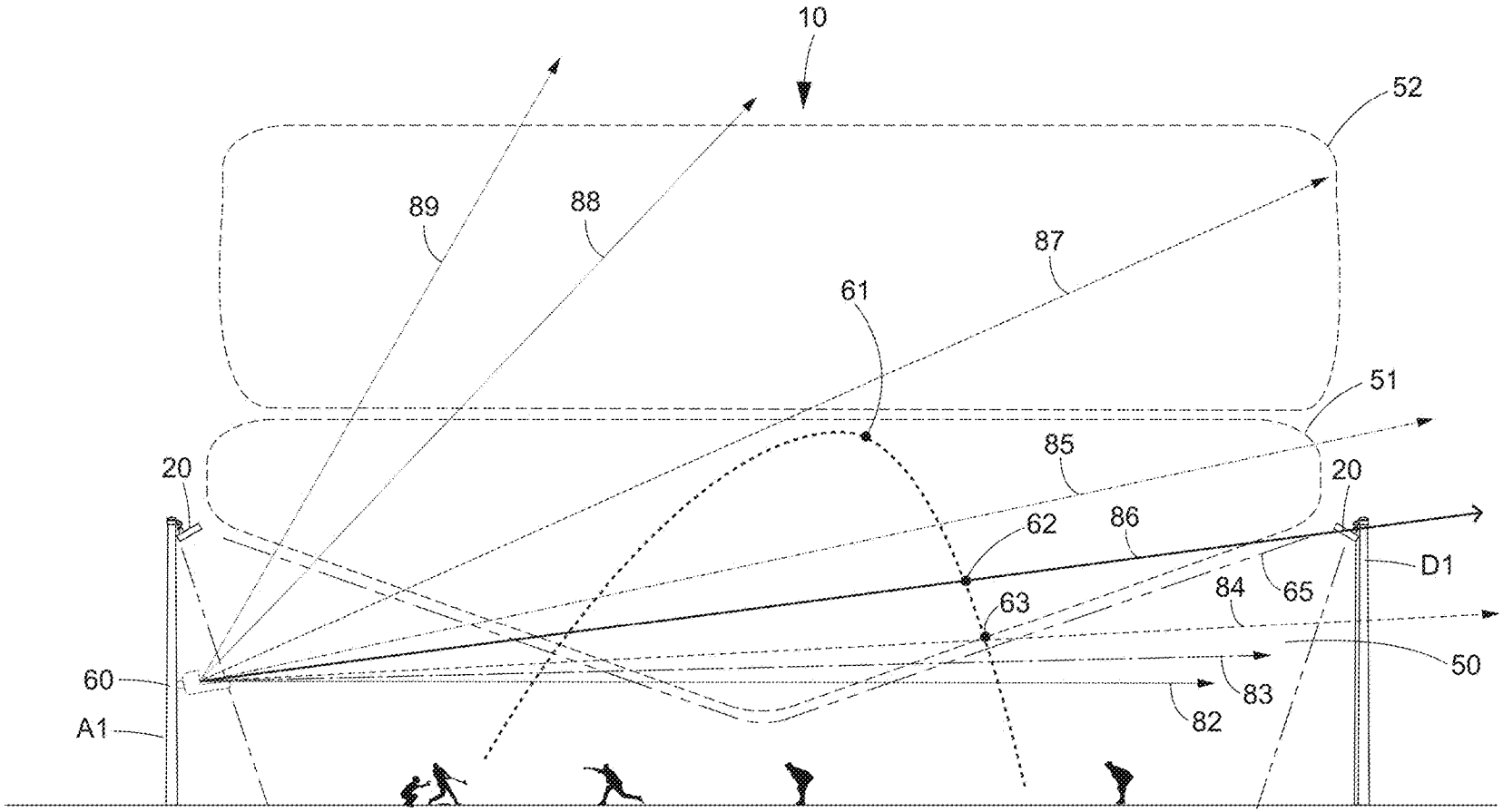

Alternatively, FIG. 1D illustrates in simplified form the lighting effect from a generic luminaire 60 according to aspects of the present invention, here aimed at 12 degrees above horizontal. Numbered rays 82-89 are listed in order from lower to upper (with angle from horizontal):

lower cutoff 82 at 0 degrees
lower field angle (10% intensity) 83 at 1.5 degrees
lower beam angle (50% intensity) 84 at 3 degrees
maximum beam intensity 86 at 8 degrees
luminaire aiming axis 85 at 12 degrees
upper beam angle (50% intensity) 87 at 24 degrees
upper field angle (10% intensity) 88 at 45 degrees
upper cutoff 89 at 60 degrees It may be seen that in contrast to the prior art arrangement illustrated in FIG. 1C that a ball in play at 61, 62, and 63 will be adequately illuminated by use of luminaire 60; namely, at trajectory point 61 the ball is illuminated by beam 87 representing 50% intensity, from there the ball falls into a region of more and more light (e.g., at trajectory point 62 where it is illuminated by beam 86 representing maximum luminaire intensity), and finally, as the ball falls to trajectory position 63, it transitions to a light level that is still bright at 50% intensity and where it is immediately illuminated by light from downlight fixture 20.

Of course the preceding discussions of both FIGS. 1C and 1D are greatly simplified. Uplighting will likely be provided from multiple locations around the field. And light from poletop luminaires 20, even if fairly sharply cut off, will allow for some transition near their upper beam edges 65. Thus it will still require ordinary skill in the art to arrange lighting for the field to take into consideration local field conditions.

Figure 2:
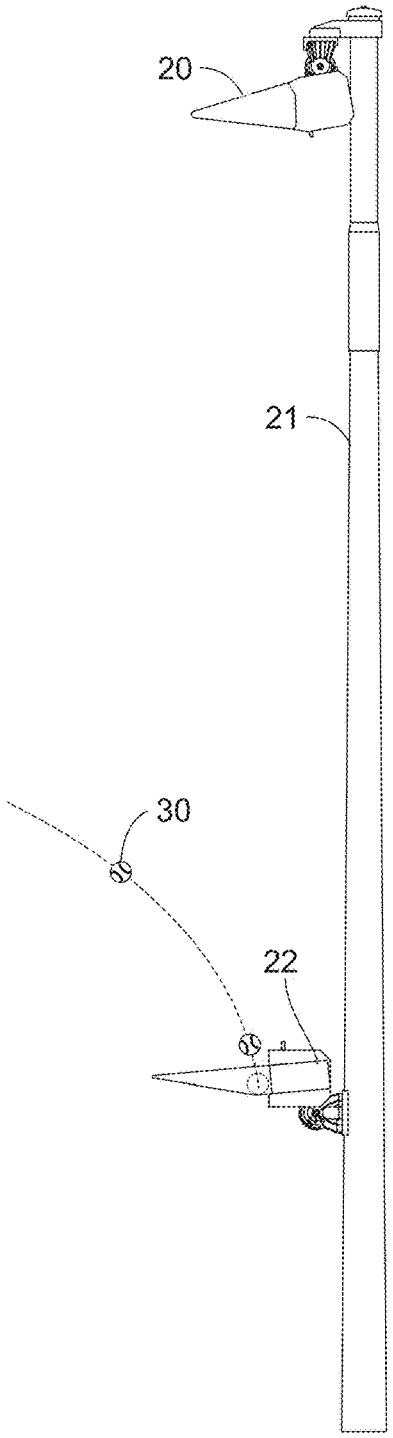
Prior Art Fig 2

Another further difficulty with providing uplight from prior art luminaires is illustrated in FIG. 2. As can be seen, a ball 30 in flight (e.g., batted as in FIGS. 1A-D) can sometimes be trapped in the visor of prior art uplight fixture 22; this is addressed in at least some of the embodiments later set forth.

General Embodiment

Figure 5A:
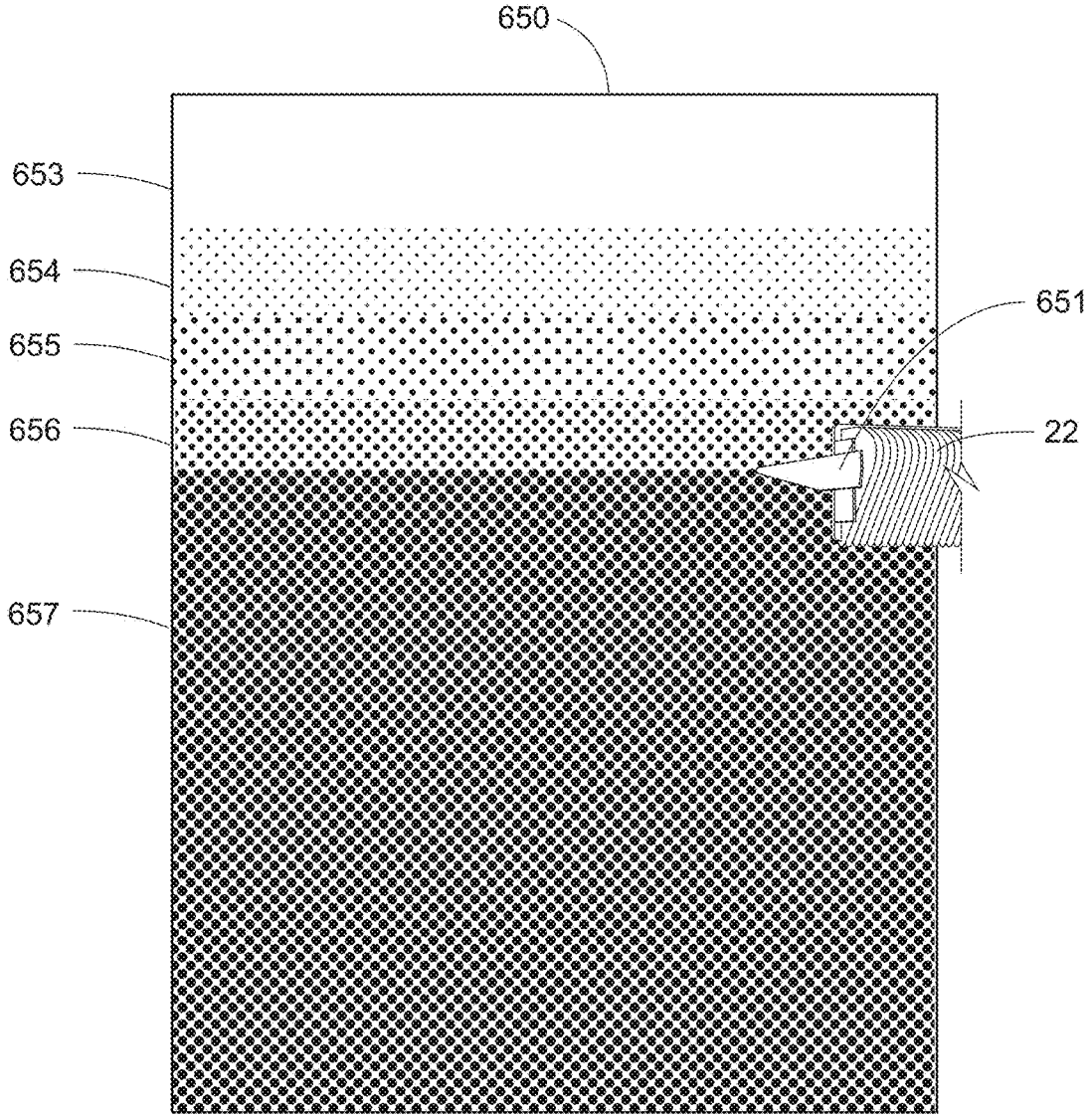
Prior Art Fig 5A
Figure 5B:
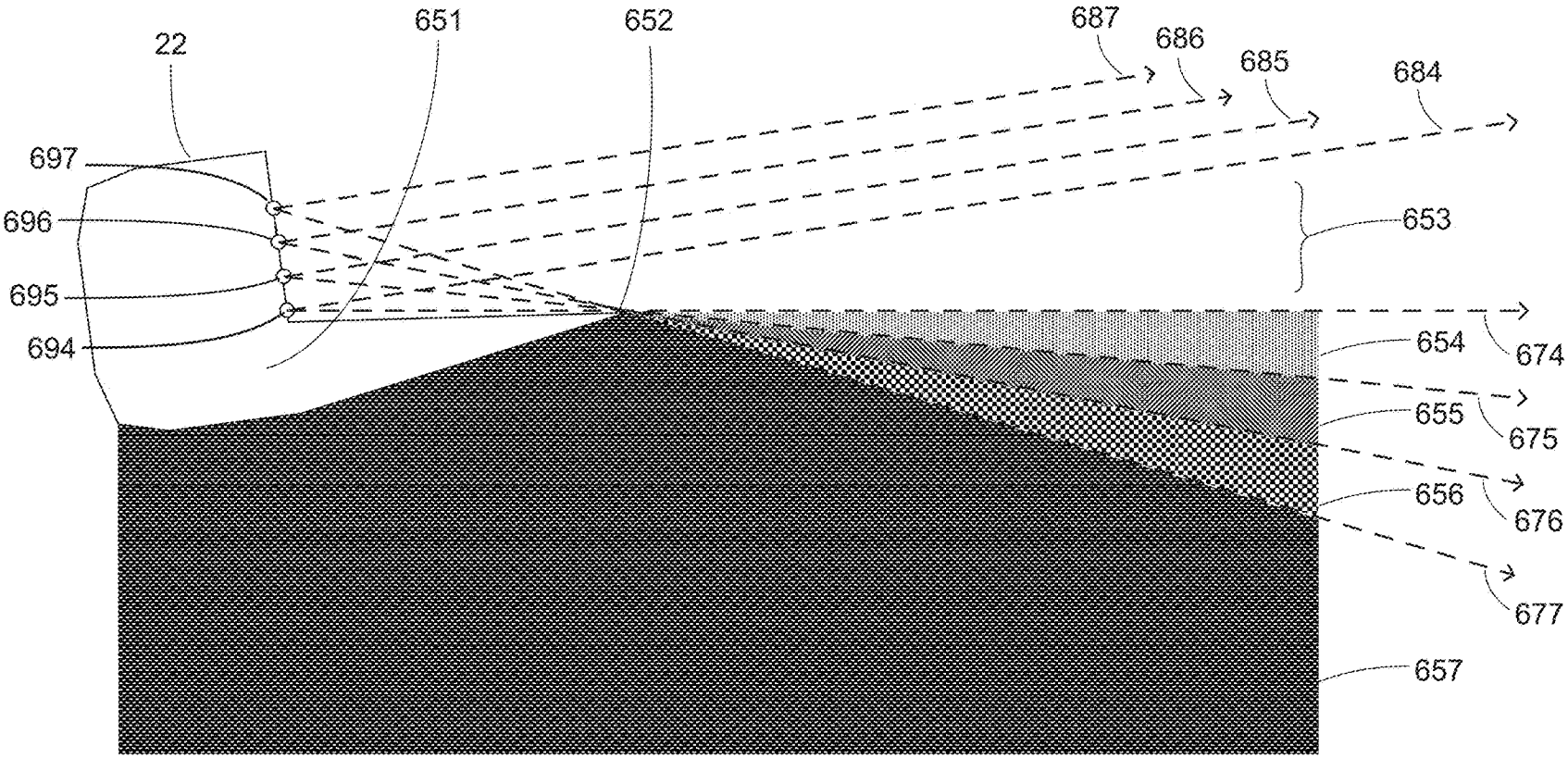
Prior Art Fig 5B
Figure 5C:
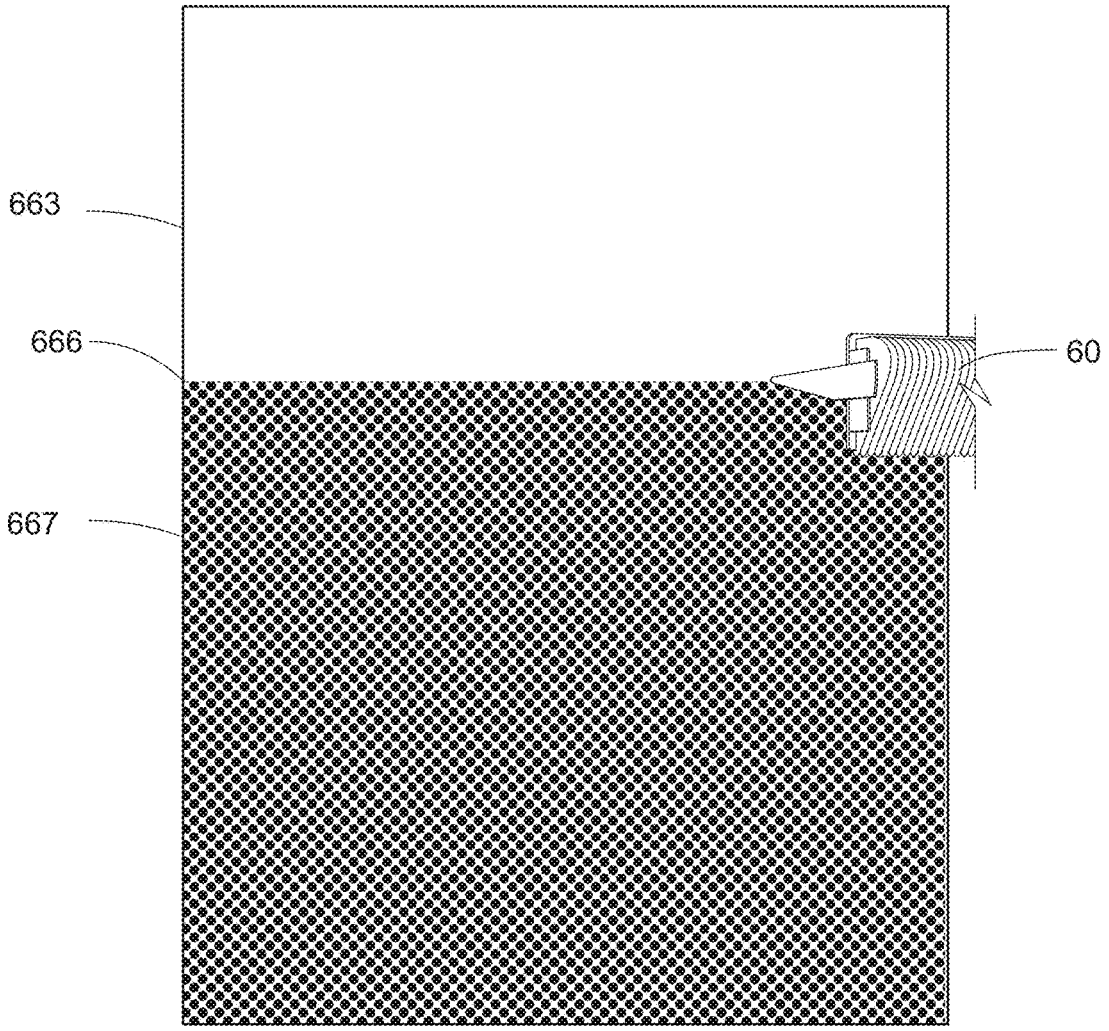
Figure 5D:
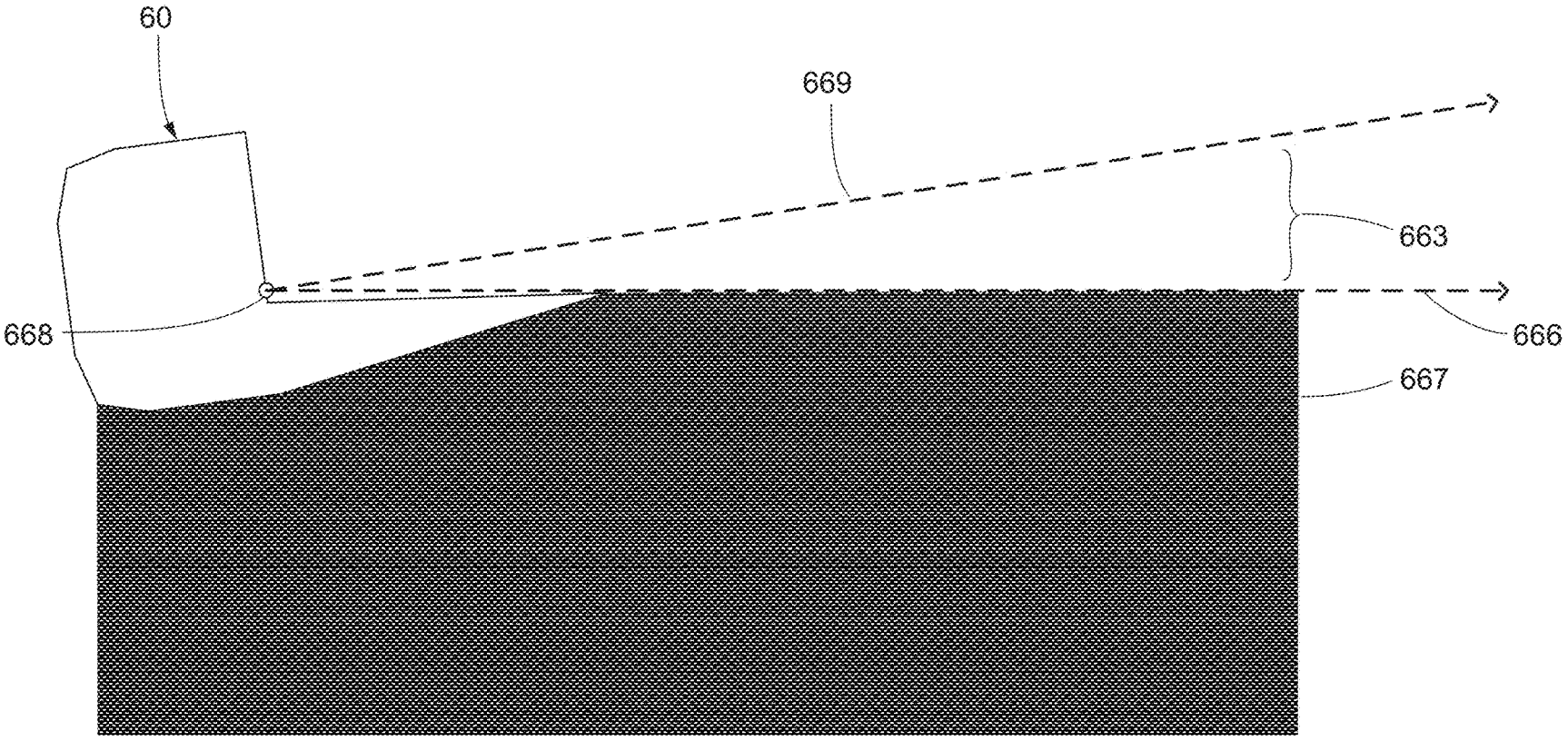

Envisioned is a sharp cutoff LED luminaire adapted to provide a transition from full light to no light over an angle of on the order of five or fewer degrees, allowing precise placement of controlled light in the aerial space above the field or other target area where it is difficult to provide light—without contributing to glare for players. This is in contrast to state-of-the-art LED luminaires which provide a similar transition over an angle of 10 or more degrees, depending on luminaire design. This lack of a sharp cutoff in prior art fixtures is generally illustrated in FIGS. 5A and B, and has been previously discussed. FIGS. 5C and D illustrate sharp beam cutoff from a generic fixture 60 designed in accordance with aspects of the present invention. In contrast to luminaire 22 which has multiple rows of LEDs (and therefore multiple zones of light) the light from luminaire 60 (represented by beam center 669), which has a single row of LEDs 668, is cut off sharply at 666 between illuminated area 663 and dark area 667. These results, and the basis for more specific measurements in the exemplary embodiments, were produced in accordance with test setup 661 of FIG. 11, the setup of which generally comprised the following:

- distance from the farthest end of the external visor (i.e., the tip of the visor) to the back wall was 25 feet
- luminaires were mounted 67 inches above the ground (as measured to the center of the LED array)
- LEDs were operated at a low nominal current (e.g., 0.10A)
- any noticeable light on paper 614 was measured
- any noticeable light on stand 616 was measured More specific embodiments using the generalized example of a sharp cutoff uplight fixture above are set forth below, and include a method of designing a lighting system using one or more sharp cutoff LED luminaires at a low-mounted position in a manner that provides uplighting without perceived glare. While the specific exemplary embodiments are set forth with respect to baseball it can be appreciated that a sharp cutoff LED luminaire may find use in a variety of applications at a variety of locations and mounting heights; all are possible, and envisioned.

Figure 3D:
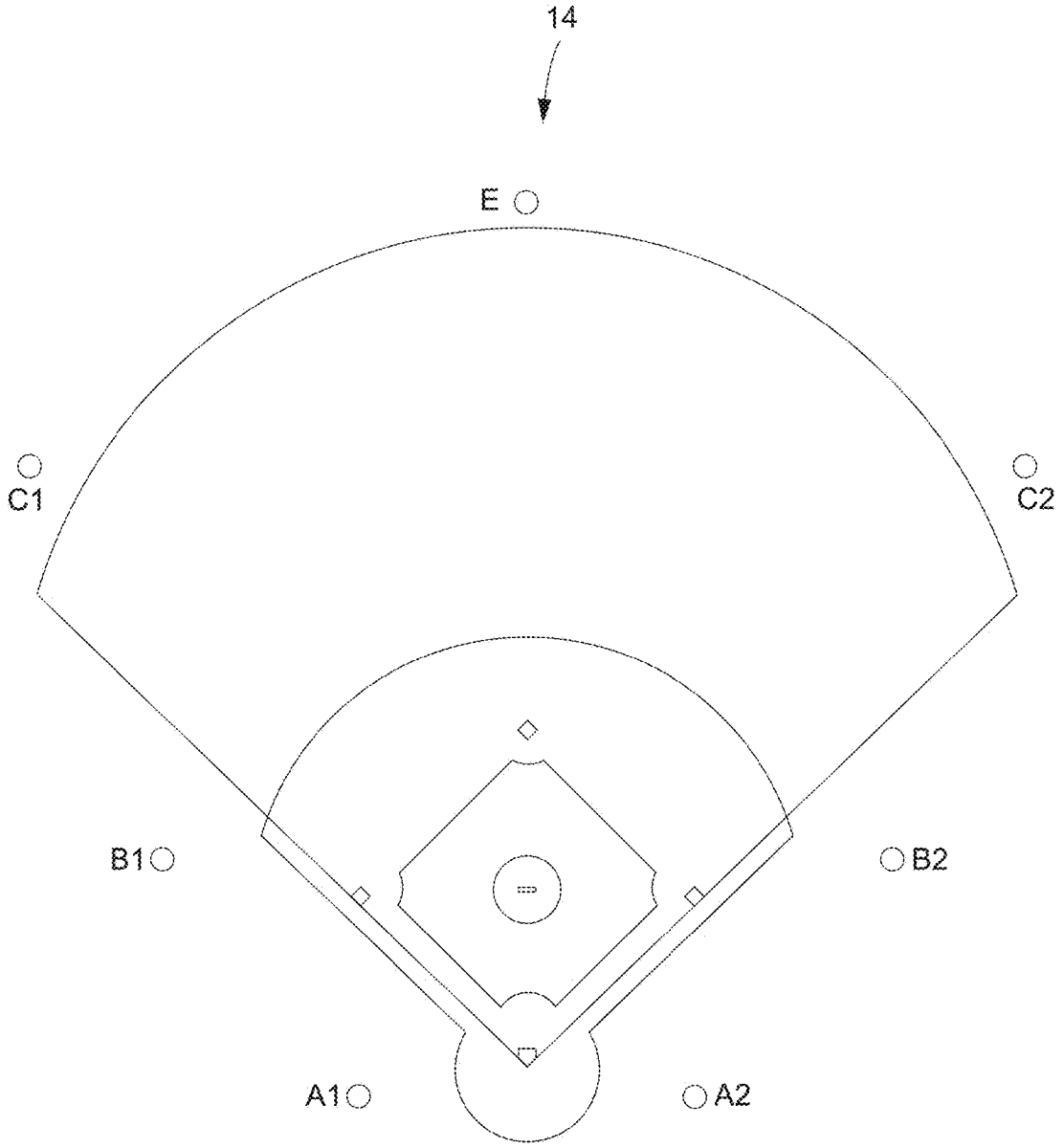
Figure 3E:
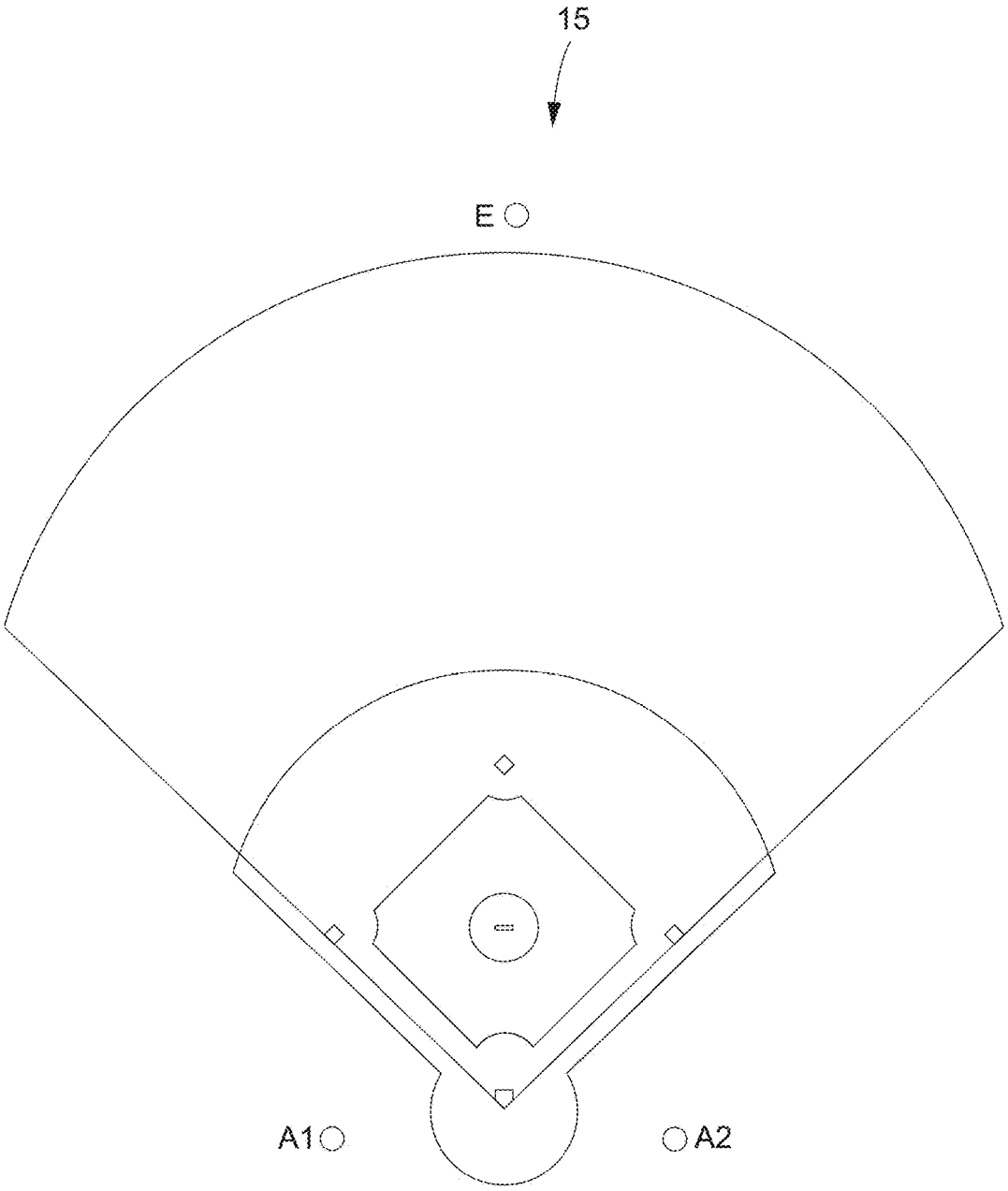
Figure 4A:
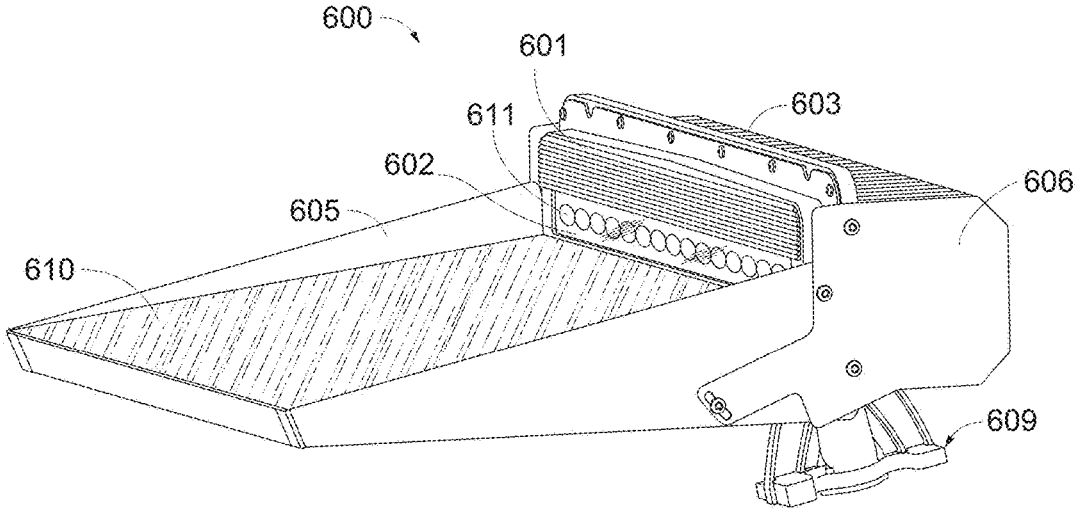
Figure 4B:
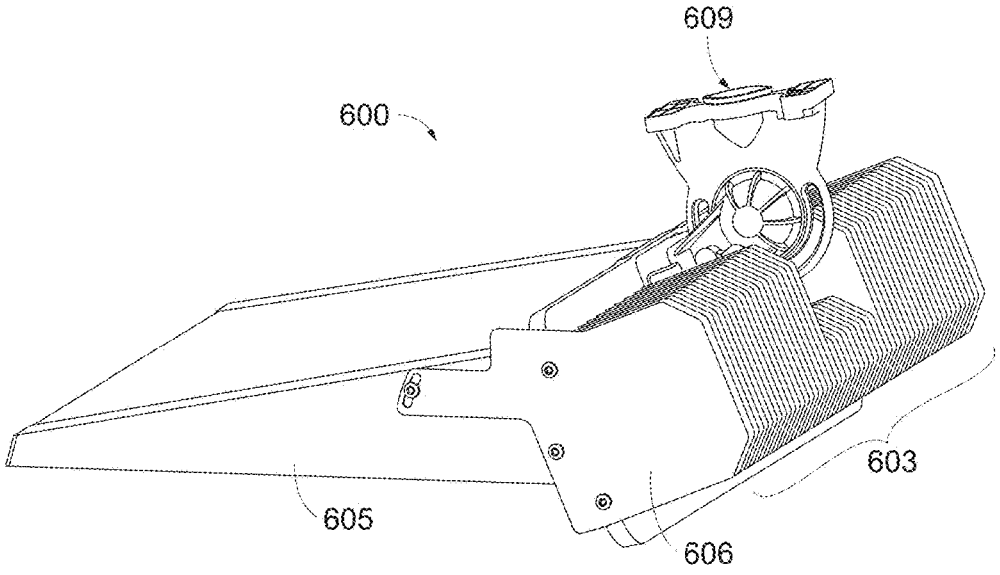
Figure 4C:
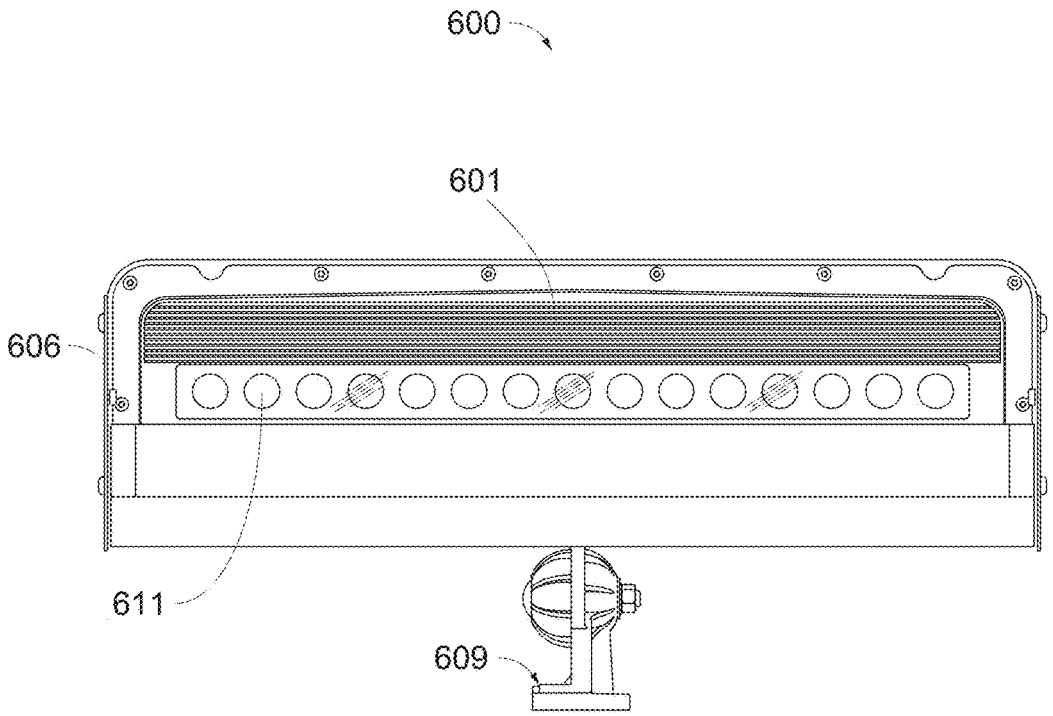
Figure 4D:
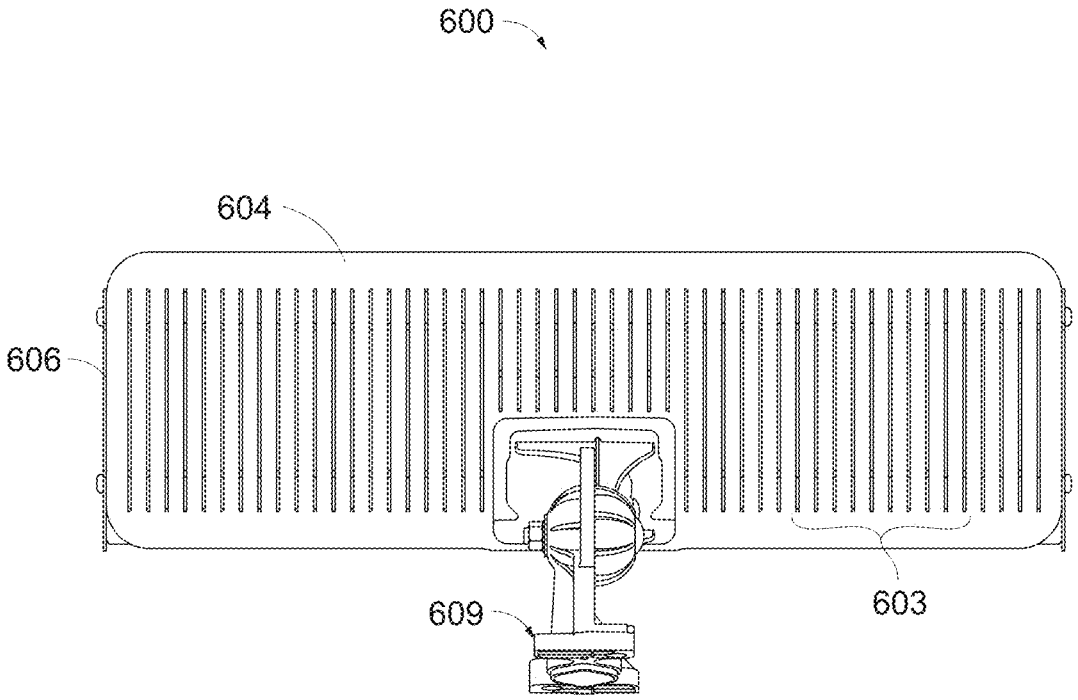
Figure 4E:
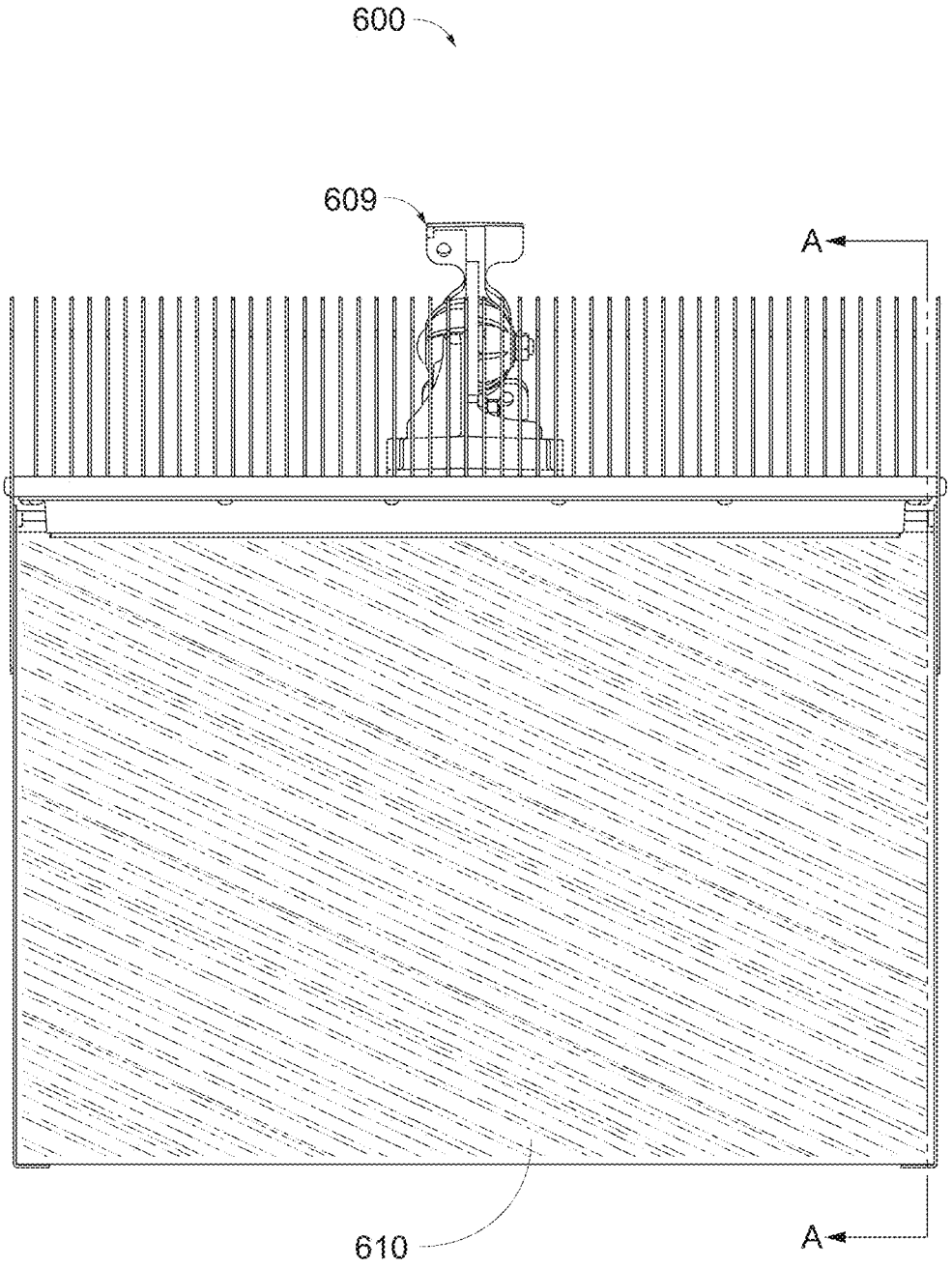
Figure 4F:
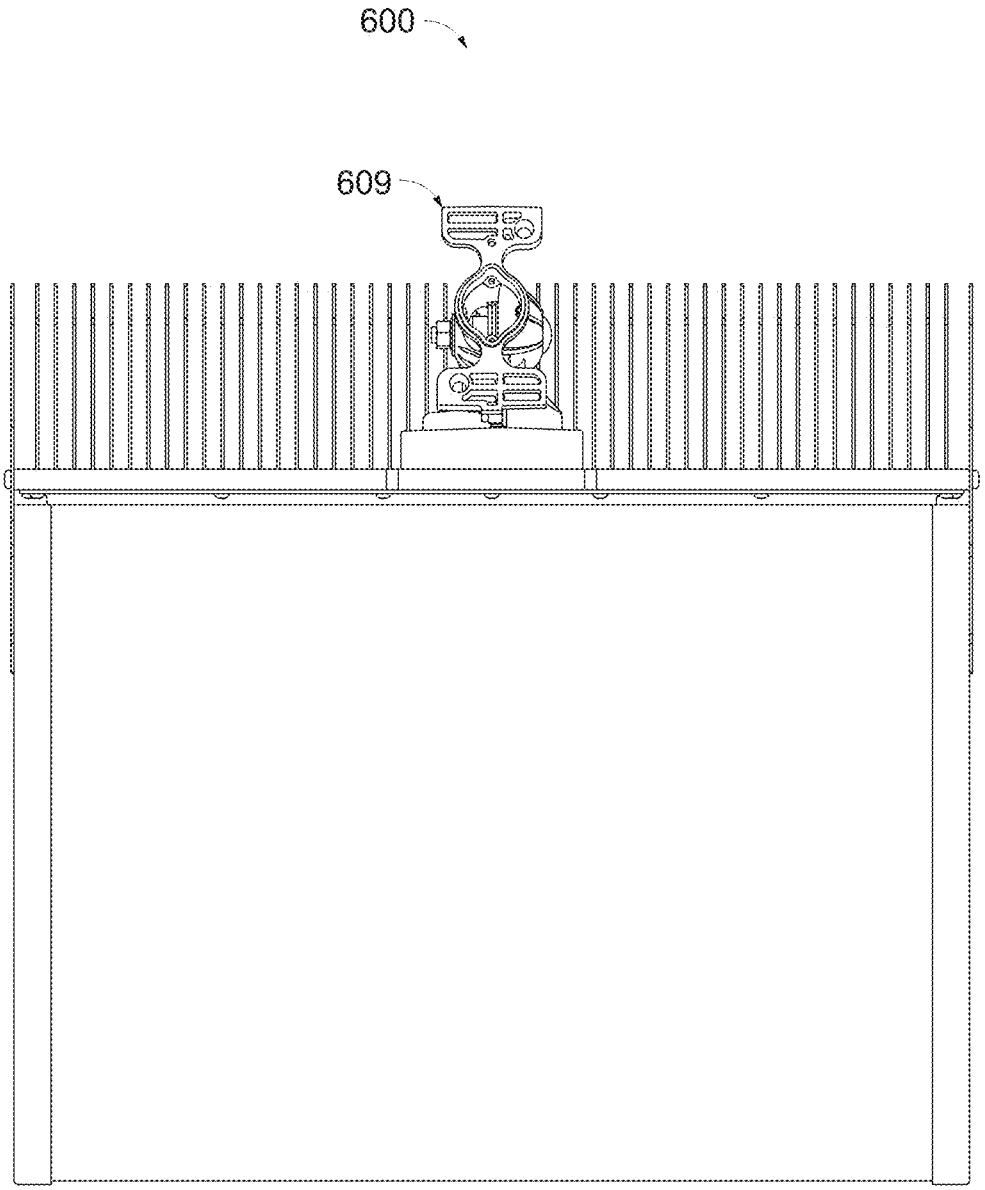
Figure 4G:
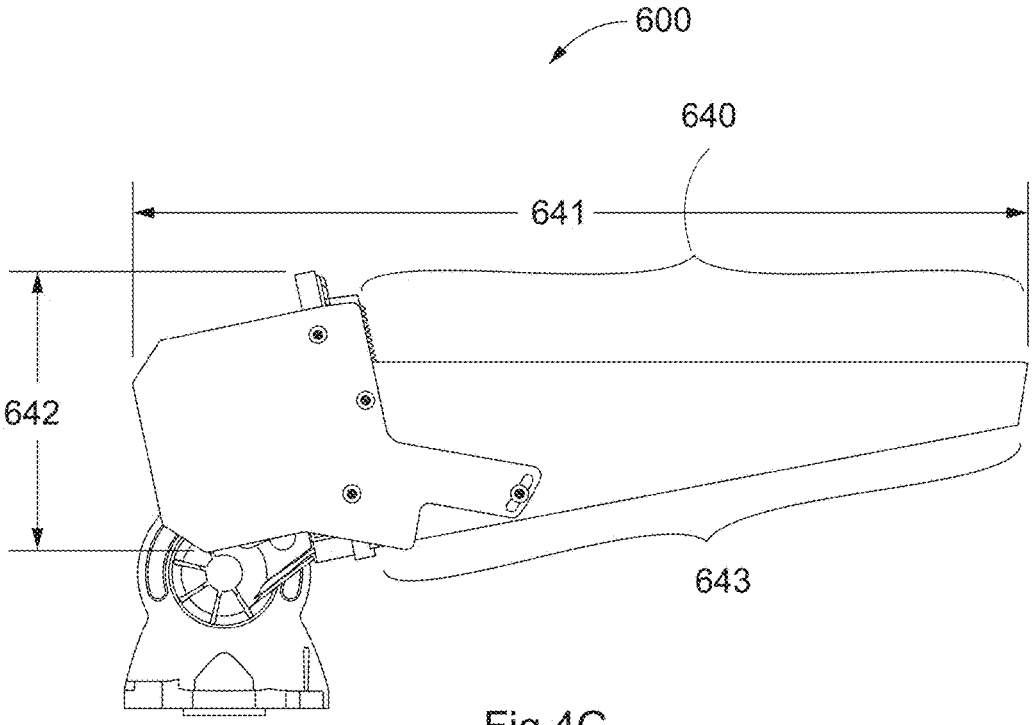
Figure 4H:
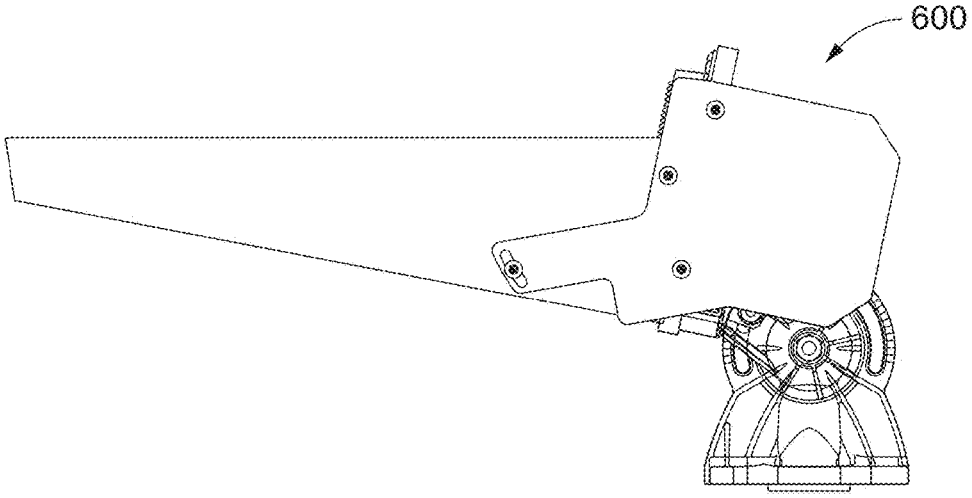
Figure 4I:
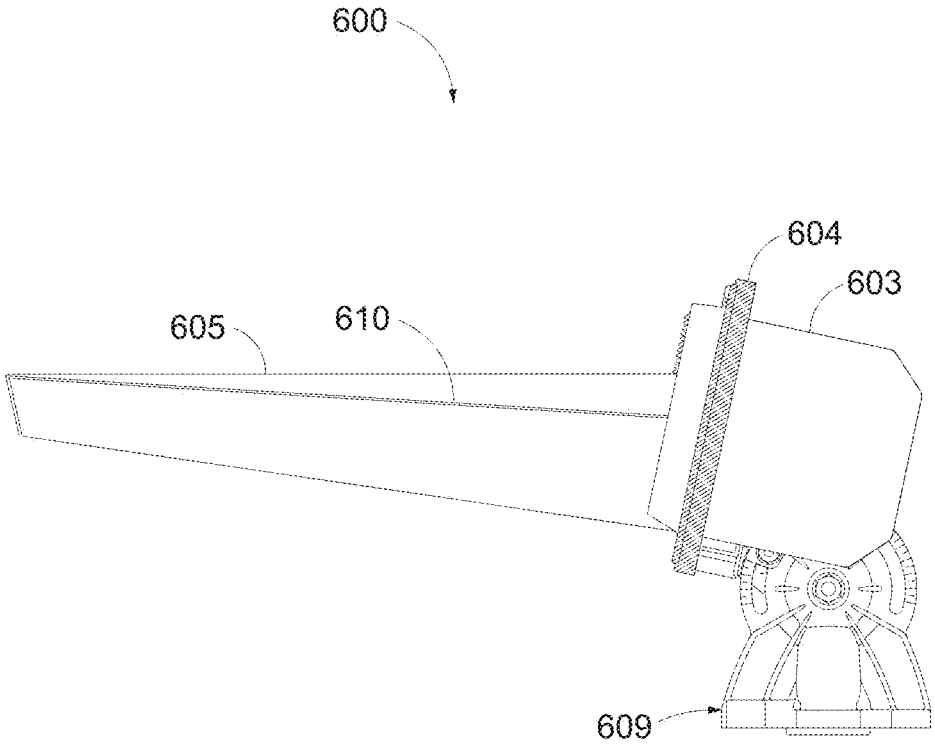

The more specific embodiments set forth below also include a method of improving lighting design practices so to reduce pole count (and therefore potentially reduce cost of a lighting installation). As has been previously discussed, It may be understood that if the pole configuration shown in FIG. 3C (i.e., layout 13) were used with prior art uplight luminaires, there would be significant problems with meeting the exacting requirements of sports lighting (e.g., uniformity, minimum light level, etc.) while also minimizing glare and haze, particularly since the proposed non-standard "E" pole location is in center field in direct view of a batter. The exemplary embodiments overcome issues of haze and perceived glare, and so alternative pole layouts are possible, and envisioned; namely, a five-pole layout 13 (FIG. 3C) in which an E pole replaces all C and D pole locations, a seven-pole layout 14 (FIG. 3D) using similar principles, and a three-pole layout 15 (FIG. 3E).

Figure 6A:
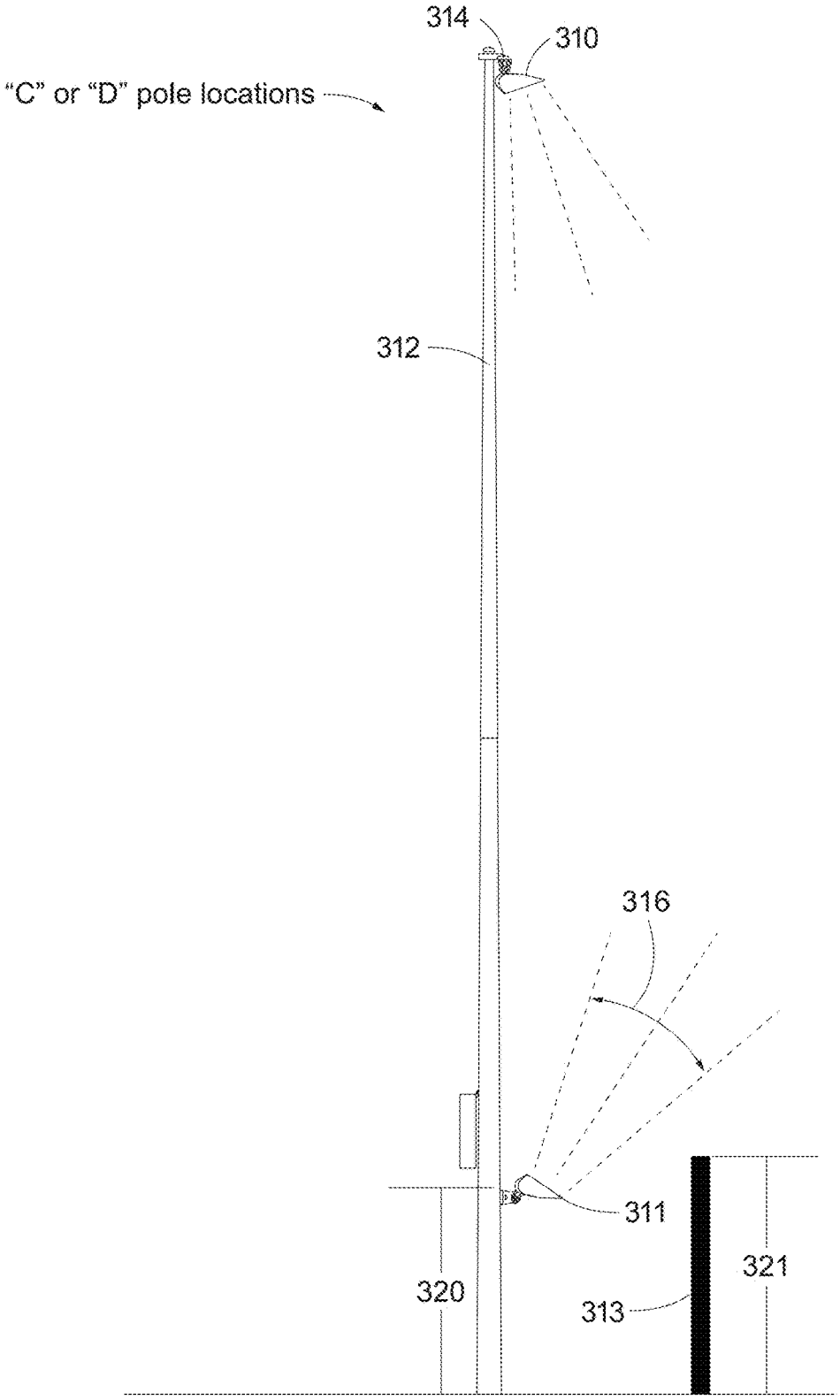
Prior Art Fig 6A
Figure 6B:
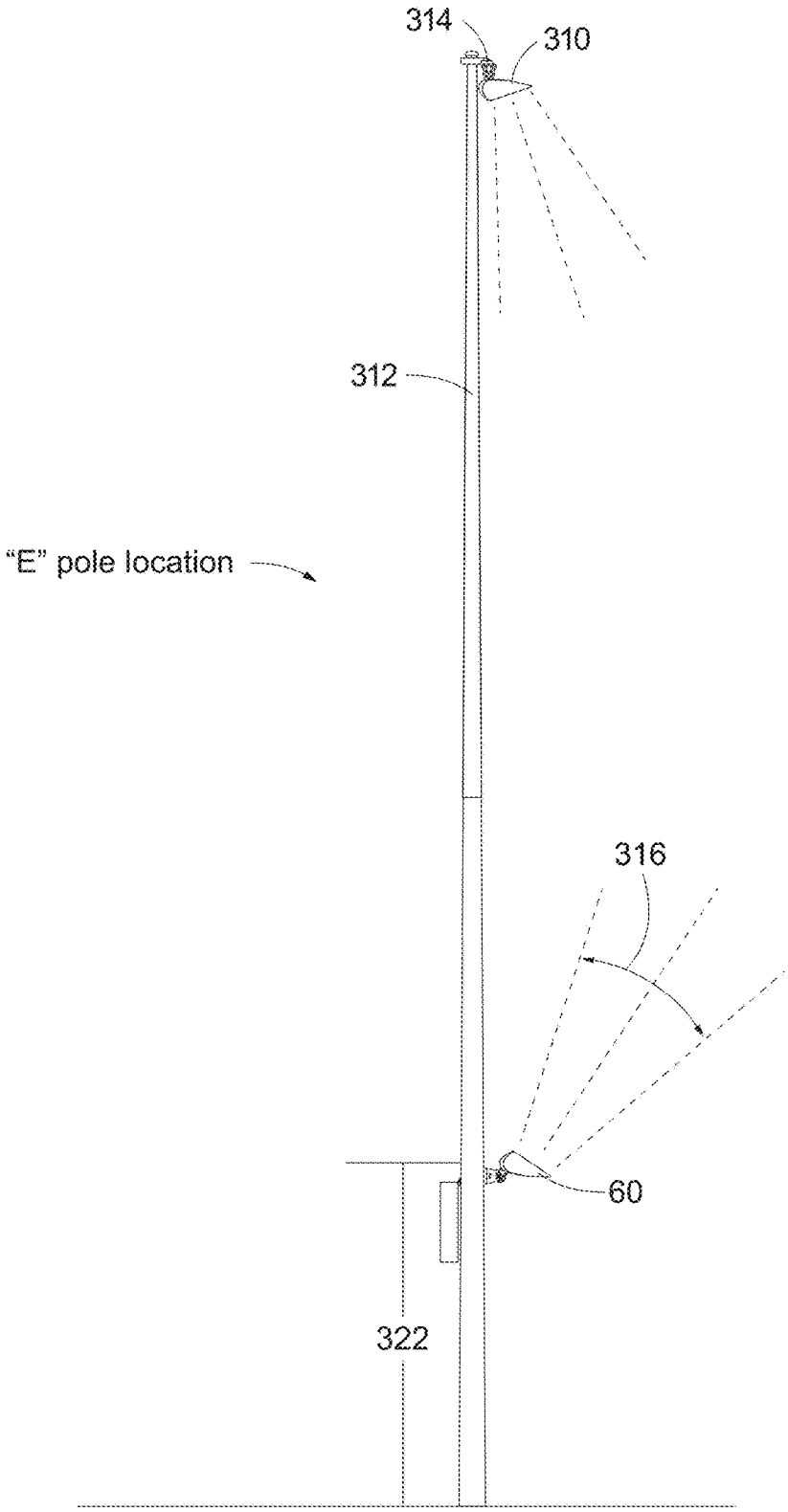

In addition to a potential reduction in poles which can lead to cost savings, the reduction of haze and perceived glare could eliminate the need for walls, blackened boards, or other blocking devices (reference no. 313, FIG. 6A), and could even permit a higher mounting height (reference no 322, FIG. 6B) without reducing vertical beam spread 316—because of the preferential shifting of intensity within the beam (the details of which will be discussed).

A more specific exemplary embodiment, utilizing aspects of the generalized example described above, will now be described.

B. Exemplary Apparatus Embodiment 1

FIGS. 4A-I illustrate a sharp cutoff LED uplight luminaire 600 designed to have a lower cutoff transition (i.e., from full light to no light) over an angle of five degrees or less, an upper cutoff on the order of 30 to 45 degrees from the central aiming axis of the LEDs (which can differ from the aiming of adjustable armature 609 and/or the external visor), and an upper cutoff transition as desired but not necessarily as sharp as the lower cutoff. Uplight luminaire 600 generally comprises: a compact array of LEDs with associated optics (collectively, reference no. 611) in a single row which is on the order of one inch high and twenty to thirty inches in width, and which is mounted to a thermally conductive housing body 604; a light transparent or light transmissive lens 602 which seals against an open portion of housing body 604 and through which light from said LEDs and associated optics (here, secondary lenses) project; an adjustable armature 609 for vertically aiming about 12 to 15 degrees above horizontal or as desired, for horizontal aiming as desired, and for affixing body 604 of luminaire 600 to a crossarm or other structure roughly 10 to 40 feet above ground (i.e., much closer to the bottom of the pole than the top); a plurality of heat fins 603 affixed to or otherwise integral to housing body 604 so to aid in dissipating heat from the LEDs; a primary reflective surface 610; side visor portions 605 which add rigidity and could be made reflective, if desired; side housing portions 606 which affix primary reflective surface 610 and side visor portions 605 to housing body 604; and one or more ribbed or blackened portions 601 of housing body 604 or other portion of luminaire 600 to aid in reducing internal glow, perceived glare, and/or back light.

Figure 7:
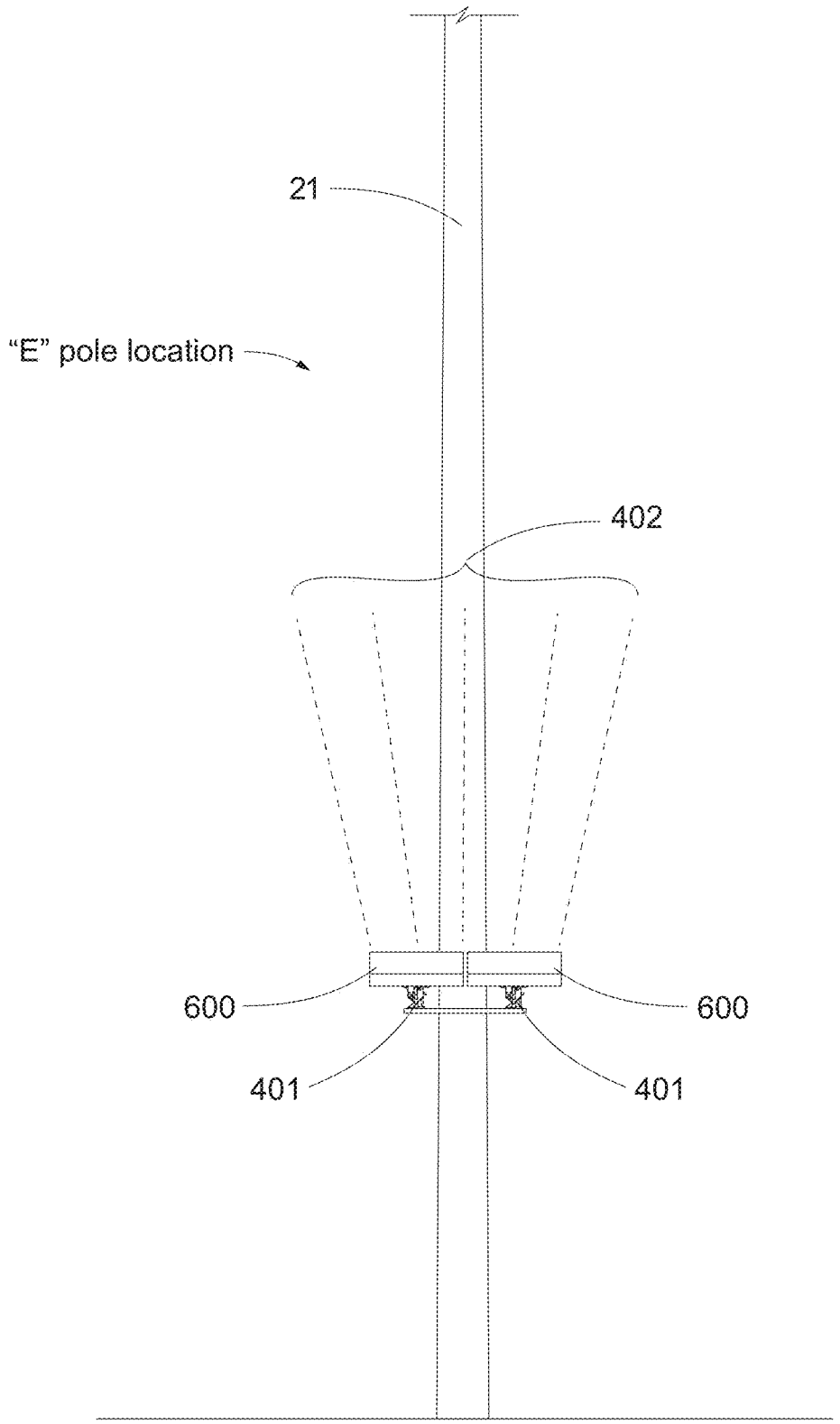
FIG. 7 illustrates one possible option or alternative according to aspects of the present invention wherein multiple sharp cutoff LED luminaires are low-mounted and oriented to provide uplight across a desired horizontal beam spread.

In practice, luminaire 600 could employ on the order of 80 model XP-L2 LEDs available from Cree, Inc., Durham, N.C., USA, operated below maximum rated current with no active cooling and still provide adequate uplighting above a field when mounted at customary distances for standard pole locations. Such uplight levels might be on the order of 10 fc near the ground and less in the higher elevations above the field for a Class I baseball field and on the order of 1-5 fc for smaller fields or at a lower class of play. Adjustable armature 609 which provides both horizontal and vertical aiming capabilities may be designed in accordance with US Patent Publication No. 2011/0149582 incorporated by reference herein in its entirety, or otherwise. The external visor (here, parts 610, 605, and any other parts or fastening devices affixed to housing body 604 by side housing portions 606) could be fixed, or could be pivotable using means and methods described in U.S. Pat. No. 9,631,795 incorporated by reference herein in its entirety, or otherwise. Secondary lenses could comprise TIR wide beam secondary lenses (e.g., any of the FNP models of lenses available from Fraen Corporation, Reading, Mass., USA adapted to work with the aforementioned model of LED), a complex lens system or lenses designed to produce a very wide beam (which could aid in reducing transmission losses and re-absorption that contributes to internal glow), or even simple reflectors in lieu of secondary lenses (e.g., a scaled down (i.e., suitable for a single LED) version of any model of reflector available from the aforementioned Cree); namely, any light directing or light redirecting device which harnesses at least a majority of light from its associated LED (and typically abuts the LED board which is mounted to an internal surface of the housing and at least partially surrounds the associated LED, though this is by way of example and not by way of limitation). Or, if desired, multiple fixtures 600 could be coupled to commercially available brackets 401 which are further coupled to a pole 112 such that the external visors of said fixtures are generally in near abutment, parallel to the ground (or aimed as desired), the light sources are not directly viewable, and horizontal spread is increased as desired; for the specific scenario illustrated in FIG. 7, doubling horizontal spread 402 from roughly 90 degrees to roughly 180 degrees.

Many things are of note with respect to luminaire 600. Firstly, LEDs and associated optics maintain a low profile relative the length of the visor (a total height 642 on the order of 10 inches and a total length 641 on the order of 22 inches) which aids in producing a sharp cutoff on the order of 5 degrees or less; this purposefully runs contrary to current LED luminaire design insomuch that a single row of LEDs is favored over a densely packed array of stacked LEDs. Further, luminaire 600 projects light upwardly above the plane of the external visor with no additional visors, lenses, or other devices near area 640 which would create any kind of gradation or non-uniformity; this ensures no light projects below the plane of the external visor near area 643. Also, reflective top surface 610 of the external visor of luminaire 600 sits flush against housing body 604 fractions of an inch below the linear array of LEDs (e.g., proximate) to ensure that no light escapes below luminaire 600 in the general area of 643 which could also produce back light. In essence, full light is provided above the visor and no light is provided below the visor. Also, side visors 605 (which could be reflective or blackened) are designed to be generally parallel to and above the LEDs so to prevent light transmitting out the sides of luminaire 600 and causing offsite perception of glare.

As typically mounted, the luminaire is positioned at an aiming angle of 12-15 degrees above horizontal, with the upper extent of the composite beam around 30 to 45 degrees above the central aiming axis of the LEDs, and a nearly ideal distribution of lighting intensity from the least amount at the upper beam extent above the central aiming axis of the LEDs down to maximum intensity (e.g., 50% or more intensity) at the central aiming axis of the LEDs, at about that same intensity down to a sharp transition with no more than 10% intensity at three degrees above horizontal, and zero intensity (i.e., full cutoff) at and below horizontal.

C. Exemplary Apparatus Embodiment 2

FIGS. 10A-I illustrate an alternative sharp cutoff LED uplight luminaire 100 designed to have a lower cutoff transition (i.e., from full light to no light) over an angle of five degrees or less, an upper cutoff on the order of 30 to 45 degrees from the central aiming axis of the LEDs (which can differ from the aiming of adjustable armature 109 and/or the external visor), an upper cutoff transition as desired but not necessarily as sharp as the lower cutoff, and further including structure to permit shedding of baseballs, detritus, and water—which allows baseballs, precipitation, and debris to pass through while trapping virtually all light allowed to enter said structure. Similar to apparatus 600 of Embodiment 1, uplight luminaire 100 has a total height 142 on the order of 10 inches and a total length 141 on the order of 22 inches, and generally comprises: a compact array of LEDs with associated optics (collectively, reference no. 111) in a single row which is on the order of one inch high and twenty to thirty inches in width, and which is mounted to a thermally conductive housing body 104; a light transparent or light transmissive lens 102 which seals against an open portion of housing body 104 and through which light from said LEDs and associated optics (here, secondary lenses) project; an adjustable armature 109 for vertically aiming about 12 to 15 degrees above horizontal or as desired, for horizontal aiming as desired, and for affixing body 104 of luminaire 100 to a crossarm or other structure roughly 10 to 40 feet above ground; a plurality of heat fins 103 affixed to or otherwise integral to housing body 104 so to aid in dissipating heat from the LEDs; a primary reflective surface 110; side visor portions 105 which add rigidity and could be made reflective, if desired; side housing portions 106 which affix primary reflective surface 110 and side visor portions 105 to housing body 104; and one or more ribbed or blackened portions 101 of housing body 104 or other portion of luminaire 100 to aid in reducing internal glow, perceived glare, and/or back light.

However, unlike Embodiment 1, a "light trap" space is created at 112 via openings 107 and 108, and surfaces 127, 129, 130, 131, and 132, at least some of which of said surfaces are coated (e.g., product number 8910-9000 gloss black urethane paint available from TCI Powder Coatings, Ellaville, Ga.) or otherwise formed (e.g., Privaguard glass in 4 mm thickness available from Guardian Industries Corporation, Carleton, Mich.) from materials that predominately absorb light, but what little is reflected is reflected specularly. This is counterintuitive to typical lighting design insomuch that it is usually believed diffuse reflection is a better choice when the goal is to trap, diminish, or remove light or undesirable effects from light—because diffuse surfaces are so effective at removing harshness and providing a more muted visual. However, it was found that diffuse surfaces produced a significant internal glow from space 107 (even though space 107 is only on the order of four inches by twenty inches) or onto the ground via space 108 (thereby creating bright spots and uneven light) due to uncontrolled reflection; and this could pose a glare concern or be distracting to players or others. Contrarily, since specular surfaces reflect light in a known way—each incident ray is reflected, with the reflected ray having the same angle to the surface normal as the incident ray—it was found internal light trap surfaces 127, 129, 130, 131, and 132 could be designed to work together to effectively bounce light around until fully absorbed (or any remaining reflected light that emerges to be insignificant or imperceivable).

Figure 12B:
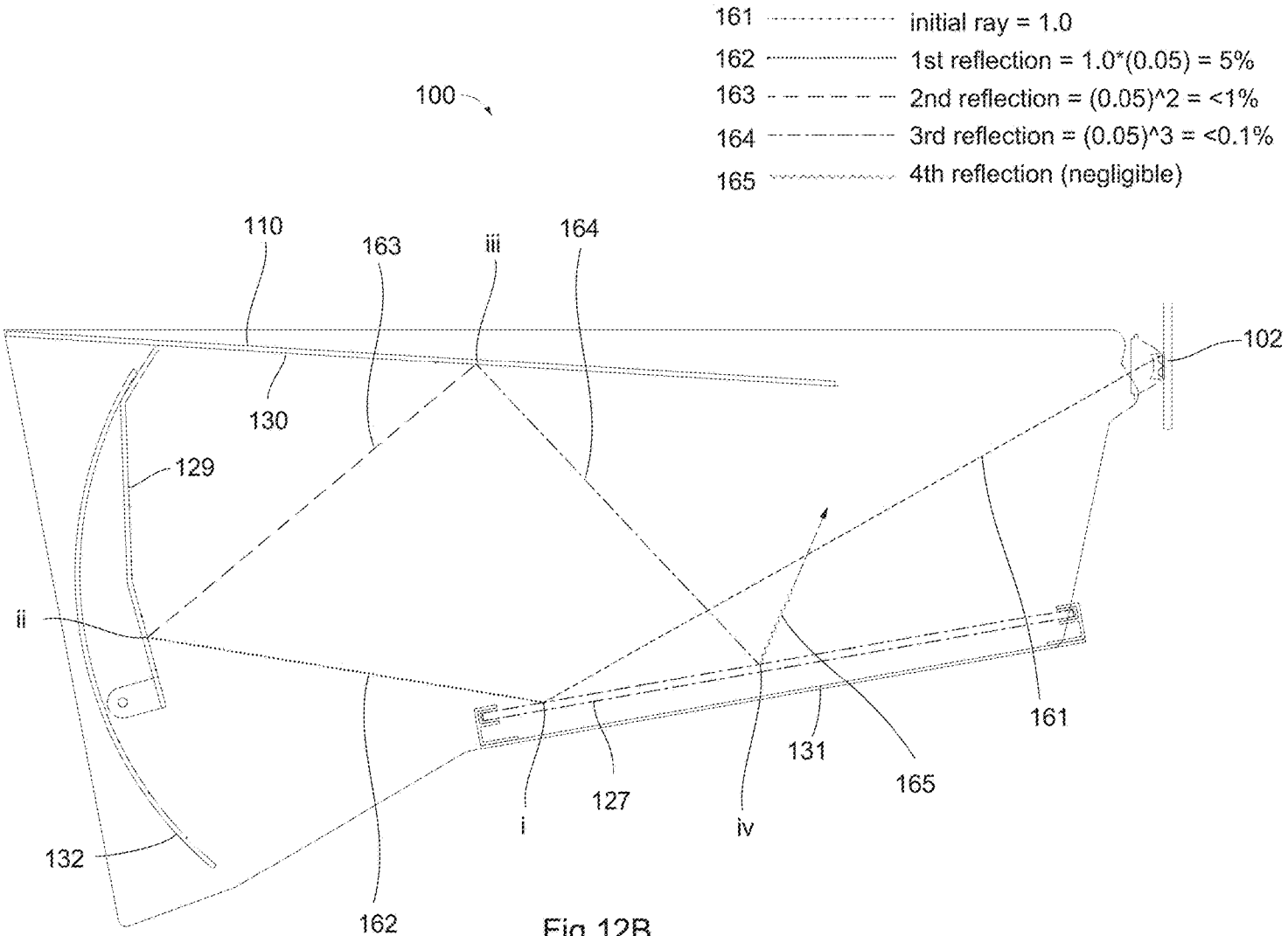

FIG. 12A illustrates a virtual representation of rays of light projected from the LEDs of luminaire 100 into light trap 112. As can be seen, reflective surface 110 is slightly sloped downward relative and towards the array of LEDs/secondary lenses 102 such that only the distalmost tip is directly horizontal; here, sloping in on the order of 3 degrees, which is adequate to allow a baseball to—by way of gravity—fall through and to the ground, while still providing desired uplight 140. Surfaces which make up light trap 112 (here, 127, and 129-132) absorb on the order of 90% to 95% percent of incident light and are positioned, angled, and shaped to create a light trap which reduces intensity of any light that escapes by 99.9% by ensuring at least three reflections before leaving light trap 112. So the light rays 144 which travel through the upper ball gap 107 can be seen to reflect off of internal surfaces in the light trap, all of which are light absorbing. For example, surfaces 129-132 are coated with reflective but light absorbing paint which (because it is specular) accurately reflects light to avoid creating haze or uncontrolled light spreading, but (because it absorbs on the order of 95% of all light which strikes it) reduces the intensity each time any time it lands thereon. And with each reflection, most of the light is absorbed, and the remaining light which is reflected strikes another light absorbing surface, such that after three reflections, so little light is reflected as to be invisible in the context of the available light at a baseball game. This is illustrated for a single representative light ray 161 in FIG. 12B; note the relative intensities of reflections 162-165 after reflection at points i-iv. For purposes of outdoor illumination, it will be seen that ray 165 may escape out upper opening 107 after having reflected several times. However, since each surface absorbs approximately 95% of incident light (in other words, at each reflection, only 1/20th of the light intensity remains), and each ray reflects at least three times, this means that for a light ray having an arbitrary relative intensity of 10,000, the remaining intensity will be no more than 10,000/20^3, or a relative intensity of 1.25 out of the original 10,000. In percentage terms, this is equal to 0.0125% of the original light intensity. Having lost around 99.99% of the original intensity, this is well below the intensity that would create visible reflection on a pole or support structure. Note that even if a more conservative value for absorption of 90% is used, this is still 10,000/10^3 or a relative intensity of 10 out of the original 10,000 or 0.1%; with 99.9% of the original intensity absorbed.

It should be noted that the light trapping function is enhanced by the use of light absorbing glass 127 which specularly reflects some of the light striking it, but absorbs on the order of 95% of the light traveling through it. Once that light then strikes surface 131, again 95% of the remaining light is further absorbed—but what is reflected must travel back through glass 127 and be further reduced by 95% before reflecting further in the light trap; this maximizes the trapping of light for the given space. Also, the end section including surface 129 and surface 132 purposefully includes both a cylindrical section and a planar section, and is selected to provide the best light trapping characteristics for this fixture configuration; however, other shapes are possible such as a simple cylindrical section, with potentially somewhat lesser light trapping effectiveness for a reduction in cost. Other curved shapes could be used or a flat or faceted plate could be used, as long as all the potential light paths are considered and accounted for (e.g., by making sure they result in at least three reflections off the specular but light absorbing surfaces) the results of which could be proven by analysis or experimentation.

Figure 13B:
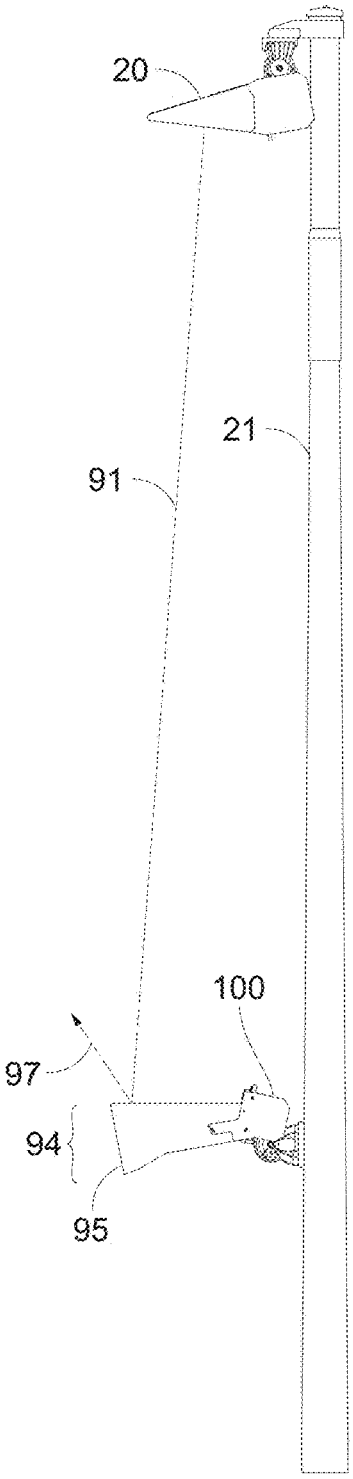

Also, it can be appreciated that the exterior surface of light trap 112 (reference no. 95, FIG. 13B) is so designed not only to provide protection and rigidity for surfaces 127, 129-132, but also to prevent onsite glare due to a lighting fixture 20 higher on a common pole 21. As is illustrated in FIG. 13A, a curved outer surface 93 (e.g., matching curvature of surface 132) was shown during testing to demonstrate undesirable reflections 92 from light 91 from a luminaire higher in the array of luminaires on a pole; as such, a planar surface 95 was selected (despite potential additional manufacturing steps and material), and testing has shown that reflection 97 from light 91 is instead directed upwardly and does not create glare at 94.

In practice, luminaire 100 could employ on the order of 80 model XP-L2 LEDs available from Cree, Inc., Durham, N.C., USA, operated below maximum rated current with no active cooling and still provide adequate uplighting above a field when mounted at customary distances for standard pole locations. Such uplight levels might be on the order of 10 fc near the ground and less in the higher elevations above the field for a Class I baseball field and on the order of 1-5 fc for smaller fields or at a lower class of play. Adjustable armature 109 which provides both horizontal and vertical aiming capabilities may be designed in accordance with US Patent Publication No. 2011/0149582 incorporated by reference herein in its entirety, or otherwise. The external visor (here, parts 110, 105, and any other parts or fastening devices affixed to housing body 104 by side housing portions 106) could be fixed, or could be pivotable using means and methods described in U.S. Pat. No. 9,631,795 incorporated by reference herein in its entirety, or otherwise. Secondary lenses could comprise TIR wide beam secondary lenses (e.g., any of the FNP models of lenses available from Fraen Corporation, Reading, Mass., USA adapted to work with the aforementioned model of LED), a complex lens system or lenses designed to produce a very wide beam (which could aid in reducing transmission losses and re-absorption that contributes to internal glow), or even simple reflectors in lieu of secondary lenses (e.g., a scaled down (i.e., suitable for a single LED) version of any model of reflector available from the aforementioned Cree); namely, any light directing or light redirecting device which harnesses at least a majority of light from its associated LED (and typically abuts the LED board which is mounted to an internal surface of the housing and at least partially surrounds the associated LED, though this is by way of example and not by way of limitation). Also, as may be appreciated, in practice the upper and/or lower gaps may be significantly smaller for sports such as football or soccer where avoiding trapping the ball is either not important or not practical, but where there is a significant advantage to releasing aerial detritus such as insects, leaves, and precipitation. In this case, the gap could be quite small, on the order of one to two inches in width or even smaller on the order of ¼ to 1 inch, or may not even require a light trap (as in Embodiment 1).

D. Exemplary Method for Embodiments 1 and 2

It may be appreciated that for a player tracking a ball, it is generally accepted that a lower level of lighting higher in the air is sufficient since the ball is typically placed against a black sky background. As the ball falls down, lighting needs to get more intense as the ball transitions into a zone where it is lit by the downlights—because the background is no longer dark but sufficient contrast still needs to exist to complete a task (like catching the ball). If the transition from full light to no light (i.e., cutoff) is over too many degrees, the ball as it travels through the variable light from the lighting apparatus will appear to dim down abruptly before it flashes bright again in the full field lighting, which is considered undesirable in the sport. As mentioned, U.S. Pat. No. 7,976,198 discusses this subject extensively (in e.g., columns 2-6 and 17-18), and provides an example (in FIG. 3C of said patent, which is included herein as FIG. 18) of aerial illumination levels 700 in footcandles at various heights that are considered desirable for at least some locations, and which is considered at least one exemplary accepted or desired standard for aerial illumination as enabled by the current embodiments. Note that the light levels in FIG. 18 are highest just above above ground level and diminish smoothly with each increase in elevation.

Diagrams 170 FIG. 14A and 181 FIG. 14B represent angle space plots of light from uplights according to prior art and according to Embodiment 2, respectively. As can be seen, prior art luminaires (e.g., 22, FIG. 2) use a lower visor to create a lower cutoff from the 50% light level at zero degrees from horizontal. Plot 170 represents fixture aiming at 13.5 degrees above horizontal—which is the lowest angle that places the lower cutoff at/above horizontal (0 degrees). It may be seen that the upper light extent is around ninety degrees above horizontal and that there is a large range (e.g., on the order of 10 vertical degrees) where intensity is lacking (i.e., just above horizontal). Alternatively, in FIG. 14B the angle space plot shows a nearly ideal distribution of lighting intensity from the least amount at 60 degrees above the central aiming axis of the light sources down of the light sources to nearly full intensity at the central axis, and at about that same intensity down to a sharp transition three degrees above horizontal, and zero intensity at and below horizontal. Illustrated differently, FIGS. 15A-B show the differences in vertical beam spread and intensity distribution between a luminaire according to prior art and Embodiment 24. It is quite clear from FIGS. 14A-15B that Embodiments 1 and 2 provide a more desirable distribution of light within the composite beam (the composite beam being the sum of individual beams from the light sources), as well as a more compact beam (which wastes less light), and with sharper cutoff.

Figure 8:
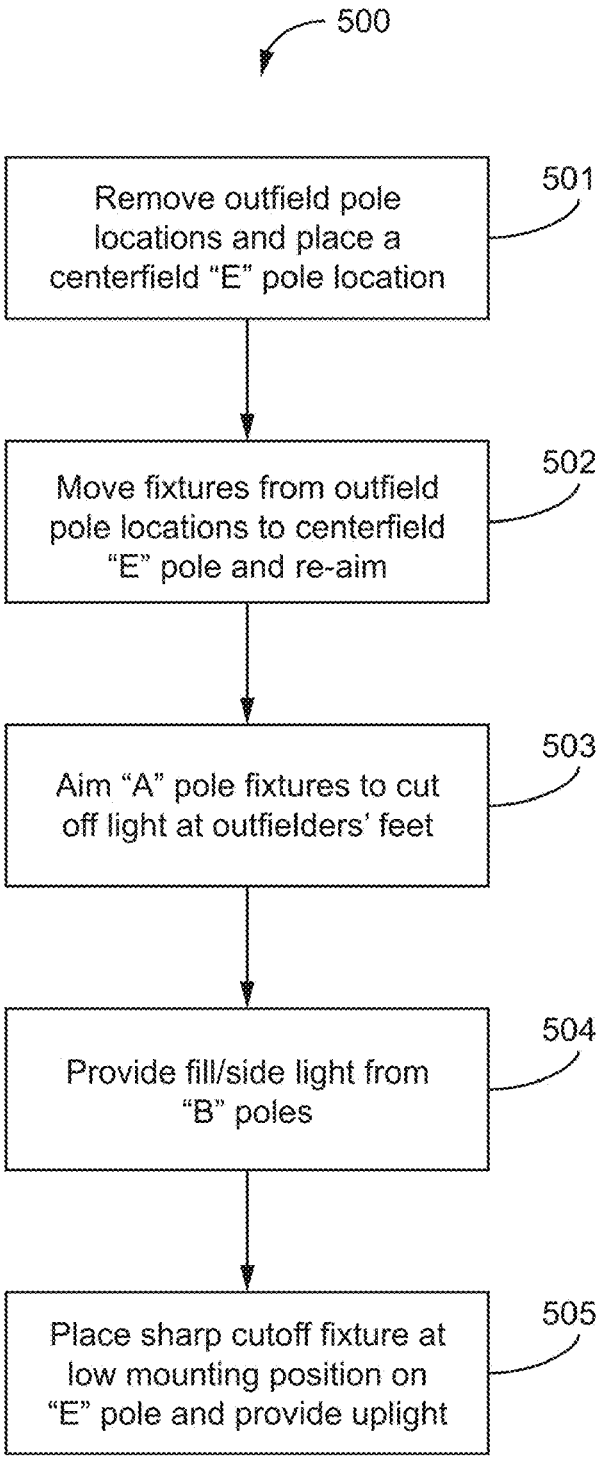
FIG. 8 illustrates a method for reducing pole count for a lighting application while providing low-mounted uplight according to aspects of the present invention.

FIGS. 14A-15B set forth the basic motivation for a method of designing a lighting system based upon the uplight luminaires of Embodiments 1 and/or 2. More specifically, FIGS. 14A-15B set forth the basic understanding necessary to design a baseball lighting system which seeks to minimize pole count to realize benefits already described. This particular method is illustrated in FIG. 8 and flows thusly.

A first step 501 of method 500 directed to reducing pole count in baseball or softball lighting comprises removing one or more outfield pole locations in favor of an "E" pole location as previously described. A second step 502 comprises relocating one or more of the light sources from the removed poles and adding them to the top of the E pole—which may require additional crossarms or a more substantial pole at the E location than is used elsewhere (but still provides overall cost savings). The field lighting luminaires of pole E are typically aimed so to cut off light near the feet of a batter.

It is of note that step 502—and more generally all steps of method 500—is referring specifically to virtual lighting fixtures insomuch that method 500 is likely to be implemented during the design stage when virtual lighting designs are being generated, though method 500 could be implemented in real time on a field—in which case it would likely be a retrofit situation. However, method 500 could also be applied to new builds (e.g., after the lighting design stage, but before trenches are dug and poles are set).

According to step 503 the luminaires at the top of "A" poles—which were not removed from the design—are aimed so to generally provide cutoff at the outfielders' feet. As such, fill or side light is provided from the luminaires at the top of the "B" poles so to ensure light levels at the field are met (step 504).

To provide adequate modeling of a ball in flight, and to provide adequate light levels to track a ball in flight, according to step 505 one or more of luminaires 100 and/or 600 may be affixed to the E pole to provide uplight; luminaires 100 and/or 600 may also be affixed to A and B poles, if desired. The precise mounting height and aiming angle of luminaires 100 and/or 600 will depend on the size of the field, pole position relative the field, level of play, etc.; FIG. 16A illustrates one particular example for a luminaire of Embodiment 2 affixed to an E pole for a professional level baseball field lighting application. As can be seen from FIG. 16A, luminaire 100 may be mounted at a height of 25 feet some distance away from an aiming location X, resulting in a composite beam having a distribution from an upper beam 203 down to full cutoff (with intermediate beams 204-207 therebetween). FIG. 16B illustrates the various vertical heights where different portions of the beam hit for both a prior art LED luminaire used as an uplight, and an Embodiment 2 luminaire. The values in FIG. 16B when taken together with the context of a ball in flight (see FIGS. 1C and D) clearly demonstrates not only an improvement of putting light where it is needed (and with an ideal or near ideal distribution within the beam) in accordance with the present invention, but also how mounting height can be tailored to suit aiming (which is beneficial for designing a lighting design which includes not only uplight, but contributions from poletop luminaires, different pole locations, etc.).

E. Options and Alternatives

The invention may take many forms and embodiments. The foregoing examples are but a few of those. To give some sense of some options and alternatives, a few examples are given below.

With respect to Embodiment 2, it can be appreciated that the amount of light trapping could be impacted by the number and design of components 127, 129-132 in addition to the general shape and size of areas 107, 108, and 112. FIGS. 9A-C illustrate a few different options and alternatives. FIG. 9A illustrates a modified fixture 100*a* which has removed of all but surface 130 from light trap area 112; this could result in unwanted light 32*a* on the ground and unwanted back light 31*a* on the pole (albeit less than in state-of-the-art fixtures), but could be very economical to produce. In FIG. 9B, a differently modified luminaire 100*b* has surface 130 and an additional surface for a more direct drop of a ball (and fewer internal reflections). Unwanted reflection/glare 31*b* on pole is eliminated, but there may still be some light 32*b* on the ground. Again, it may be a matter of cost or manufacturability, or degree of perceived glare. Finally, FIG. 9C shows luminaire 100 as previously illustrated and described; both unwanted light 32*c* and back light

31*c* are eliminated. All of the aforementioned are contemplated as possible options and alternatives.

In that same vein, it is entirely possible that some degree of downlight is desirable at the target area proximate the uplight fixtures. Oftentimes the area closest to the pole is the hardest to light because it can become an all-or-nothing situation—blast the area with light (thereby creating bright spots), or leave it less than adequately illuminated. This is due to the nature of light; namely, that due to the Inverse Square Law, if an area far away is adequately illuminated by a source, an area close is illuminated too much by that same source. As such, aspects of the present invention may be modified to specifically address light distribution at the target area near the base of a pole. For context, FIG. 17A illustrates an angle space plot for fixture 22, FIGS. 1A, 1C; as can be seen, there is no measurable light on the field (here, defined as below horizon), but too much back light (thereby posing a glare hazard). FIG. 17B illustrates an angle space plot for fixture 600 of Embodiment 1 modified to have a gap similar to that of Embodiment 2; as can be seen, there is a large amount of downlight and virtually no backlight. FIG. 17C illustrates an angle space plot for fixture 100*a* of FIG. 9A with all portions of light trap 112 reflective; as can be seen, there is less downlight than that of FIG. 17B (which may be desirable), but slightly more back light. Finally, FIG. 17D illustrates an angle space plot for fixture 100 wherein all portions of light trap 112 are made light absorbing (e.g., by coating with black felt or other material); as can be seen, backlight and downlight are imperceivable. All of the aforementioned are contemplated as possible options and alternatives.

More broadly and regarding both embodiments, there are a number of options and alternatives. For example, LEDs could be paired with secondary lenses or reflectors, or some other kind of optic (e.g., films or filters); this could be on a one-to-one basis (i.e., one optic per LED), or otherwise. The LEDs themselves could be white, colored, some combination, or include color films on lens 602 or associated optics so to produce a desired theatrical effect (e.g., perceivably white uplight but colored downlight which matches team colors); light sources could even be other than LEDs (e.g., laser sources). The envisioned luminaires could have one or more portions blackened to reduce internal glow—this could extend to portions of the pole, crossarm, etc. so to aid in reducing back light. Even lens 602 could be partially blackened so to produce a composite beam of desired dimensions (albeit to the detriment of light level). To "blacken" a component could comprise painting said component black, taping said component with black tape, forming said component from a black material, layering a black material (e.g., cloth) over said component, etc. —and could extend to colors other than black (e.g., for aesthetic reasons). Finally, it should be noted that while specific examples of materials, forming techniques, fastening methods, etc. may have discussed herein, a wide variety of options and alternatives exist, and could be used. For example, the generally opposite side of reflective surface 110 may be painted to produce surface 130, surfaces 110 and 130 could be discrete components that are glued or riveted together, or otherwise.

What is claimed is:

1. An uplight lighting fixture comprising:

a. a thermally conductive housing having a plurality of sides, an internal space including an internal surface, and an opening through one or more sides into the internal space;

b. a row of one or more light sources mounted to the internal surface, said one or more light sources having a central aiming axis and producing a composite beam;

c. one or more optics associated with the one or more light sources and contained within the internal space;

d. a lens having a plurality of sides and sealed against the opening in the housing, the lens being light transmissive or light transparent such that the composite beam projects through the lens when the lens is sealed against the opening in the housing;

e. external visor affixed to one or more sides of the housing and proximate one side of the lens, the external visor having at least one reflective surface and a distalmost tip which cuts off light from the composite beam projected through the lens;

f. a ribbed portion affixed to or on one or more sides of the housing and proximate one side of the lens at a position opposite to the external visor such that the ribbed portion absorbs or traps at least a portion of the composite beam reflected off the at least one reflective surface of the external visor; and g. an armature affixed to a side of the housing and adapted to orient the housing relative a pole or other structure so to direct the projected composite beam away from a plane.

2. The uplight lighting fixture of claim 1 wherein the external visor further comprises structure to permit pivoting of the external visor relative the housing, and wherein light cutoff is selectable via pivoting of the external visor.

3. The uplight lighting fixture of claim 2 wherein light is cut off 12 degrees below the central axis by the external visor.

4. The uplight lighting fixture of claim 2 wherein the armature directs the projected composite beam away from a first plane, and wherein light is cut off below a plane parallel to the first plane.

5. The uplighting fixture of claim 4 wherein the first plane comprises a surface to which the pole or other structure is affixed.

6. The uplight lighting fixture of claim 4 wherein the composite beam has a maximum intensity, and wherein the external visor is pivoted such that the maximum intensity of the composite beam is eight degrees above the plane parallel to the first plane.

7. The uplight lighting fixture of claim 1 wherein the row of one or more light sources comprises a single row of light sources.

8. The uplight lighting fixture of claim 7 wherein the light sources are LEDs.

9. The uplight lighting fixture of claim 1 wherein the external visor further comprises one or more light absorbing surfaces positioned relative the projected composite beam so to prevent illuminating the plane and the pole or other structure.

10. The uplight lighting fixture of claim 1 wherein the external visor further comprises one or more light reflecting surfaces positioned relative the projected composite beam so to prevent illuminating the plane or the pole or other structure.

11. An uplight lighting fixture comprising:

a. a housing including one or more light sources and an emitting face through which a composite beam of light from the one or more light sources is emitted;

b. an external visor having at least one reflective surface and a distalmost tip which cuts off light from the composite beam and one or more of:

i. one ore more light absorbing surfaces positioned relative the emitted composite beam so to prevent illuminating a plane and a pole or other structure; beam ii. a gap in the reflective surface to permit objects of a selected size to pass through; and c. an armature affixed to the housing and adapted to aim the housing relative the pole or other structure so to direct the emitted composite beam away from the plane;

d. wherein some portion of the armature, some portion of the external visor, or some portion of the armature and some portion of the external visor is adjustable so to select light cutoff or aiming.

12. The uplight lighting fixture of claim 11 wherein the one or more light sources comprises a single row of LEDs.

13. The uplight lighting fixture of claim 11 wherein the external visor further comprises one or more light reflecting surfaces positioned relative the emitted composite beam so to prevent illuminating the plane or the pole or other structure.

14. The uplight lighting fixture of claim 11 wherein the external visor further comprises one or more light reflecting or light absorbing surfaces positioned relative the emitted composite beam so to direct a specific portion of the composite beam to the plane.

* * * * *